US012398636B2

(12) United States Patent
Fettis et al.

(10) Patent No.: US 12,398,636 B2
(45) **Date of Patent: *Aug. 26, 2025**

(54) PROCESSES AND CONFIGURATIONS FOR SUBTERRANEAN RESOURCE EXTRACTION

(71) Applicant: 102062448 Saskatchewan Ltd., Corman Park (CA)

(72) Inventors: Bradley V. A. Fettis, Corman Park (CA); Donald Joseph Larmour, Saskatoon (CA); Don John Gendzwill, Saskatoon (CA)

(73) Assignee: 102062448 Saskatchewan Ltd., Corman Park (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/349,579

(22) Filed: Jul. 10, 2023

(65) Prior Publication Data

US 2023/0358128 A1 Nov. 9, 2023

Related U.S. Application Data

(63) Continuation of application No. 17/086,104, filed on Oct. 30, 2020, now Pat. No. 11,739,624.

(Continued)

(51) Int. Cl.

| | |
|---|---|
| ***E21B 43/28*** | (2006.01) |
| ***E21B 43/241*** | (2006.01) |
| ***E21B 43/30*** | (2006.01) |

(52) U.S. Cl.

CPC ..... *E21B 43/28* (2013.01); *E21B 43/305* (2013.01); *E21B 43/241* (2013.01)

(58) Field of Classification Search

CPC ..... E21B 7/046; E21B 43/241; E21B 43/43; E21B 43/28; E21B 43/283; E21B 43/30; E21B 43/305

See application file for complete search history.

(56) References Cited

U.S. PATENT DOCUMENTS

| | | | |
|---|---|---|---|
| 3,309,141 | A | 3/1967 | Fitch et al. |
| 4,221,433 | A | 9/1980 | Jacoby |

(Continued)

FOREIGN PATENT DOCUMENTS

| | | | |
|---|---|---|---|
| CA | 2006926 | A1 | 6/1990 |
| CA | 2822840 | A1 | 12/2014 |

(Continued)

OTHER PUBLICATIONS

International Search Report and Written Opinion mailed Jan. 5, 2021 in International Patent Application No. PCT/CA2020/051477 (8 pages).

(Continued)

*Primary Examiner* — Janine M Kreck

(74) *Attorney, Agent, or Firm* — SMART & BIGGAR LP; Tonino Rosario Orsi

(57) ABSTRACT

Processes and configurations for subterranean resource extraction are provided. The processes include installing borehole strings, such as by drilling a plurality of boreholes, for example, first and second boreholes, that extend from a surface region into a resource deposit. The first and second boreholes are situated adjacent to each other. Portions of the first and second boreholes laterally extend in a penannularly fashion and connect terminally at a nodal space situated within the resource deposit. Carrier fluid is injected from the surface along fluid paths defined by the boreholes to in situ leach resource materials from the resource deposit into the carrier fluid, and carrier fluid containing the resource materials is brought back to surface for resource extraction.

19 Claims, 26 Drawing Sheets

Related U.S. Application Data

(60) Provisional application No. 62/929,705, filed on Nov. 1, 2019.

(56) References Cited

U.S. PATENT DOCUMENTS

| | | | | |
|---|---|---|---|---|
| 4,264,104 | A | 4/1981 | Helvenston et al. | |
| 4,385,662 | A | 5/1983 | Mullins et al. | |
| 5,246,273 | A | 9/1993 | Rosar | |
| 2006/0039842 | A1 | 2/2006 | Day et al. | |
| 2008/0068211 | A1 | 3/2008 | Aiello | |
| 2010/0225254 | A1 | 9/2010 | Takata | |
| 2011/0127825 | A1* | 6/2011 | Hughes | E21C 37/00 299/4 |
| 2011/0175428 | A1 | 7/2011 | Haugen | |
| 2012/0027516 | A1 | 2/2012 | Day et al. | |
| 2012/0043800 | A1 | 2/2012 | Wentworth et al. | |
| 2013/0192831 | A1 | 8/2013 | Diehl et al. | |
| 2015/0137578 | A1 | 5/2015 | Colome | |
| 2019/0368330 | A1 | 12/2019 | Hardage et al. | |
| 2020/0011151 | A1* | 1/2020 | Toews | C09K 8/572 |

FOREIGN PATENT DOCUMENTS

| | | | |
|---|---|---|---|
| CN | 104612691 | B | 2/2017 |
| CN | 109026002 | A | 12/2018 |
| WO | 2003095795 | A1 | 11/2003 |
| WO | 2008131212 | A2 | 10/2008 |
| WO | 2020006620 | A1 | 1/2020 |

OTHER PUBLICATIONS

Supplementary European Search Report dated Oct. 6, 2023 in European Patent Application No. EP20881065.5 (9 pages).

* cited by examiner

PROCESSES AND CONFIGURATIONS FOR SUBTERRANEAN RESOURCE EXTRACTION

RELATED APPLICATION

This application is a continuation of U.S. patent application Ser. No. 17/086,104, filed Oct. 30, 2020, which claims the benefit of U.S. Provisional Patent Application No. 62/929,705 filed Nov. 1, 2019; the entire contents of each of which are hereby incorporated by reference.

FIELD OF THE DISCLOSURE

The present disclosure generally relates to resource extraction, and in particular to processes and configurations for subterranean resource extraction.

BACKGROUND

The following paragraphs are provided by way of background to the present disclosure. They are not however an admission that anything discussed therein is prior art or part of the knowledge of persons skilled in the art.

Various techniques have evolved to extract and recover valuable subterranean resources, including mineral resources, such as potash, for example, from geological formations. One such technique, commonly referred to as in situ leaching, involves the drilling of boreholes from the surface into a subterranean resource deposit, and the subsequent injection of a fluid from surface into the borehole to in situ leach the resource material from the deposit into the fluid for recovery at the surface. Significant benefits can be said to be provided by resource extraction based on in situ leaching relative to more traditional subterranean mining practices. Thus, for example, resource extraction involving in situ leaching does not require the deployment of an underground workforce, only a limited amount of underground rock material needs to be removed, and the capital costs associated with resource extraction based on in situ leaching are generally lower than those associated with conventional mining or resource extraction operations.

For example, the performance of known primary potash solution mining techniques commonly initially involves the formation of a subterranean cavern at the distal end of a vertically oriented borehole. Thereafter primary resource extraction can be initiated starting from the subterranean cavern. This may involve breaking layers of the resource deposit, which is a process commonly referred to as rubblizing, to create rubblized resource material which has an enlarged surface area, and then injecting a fluid, such as an unsaturated fresh water solvent, to dissolve the soluble resource material. The solvent fluid may be slowly pumped downwards from the surface into the borehole, for example, through a liner in the borehole, towards the cavern. Dissolution of resource material in the cavern in the solvent generally results in the formation of a brine. Once the concentration of resource material in the brine is sufficiently high, further solvent is injected from surface and the brine is circulated up to surface, for example, through the annulus of the borehole. A fluid flow rate through the cavern can be established to discharge the brine at the surface on a continuous basis. At the surface the brine can then be processed to recover the resource material, and waste minerals such as salt, are disposed of, typically in a surface tailings area.

Thus, a typical resource extraction configuration for in situ leaching resource extraction involves a vertically extended borehole comprising a distally situated subterranean cavern from which the resource material is leached and extracted.

Primary potash solution mining resource extraction according to the known techniques and configurations generally requires large ground surface areas, for example, large scale in situ leaching resource extraction based operations can contain 40 wells spread over ten or more square kilometers, thus having a significant environmental impact. At the same time, large amounts of the total resource content of subterranean resource deposits remain unmined using the mining techniques known to those skilled in the art. Furthermore, as noted, waste minerals are brought to the surface using conventional potash extraction techniques. Thus, at the surface, separation of the resource material and waste minerals is required. Tailing areas require further surface space. In addition, under windy conditions waste mineral material can escape from the tailings area and cause environmental contamination.

Furthermore, many operational parameters and properties of the resource deposit effect the efficiency of an in situ leaching resource extraction operation, including, for example, solvent flow rate, solvent temperature, resource deposit temperature, brine salinity and cavern geometry. Using known systems and techniques for in situ leaching resource extraction it is challenging to monitor or control these parameters and properties, thus resulting in a suboptimal recovery of minerals from the resource material from the subterranean resource deposit.

Thus, despite the availability of a variety of techniques for recovery of resource materials from subterranean resource deposits, the known techniques are insufficiently effective. There is an ongoing need in the art for improved processes for resource recovery from resource deposits, and in particular there is a need for improved techniques and configurations for in situ leaching resource recovery, including economic techniques and configurations which have a limited environmental impact.

SUMMARY

The following paragraphs are intended to introduce the reader to the more detailed description that follows and not to define or limit the claimed subject matter of the present disclosure.

In one broad aspect, the present disclosure relates to processes and configurations for extracting resource materials from a subterranean resource deposit.

In another broad aspect, the present disclosure relates to processes and configurations for extracting resource materials from a subterranean resource deposit which may be applied over relatively small surface regions, thereby limiting environmental impact, and inputs, notably energy and water, and reducing costs, while still recovering substantial quantities of resource materials, similar to or even exceeding the quantities that may be extracted using traditional resource extraction processes. In at least one embodiment, the mining configurations may be applied over a surface region of one square mile or less.

Accordingly, in one aspect, in accordance with the teachings herein, the present disclosure provides, in at least one embodiment, a process for in situ subterranean resource extraction from subterranean space comprising a resource deposit by extracting a resource from the resource deposit using a borehole configuration that comprises:

a) a first borehole string extending downward from a surface region into the resource deposit, the first borehole string comprising first and second sections, the first section extending downward from the surface region and the second section extending laterally in a first lateral direction from the first section into the resource deposit; and b) a second borehole string extending downward from the surface region into the resource deposit, the second borehole string situated adjacent to the first borehole string and comprising first and second sections, the first section extending downward from the surface region and the second section extending laterally in a second lateral direction from the first section of the second borehole string into the resource deposit, where the second sections of the first and second borehole strings penannularly extend to form a first planar region, and to distally connect the second sections at a nodal space so that a fluid path is formed downward from the surface region through the first borehole string to the nodal space and from the nodal space upward to the surface through the second borehole string, wherein the process comprises:

(i) injecting a carrier fluid from the surface region downward through the first or second borehole string along the fluid path to thereby in situ leach resource material from the resource deposit into the carrier fluid and increase internal volumes of the second sections of the first and second borehole strings, (ii) circulating the carrier fluid comprising the leached resource material along the fluid path via the nodal space and upward to the surface region through the second borehole string when injecting the carrier fluid through the first borehole string, or through the first borehole string when injecting the carrier fluid through the second borehole string; and (iii) recovering the carrier fluid comprising the in situ leached resource material.

In at least one embodiment, the first section of the first borehole string or the first section of the second borehole string can extend substantially vertically relative to the surface region.

In at least one embodiment, the second sections of the first and second borehole strings can extend generally in a horizontal direction relative to the surface region and the first planar region is situated substantially horizontal relative to the surface region.

In at least one embodiment, the circulating the carrier fluid can continue until the internal volumes of the first and second borehole strings have increased so that the average height along the lengths of the second sections of the first and second borehole strings have increased at least two-fold, while the average widths along the lengths of the second sections of the first and second borehole strings have increased at least as much as the increases in the heights.

In at least one embodiment, the circulating the carrier fluid can continue until the internal volumes of the first and second borehole strings have increased so that an average width along the lengths of the second sections of the first and second borehole strings have increased at least two-fold from initial widths of those sections, and thereafter, the process comprises stopping the carrier fluid circulation and maintaining the carrier fluid stagnant within the second sections of the first and second borehole strings for a period of at least one day, before recovering the carrier fluid through the first and/or the second borehole string.

In at least one embodiment, the borehole configuration can comprise first and second borehole strings comprising casing along a proximal portion of the first borehole string extension or the second borehole string extension.

In at least one embodiment, the process can comprise periodically injecting the carrier fluid in an alternating fashion through the first and the second borehole strings.

In at least one embodiment, the borehole configuration can comprise a third borehole string extending downward from the surface region, the third borehole string distally connecting at the nodal space in the resource deposit.

In at least one embodiment, the third borehole string can have a surface borehole string opening adjacent to the surface borehole string openings of the first and second borehole string.

In at least one embodiment, the third borehole string can have a surface borehole string opening spaced away from the surface borehole string openings of the first and second borehole string.

In at least one embodiment, the process can comprise assaying the subterranean resource deposit for the presence of the resource material by accessing the nodal space via the third borehole string with an assaying device prior to injecting the carrier fluid.

In at least one embodiment, the process can comprise injecting the carrier fluid from the surface region into the nodal space via the third borehole string and up to the surface region through the fluid path along the first borehole string or the second borehole string.

In at least one embodiment, the first borehole string can comprise:

a third section that extends laterally in a third lateral direction from the first section of the first borehole string into the resource deposit; and the second borehole string comprises a third section extending laterally in approximately a fourth lateral direction from the first section of the second borehole string into the resource deposit, where the third sections of the first and second borehole strings are formed to penannularly extend to form a second planar region, and to distally connect to form a second nodal space so that a second fluid path is formed downward from the surface region through the first borehole string to the second nodal space and from the second nodal space upward to the surface region through the second borehole string; and the process further comprises:

injecting the carrier fluid from the surface region downward through the first or the second borehole string along the first and second fluid paths to in situ leach resource material from the resource deposit and increase the internal volumes of the of the second and third sections of the first and second borehole strings, and circulating the carrier fluid comprising the resource materials along the fluid path via the first and second nodal spaces upward to the surface region through the second borehole string when injecting the carrier fluid in the first borehole string, or through the first borehole string when injecting the carrier fluid through the second borehole string, and recovering the carrier fluid comprising the in situ leached resource material.

In at least one embodiment, the first and second borehole strings can be a first borehole and a second borehole, respectively.

In at least one embodiment, the first section of the first borehole string can be a first tubular liner and the second section of the first borehole string is a first laterally extending borehole extending from the first tubular liner, the first section of the second borehole string is a second tubular liner and the second section of the second borehole string is a second laterally extending borehole extending from the second tubular liner, and the first sections of the first and second borehole strings together are installed in a first borehole extending from the surface region.

In at least one embodiment, the borehole configuration can comprise a fourth borehole string, the fourth borehole string extending downward from the surface region into the resource deposit, and distally connecting to the second nodal space.

In at least one embodiment, the third sections of the first and second borehole strings can be at the same depth so that the first and second planar regions are situated at approximately at the same depth relative to the surface region.

In at least one embodiment, the third sections of the first and second borehole strings can be at different depths so that the first and second planar regions are situated at two different depths relative to the surface region.

In at least one embodiment, the surface region below which the borehole configuration can be implemented is twenty five square mile or less.

In at least one embodiment, the surface region below which the borehole configuration is implemented can be one square mile or less.

In at least one embodiment, the first borehole string can comprise a first plurality of sections that extend laterally in a first plurality of different lateral directions from the first section of the first borehole string into the resource deposit; and the second borehole string can comprise a second plurality of sections that extend laterally in a second plurality of lateral directions from the first section of the second borehole string into the resource deposit, where the first plurality of sections is equal in number to the second plurality of sections, each section of the first plurality of sections penannularly extends with one section of the second plurality of sections to form a plurality of planar regions, and distally connects to form a plurality of nodal spaces so that a plurality of fluid paths are formed that flow downward from the surface region through the first borehole string to each of the nodal spaces and from the plurality of nodal spaces upward to the surface through the second borehole string;

and the process further comprises:

injecting the carrier fluid from the surface region downward through the first borehole string or the second borehole string along the plurality of fluid paths to thereby in situ leach resource material from the resource deposit and increase the internal volume of the first and second plurality of lateral extensions, and circulating the carrier fluid comprising the resource materials along the plurality of fluid paths via the plurality of nodal spaces and upward to the surface through the second borehole string when injecting the carrier fluid in the first borehole string, or through the first borehole string when injecting the carrier fluid through the second borehole string to thereby recover the carrier fluid comprising the in situ leached resource material.

In at least one embodiment, a plurality of additional borehole strings can extend downward from the surface region into the resource deposit, and each of the plurality of additional borehole strings distally connect to one of the plurality of nodal spaces.

In at least one embodiment, the plurality of additional borehole strings can be a plurality of boreholes.

In at least one embodiment, wherein the first section of a first plurality of the additional borehole strings can correspond with an equal first plurality of tubular liners and the second section of the first plurality of the additional borehole strings corresponds with an equal plurality of laterally extending boreholes extending from the first plurality of tubular liners, the first section of a second plurality of the additional borehole strings corresponds with an equal second plurality of tubular liners and the second section of the second plurality of the additional borehole strings corresponds with an equal plurality of laterally extending boreholes extending from the second plurality of tubular liners, and the first sections of the first and second plurality of the additional borehole strings are together installed in a first borehole extending from the surface region.

In at least one embodiment, the plurality of additional borehole strings can be spaced away from one another and from the first and second borehole strings.

In at least one embodiment, the plurality of additional borehole strings can be radially disposed relative to the first and second borehole strings.

In at least one embodiment, the first section of the first borehole string can be a first tubular liner 190*a* and the second section of the first borehole string is a first laterally extending borehole extending from the first tubular liner 190*a*, the first section of the second borehole string is a second tubular liner 190*b* and the second section of the second borehole string is a second laterally extending borehole extending from the second tubular liner 190*b*, and the first sections of the first and second borehole strings together are installed in a first borehole extending from the surface region.

In at least one embodiment, the process can comprise subsequently injecting the carrier fluid from the surface region into the nodal space via one or more of the plurality of additional borehole strings and up to the surface region through the fluid path along the first and second borehole strings.

In at least one embodiment, the resource material can comprise first and second chemical constituents, and the process comprises circulating the carrier fluid wherein the first chemical constituent in situ leaches into the carrier fluid, and the second chemical constituent is retained in situ and forms a porous matrix.

In at least one embodiment, the first chemical constituent can potassium chloride, and the second chemical constituent is sodium chloride.

In at least one embodiment, the resource material can be an evaporite.

In at least one embodiment, the carrier fluid can be a solvent and the resource material is an evaporite that is soluble in the solvent.

In at least one embodiment, the evaporite can be potash.

In another aspect, the present disclosure provides, in at least one embodiment, a process for constructing a mining configuration for subterranean resource extraction from a resource deposit, the process comprising:

installing a plurality of borehole strings extending downward from a surface region by:

installing a first borehole string extending downward from the surface region into the mineral deposit, the first borehole string comprising first and second sections, the first section extending downward from the surface region and the second section extending laterally in a first lateral direction from the first section into the resource deposit; and installing a second borehole string extending downward from the surface region into the resource deposit, the second borehole string situated adjacent to the first borehole string and comprising first and second sections, the first section extending downward from the surface region and the second section extending laterally in a second lateral direction from the first section of the second borehole string into the resource deposit, where the second sections of the first and second borehole strings penannularly extend to form a first planar region, and to distally connect at a nodal space to thereby form a fluid path downward from the surface region through the first borehole string to the nodal space and from the nodal space upward to the surface through the second borehole string.

In at least one embodiment, the process can comprise forming the first section of the second borehole string, and the first section of the second borehole string to extend substantially vertically relative to the surface region.

In at least one embodiment, the process can comprise forming the second sections of the first and second borehole strings to extend generally in a horizontal direction relative to the surface region and the first planar region is situated substantially horizontal relative to the surface region.

In at least one embodiment, the process can comprise casing the second section of the first and second borehole strings along a proximal portion of the first borehole string extension or the second borehole string extension.

In at least one embodiment, the process can comprise installing a third borehole string extending downward from the surface region, the third borehole string distally connecting at the nodal space in the resource deposit.

In at least one embodiment, the process can comprise installing the third borehole string to have a surface borehole string opening adjacent to the surface borehole string openings of the first and second borehole strings.

In at least one embodiment, a plurality of additional borehole strings 471, 472, 473, and 474 can extend downward from the surface region into the resource deposit, and each of the plurality of additional borehole strings distally connect to one of the plurality of nodal spaces.

In at least one embodiment, the first and second borehole strings can be boreholes and the installing comprises drilling each of the boreholes to form the boreholes.

In at least one embodiment, wherein the first sections 477*a* and 477*b* of a first plurality 475 of the additional borehole strings 471, 472, 473, and 474 can correspond with an equal first plurality 479 of tubular liners 478*a* and 478*b* and the second sections 105*b* and 105*d* of the first plurality 475 of the additional borehole strings 473 and 474 correspond with an equal plurality of laterally extending boreholes 105-1 and 105-2 extending from the first plurality 479 of tubular liners 478*a* and 478*b*, the first sections 477*c* and 477*d* of a second plurality 476 of the additional borehole strings 471 and 472 correspond with an equal second plurality 480 of tubular liners 478*c* and 478*d* and the second sections 105*e* and 105*c* of the second plurality 476 of the additional borehole strings 471, and 472 correspond with an equal plurality of laterally extending boreholes 105-3 and 105-4 extending from the second plurality 480 of tubular liners 478*c* and 478*d*, and the first sections 477*a* and 477*b* of the first plurality 475 and first sections 477*c* and 477*d* of the second plurality 476 of the additional borehole strings 471, 472, 473, and 474 are together installed in a first borehole 105 extending from the surface region.

In at least one embodiment, the surface region below which the borehole configuration can be implemented is twenty five square mile or less.

In at least one embodiment, the surface region below which the borehole configuration can be implemented is one square mile or less.

In at least one embodiment, the process further can comprise:

providing the first borehole string with a third section that extends laterally in a third lateral direction from the first section of the first borehole string into the resource deposit; and providing the second borehole string with a third section extending laterally in approximately a fourth lateral direction from the first section of the second borehole string into the resource deposit, where the third sections of the first and second borehole strings are formed to penannularly extend to form a second planar region, and to distally connect to form a second nodal space and a second fluid path is formed downward from the surface region through the first borehole string to the second nodal space and from the second nodal space upward to the surface region through the second borehole string.

In at least one embodiment, wherein the process can comprise forming the third sections of the first and second borehole strings at the same depth so that the first and second planar regions are situated at the same depth relative to the surface region.

In at least one embodiment, the process can comprise forming the third sections of the first and second borehole strings at different depths so that the first and second planar regions are situated at two different depths relative to the surface region.

In at least one embodiment, the process can comprise providing the first borehole string with a first plurality of sections that extend laterally in a first plurality of different lateral directions from the first section of the first borehole string into the resource deposit; and providing the second borehole string with a second plurality of sections extending laterally in a second plurality of lateral directions from the first section of the second borehole string into the resource deposit, where the first plurality of sections is equal in number to the second plurality of sections, and each section of the first plurality of sections penannularly extends with one section of the second plurality of sections to collectively form a plurality of planar regions, and distally connects to collectively form a plurality of nodal spaces so that a plurality of fluid paths are formed that flow downward from the surface region through the first borehole string to each of the nodal spaces and from the plurality of nodal spaces upward to the surface through the second borehole string.

In at least one embodiment, the process can comprise installing a plurality of additional borehole strings that extend downward from the surface region into the resource deposit, and wherein each of the plurality of additional borehole strings distally connect to one of the plurality of nodal spaces.

In at least one embodiment, the process can comprise forming each of the additional borehole strings to be spaced away from one another and the first and second borehole strings.

In at least one embodiment, the process can comprise forming each of the plurality of additional borehole strings to be radially disposed relative to the first and second borehole strings.

In at least one embodiment, the resource material can be an evaporite.

In at least one embodiment, the carrier fluid can be a solvent and the resource material is an evaporite that is soluble in the solvent.

In at least one embodiment, the evaporite can be potash.

In another aspect, the present disclosure provides, in at least one embodiment, a process for subterranean resource extraction from a subterranean resource deposit, the process comprising:

installing a plurality of borehole strings extending downward from a surface region by:

installing a first borehole string extending downward from the surface region into the resource deposit, the first borehole string comprising first and second sections, the first section extending downward from the surface region and the second section extending laterally in a first lateral direction from the first section into the resource deposit; and installing a second borehole string extending downward from the surface region into the resource deposit, the second borehole string situated adjacent to the first borehole string and comprising a first and second section, the first section extending downward from the surface region and the second section extending laterally in a second lateral direction from the first section of the second borehole string into the resource deposit, where the second sections of the first and second borehole strings penannularly extend to form a first planar region, and to distally connect at a nodal space to thereby form a fluid path downward from the surface region through the first borehole string to the nodal space and from the nodal space upward to the surface through the second borehole string;

injecting a carrier fluid from the surface region downward through the first or second borehole string along the fluid path to thereby in situ leach resource material from the resource deposit into the carrier fluid and increase the internal volumes of the second sections of the first and second borehole strings;

circulating the carrier fluid comprising the leached resource material along the fluid path via the nodal space and upward to the surface region through the second borehole string when injecting the carrier fluid through the first borehole string, or through the first borehole string when injecting the carrier fluid through the second borehole string; and recovering the carrier fluid comprising the in situ leached resource material.

In at least one embodiment, the process can comprise forming the first section of the second borehole string, and the first section of the second borehole string to extend substantially vertically relative to the surface region.

In at least one embodiment, the process can comprise forming the second sections of the first and second borehole string to extend generally in a horizontal direction relative to the surface region and the first planar region is situated substantially horizontal relative to the surface region.

In at least one embodiment, the process can comprise continuing circulation of the carrier fluid until the internal volumes of the first and second borehole strings have increased so that the average heights along the lengths of the second sections of the first and second borehole strings have increased at least two-fold, while the average widths along the lengths of the second sections of the first and second borehole strings have increased at least as much as the height increases.

In at least one embodiment, the process can comprise continuing circulation of the carrier fluid until the internal volumes of the first and second borehole strings have increased so that average widths along the lengths of the second sections of the first and second borehole strings have increased at least two-fold from initial widths of those sections, and thereafter, the process comprises stopping the carrier fluid circulation and maintaining the carrier fluid stagnant within the second sections of the first and second borehole strings for a period of at least one day, before recovering the carrier fluid through the first and/or the second borehole string.

In at least one embodiment, the process can comprise casing the second section of the first and second borehole strings along a proximal portion of the first borehole string extension or the second borehole string extension.

In at least one embodiment, the process can comprise installing a third borehole string extending downward from the surface region, the third borehole string distally connecting at the nodal space in the resource deposit.

In at least one embodiment, the process can comprise installing the third borehole string to have a surface borehole string opening adjacent to the surface borehole string openings of the first and second borehole strings.

In at least one embodiment, the process can comprise installing the third borehole string to have a surface borehole string opening spaced away from the surface borehole string openings of the first and second borehole strings.

In at least one embodiment, the first and second borehole strings can be boreholes and the installing comprises drilling a borehole to form each of the boreholes.

In at least one embodiment, the first, second and third borehole strings are boreholes and the installing comprises drilling a borehole to form each of the boreholes.

In at least one embodiment, the process can comprise assaying the subterranean resource deposit for the presence of the resource material by accessing the nodal space via the third borehole string with an assaying device.

In at least one embodiment, the process can comprise subsequently periodically injecting the carrier fluid in an alternating fashion through the first and the second borehole strings.

In at least one embodiment, the process can comprise subsequently injecting the carrier fluid from the surface region into the nodal space via the third borehole string and up to the surface region through the fluid path along the first borehole string or the second borehole string.

In at least one embodiment, the process can comprise providing the first borehole string with a third section that extends laterally in a third lateral direction from the first section of the first borehole string into the resource deposit; and providing the second borehole string with a third section extending laterally in approximately a fourth lateral direction from the first section of the second borehole string into the resource deposit, where the third sections of the first and second borehole strings are formed to penannularly extend to form a second planar region, and to distally connect the third sections to thereby form a second nodal space and a second fluid path is formed downward from the surface region through the first borehole string to the second nodal space and from the second nodal space upward to the surface region through the second borehole string; and the process further comprises:

injecting the carrier fluid from the surface region downward through the first or the second borehole string along the first and second fluid paths to in situ leach resource material from the resource deposit and increase the internal volumes of the of the second and third sections of the first and second borehole strings, circulating the carrier fluid comprising the resource materials along the fluid path via the first and second nodal spaces and upward to the surface region through the second borehole string when injecting the carrier fluid in the first borehole string, or through the first borehole string when injecting the carrier fluid through the second borehole string, and recovering the carrier fluid comprising the in situ leached resource material.

In at least one embodiment, the process can comprise forming the third sections of the first and second borehole strings at the same depth so that the first and second planar regions are situated at approximately the same depth relative to the surface region.

In at least one embodiment, the process can comprise forming the third sections of the first and second borehole strings at different depths so that the first and second planar regions are situated at two different depths relative to the surface region.

In at least one embodiment, the surface region below which the mining configuration is implemented can be twenty five square mile or less.

In at least one embodiment, the surface region below which the mining configuration is implemented can be one square mile or less.

In at least one embodiment, wherein the process can comprise providing the first borehole string with a first plurality of sections that extend laterally in a first plurality of different lateral directions from the first section of the first borehole string into the resource deposit; and providing the second borehole string with a second plurality of sections extending laterally in a second plurality of lateral directions from the first section of the second borehole string into the resource deposit, where the first plurality of sections is equal in number to the second plurality of sections, and each section of the first plurality of sections penannularly extends with one section of the second plurality of sections to collectively form a plurality of planar regions, and distally connects to collectively form a plurality of nodal spaces so that a plurality of fluid paths are formed that flow downward from the surface region through the first borehole string to each of the nodal spaces and from the plurality of nodal spaces upward to the surface through the second borehole; and the process further comprises:

injecting the carrier fluid from the surface region downward through the first borehole string or the second borehole string along the plurality of fluid paths to thereby in situ leach resource material from the resource deposit and increase the internal volumes of the first and second plurality of lateral extensions, and circulating the carrier fluid comprising the resource materials along the plurality of fluid paths via the plurality of nodal spaces and upward to the surface through the second borehole string when injecting the carrier fluid in the first borehole string, or through the first borehole string when injecting the carrier fluid through the second borehole string to thereby recover the carrier fluid comprising the in situ leached resource material.

In at least one embodiment, the process can comprise installing a plurality of additional borehole strings that extend downward from the surface region into the resource deposit, and wherein each of the plurality of additional borehole strings distally connect to one of the plurality of nodal spaces.

In at least one embodiment, the process can comprise forming each of the additional borehole strings to be spaced away from one another and from the first, and second borehole strings.

In at least one embodiment, the process can comprise forming each of the plurality of additional borehole strings to be radially disposed relative to the first and second borehole strings.

In at least one embodiment, the process can comprise injecting the carrier fluid in an alternating fashion through the first borehole string and the second borehole string.

In at least one embodiment, the process can comprise subsequently injecting the carrier fluid from the surface region into the nodal space via one or more of the plurality of additional borehole strings and up to the surface region through the fluid path along the first and second borehole strings.

In at least one embodiment, the resource material can comprise first and second chemical constituents, and the process comprises circulating the carrier fluid wherein the first chemical constituent in situ leaches into the carrier fluid, and the second chemical constituent is retained in situ and forms a porous matrix.

In at least one embodiment, the first chemical constituent can be potassium chloride, and the second chemical constituent is sodium chloride.

In at least one embodiment, the resource material can be an evaporite.

In at least one embodiment, the carrier fluid can be a solvent and the resource material is an evaporite that is soluble in the solvent.

In at least one embodiment, the evaporite can be potash.

In another aspect, the present disclosure provides, in at least one embodiment, a resource extraction configuration for in situ resource extraction from a resource deposit in an underlying subterranean space associated with a surface region, wherein the resource extraction configuration comprises:

at least one borehole configuration, each borehole configuration comprising:

a first borehole string extending downward from the surface region into the resource deposit, the first borehole string comprising first and second sections, the first section extending downward from the surface region and the second section extending laterally in a first lateral direction from the first section into the resource deposit; and a second borehole string extending downward from the surface region into the resource deposit, the second borehole string situated adjacent to the first borehole string and comprising first and second sections, the first section of the second borehole string extending downward from the surface region and the second section of the second borehole string extending laterally in a second lateral direction from a distal portion of the first section of the second borehole string into the resource deposit, where the second sections of the first and second borehole strings penannularly extend to form a first planar region, and the second sections distally connect at a nodal space and form a fluid path downward from the surface region through the first borehole string to the nodal space and from the nodal space upward to the surface region through the second borehole string.

In at least one embodiment, the at least one borehole configuration can comprise a third borehole string extending downward from the surface region, the third borehole string having a distal end at the nodal space in the resource deposit.

In at least one embodiment, the first section of the first borehole string, or the first section of the second borehole string, or the third borehole string of the at least one borehole configuration can be positioned to extend substantially vertically relative to the surface region.

In at least one embodiment, the second sections of the first and second borehole strings of the at least one borehole configuration can be positioned to extend generally in a horizontal direction relative to the surface region.

In at least one embodiment, the resource extraction configuration can comprise a plurality of borehole configurations having a plurality of borehole strings, wherein fluid paths through each of laterally extending second sections of a first portion of the plurality of borehole strings extend substantially parallel and adjacent to corresponding fluid paths of a second portion of the plurality of borehole strings.

In at least one embodiment, the first borehole string of the at least one borehole configurations can comprise a third section extending laterally in a third lateral direction from the first section of the first borehole string into the resource deposit; and the second borehole string of the at least one borehole configurations comprise a third section extending laterally in a fourth lateral direction from the first section of the second borehole string into the resource deposit, where the third sections of the first and second borehole strings penannularly extend to form a second planar region, and the third sections of the first and second borehole strings distally connect to form a second nodal space and a second fluid path is formed from the surface region through the first borehole string to the second nodal space and from the second nodal space upward to the surface region through the second borehole string.

In at least one embodiment, the resource extraction configuration can comprise first and second borehole configurations that have first and second nodal spaces and are situated side by side so that a first imaginary straight line run from the first distal nodal space towards the first and second borehole string of the first borehole configuration and a second imaginary straight line run from the second distal nodal space towards the first and second borehole string of the second borehole configuration, wherein the first and second imaginary line run approximately parallel.

In at least one embodiment, the surface region below which the mining configuration is implemented can be twenty five square mile or less.

In at least one embodiment, the surface region below which the mining configuration is implemented can be one square mile or less.

In at least one embodiment, the distance between the parallel first and second lines can be 200 meters, or less.

In at least one embodiment, the first borehole string of the at least one borehole configuration can comprise a first plurality of sections extending laterally in a first plurality of different lateral directions from the first section of the first borehole string into the resource deposit; the second borehole string of the at least one borehole configuration comprises a second plurality of sections penannularly extending in a second plurality of lateral directions from the first section of the second borehole string into the resource deposit, the first plurality of sections being equal in number to the second plurality of sections, and each section of the first plurality of sections penannularly extends with one section of the second plurality of sections to collectively form a plurality of planar regions, and distally connects to collectively form a plurality of nodal spaces so that a plurality of fluid paths from the surface region through the first borehole string to each of the nodal spaces and from the plurality of nodal spaces upward to the surface through the second borehole string.

In at least one embodiment, the at least one borehole configuration can comprise a first plurality of additional borehole strings that extend downward from the surface region into the resource deposit, each of the additional borehole strings being spaced away from one another and from the first, second and third borehole string, and each of the plurality of additional borehole strings are distally connected to one of the plurality of nodal spaces.

In at least one embodiment, the plurality of additional borehole strings can be radially disposed relative to the first and second borehole strings.

In at least one embodiment, the at least one borehole configuration can comprise a second plurality of borehole strings comprising first, second and third boreholes extending in a same manner as the first, second and third borehole strings of the first plurality of borehole strings, the first plurality of borehole strings comprising second and third extensions oriented so as to be radially disposed relative to the second and third borehole strings, and the second plurality of borehole strings is oriented so as to be encircling and intercalating the first plurality of borehole strings.

In another aspect, the present disclosure provides, in at least one embodiment, a plurality of adjacent borehole configurations that each include a plurality of borehole strings and are associated with adjacent surface regions to facilitate resource extraction from a resource deposit in an underling subterranean space, each borehole configuration comprising:

a first borehole string that extends downward from the surface region into the resource deposit, the first borehole string comprising first and second sections, the first section extending downward from the surface region and the second section extending laterally in a first lateral direction from the first section into the resource deposit; and a second borehole string that extends downward from the surface region into the resource deposit, the second borehole string situated adjacent to the first borehole string and comprising first and second sections, the first section extending downward from the surface region and the second section extending laterally in a second lateral direction from the first section of the second borehole string into the resource deposit, where the second sections of the first and second borehole strings penannularly extend to form a first planar region and to distally connect at a nodal space and form a fluid path from the surface region through the first borehole string to the nodal space and from the nodal space to the surface region through the second borehole string.

In at least one embodiment, each borehole configuration can comprise a third borehole string extending downward from the surface region, the third borehole string having a distal end at the nodal space in the resource deposit.

In at least one embodiment, each borehole configuration in the plurality of adjacent borehole configurations the first borehole string can comprise a first plurality of sections extending laterally in a first plurality of different lateral directions from the first section of the first borehole string into the resource deposit; the second borehole string comprises a second plurality of sections extending laterally in a second plurality of lateral directions from the first section of the second borehole string into the resource deposit, the first plurality of sections being equal in number to the second plurality of sections, and each section of the first plurality of sections penannularly extends with one section of the second plurality of sections to collectively form a plurality of planar regions, and distally connects to collectively form a plurality of nodal spaces so that a plurality of fluid paths are formed from the surface region through the first borehole string to each of the nodal spaces and from the plurality of nodal spaces to the surface through the second borehole string.

In at least one embodiment, the plurality of adjacent borehole strings can comprise a plurality of additional borehole strings that extend downward from the adjacent surface regions into the resource deposit, where for each borehole configuration the additional borehole strings are spaced away from one another and from the first, second and third borehole strings, and each of the plurality of additional borehole strings are distally connected to one of the plurality of nodal spaces Other features and advantages of the present disclosure will become apparent from the following detailed description. It should be understood, however, that the detailed description, while indicating preferred implementations of the present disclosure, is given by way of illustration only, since various changes and modification within the spirit and scope of the disclosure will become apparent to those of skill in the art from the detailed description.

BRIEF DESCRIPTION OF THE DRAWINGS

The disclosure is in the hereinafter provided paragraphs described, by way of example, in relation to the attached figures. The figures provided herein are provided for a better understanding of the example embodiments and to show more clearly how the various embodiments may be carried into effect. Like numerals designate like or similar features throughout the several views possibly shown situated differently or from a different angle. Thus, by way of example only, part 115 in FIGS. 1C, 1E, 2A, 2B, 2C, 2K, 2L, 2M, 2N, 2O, 2P, 2S, 3A, 3C, 3D, and 3E refers to a borehole in each of these figures. The figures are not intended to limit the present disclosure.

Figure 1A:
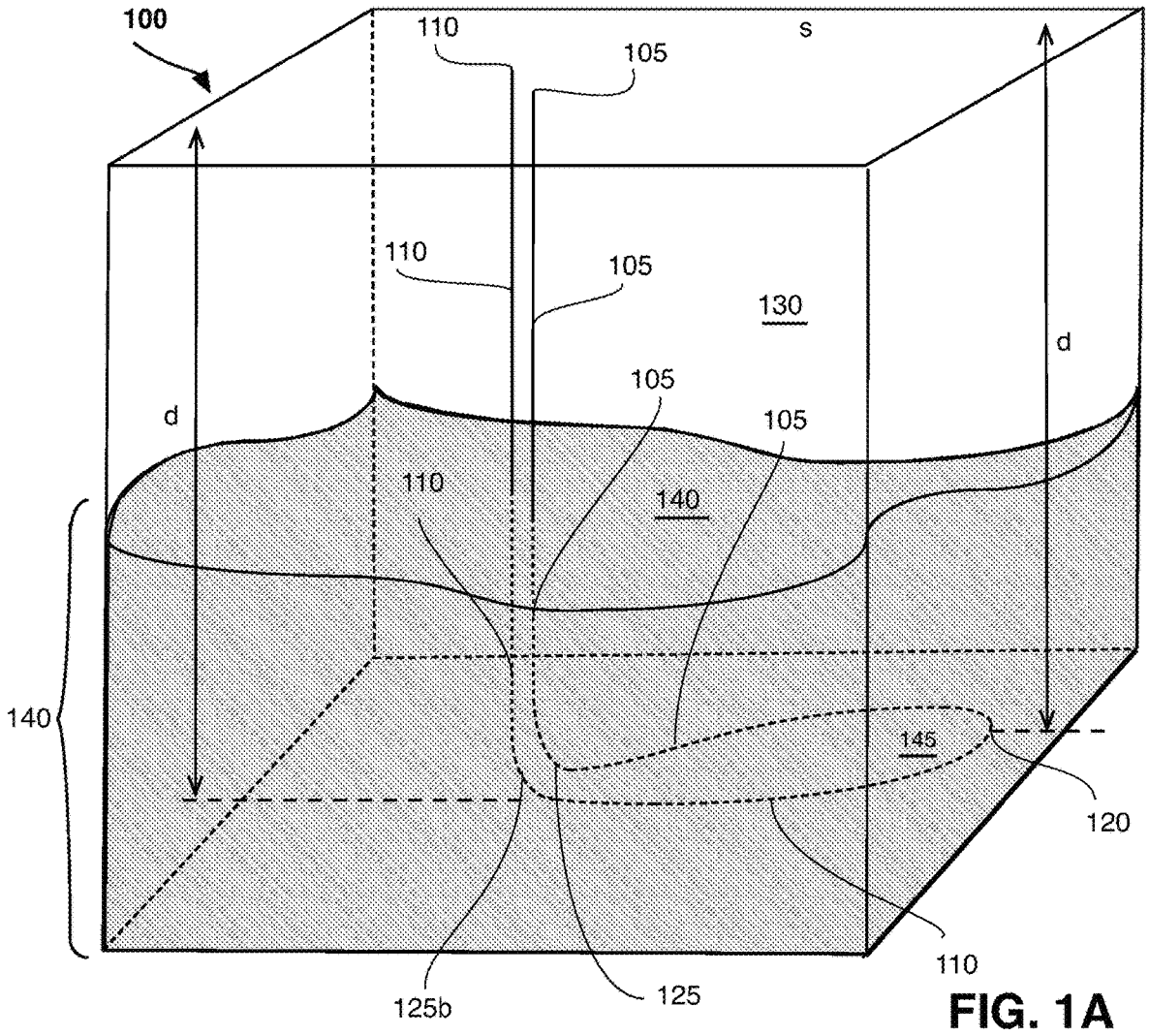
FIG. 1A is a schematic perspective view of a resource extraction configuration according to an example embodiment of the present disclosure.

The figures together with the following detailed description make apparent to those skilled in the art how the disclosure may be implemented in practice.

DETAILED DESCRIPTION

Various processes, systems and configurations will be described below to provide at least one example of at least one embodiment of the claimed subject matter. No embodiment described below limits any claimed subject matter and any claimed subject matter may cover processes, systems, or configurations that differ from those described below. The claimed subject matter is not limited to any process, system, or configurations having all of the features of processes, systems, or compositions described below, or to features common to multiple processes, systems, or configurations described below. It is possible that a process, system, or configurations described below is not an embodiment of any claimed subject matter. Any subject matter disclosed in processes, systems, or configurations described below that is not claimed in this document may be the subject matter of another protective instrument, for example, a continuing patent application, and the applicants, inventors or owners do not intend to abandon, disclaim or dedicate to the public any such subject matter by its disclosure in this document.

As used herein and in the claims, the singular forms, such as "a", "an" and "the" include the plural reference and vice versa unless the context clearly indicates otherwise. Throughout this specification, unless otherwise indicated, the terms "comprise," "comprises" and "comprising" are used inclusively rather than exclusively, so that a stated integer or group of integers may include one or more other non-stated integers or groups of integers. The term "or" is inclusive unless modified, for example, by "either". The term "and/or" is intended to represent an inclusive or. That is "X and/or Y" is intended to mean X or Y or both, for example. As a further example, X, Y and/or Z is intended to mean X or Y or Z or any combination thereof.

When ranges are used herein for geometric dimensions, physical properties, or chemical properties, such as chemical formulae, all combinations and sub-combinations of ranges and specific embodiments therein are intended to be included. Other than in the operating examples, or where otherwise indicated, all numbers expressing quantities of ingredients or reaction conditions used herein should be understood as being modified in all instances by the term "about." The term "about" when referring to a number or a numerical range means that the number or numerical range referred to is an approximation within experimental variability (or within statistical experimental error), and thus the number or numerical range may vary between 1% and 15% of the stated number or numerical range, as will be readily recognized by the context. Furthermore, any range of values described herein is intended to specifically include the limiting values of the range, and any intermediate value or sub-range within the given range, and all such intermediate values and sub-ranges are individually and specifically disclosed (e.g. a range of 1 to 5 includes 1, 1.5, 2, 2.75, 3, 3.90, 4, and 5). Similarly, other terms of degree such as "substantially" and "approximately" as used herein mean a reasonable amount of deviation of the modified term such that the end result is not significantly changed. These terms of degree should be construed as including a deviation of the modified term, such as up to 15% for example, if this deviation would not negate the meaning of the term it modifies.

Several directional terms such as "above", "below", "lower", "upper", "vertical" and "horizontal" are used herein for convenience including for reference to the drawings. In general, the terms "upper", "above", "upward" and similar terms are used to refer to an upwards direction or upper portion in relation to the earth's surface, as shown, for example in FIG. 1A. Similarly the terms "lower", "below", "downward", and "bottom" are used to refer to a downwards direction or a lower portion relative to the earth's surface, for example, such as shown in FIG. 1A. The term "vertical" is used herein to refer to a direction that is perpendicular to the earth's horizontal surface, while the term "horizontal" refers to a direction that is parallel relative to the earth's flat surface at zero incline. The terms "proximal" and "distal", as used herein, are relative terms of location referring to a generally longitudinally extending borehole, wherein a proximal location refers to a location closer to the borehole opening at the earth's surface, while a distal location refers to a location further from the borehole opening at the earth's surface.

Unless otherwise defined, scientific and technical terms used in connection with the formulations described herein shall have the meanings that are commonly understood by those of ordinary skill in the art. The terminology used herein is for the purpose of describing particular embodiments only, and is not intended to limit the scope of the present invention, which is defined solely by the claims.

All publications, patents, and patent applications referred herein are herein incorporated by reference in their entirety to the same extent as if each individual publication, patent or patent application was specifically indicated to be incorporated by reference in its entirety.

In general, the resource extraction configurations and processes of the present disclosure can be used for subterranean resource extraction. Implementation of the resource extraction configurations and processes of the present disclosure can result in the recovery at the surface of carrier fluids containing subterranean resource materials such as, but not limited to, minerals, and other resource materials.

In broad terms, the processes of the present disclosure involve constructing and installing at least two borehole strings into a subterranean area from a ground level region, which is referred to herein as a "surface region" to recover a resource material of interest. The term "borehole string", as used herein, generally refers to a tubular subterranean extension allowing for the flow of fluid therethrough. The tubular subterranean extension of a borehole string may be formed by the subterranean formation naturally surrounding the tubular extension, and thus be a borehole, or a borehole string may be formed by a tubular device, for example, casing or a liner, installed to extend at least partially, for example through a first section, inside a borehole drilled and configured to receive the tubular device. Thus, it is to be understood that in general a borehole may be constructed to comprise a singular borehole string, or a borehole may be constructed to comprise multiple borehole strings by installing multiple subterraneously extending tubular devices therein. Thus, in broad terms, the present disclosure involves drilling into a subterranean area from a surface region to recover a resource material of interest using at least one borehole and installing at least two tubular devices therein to construct two borehole strings, or drilling at least two boreholes, to thereby establish two borehole strings.

Preferably, a first borehole string and a second borehole string are established. The first and second borehole strings may be first and second boreholes situated adjacent to each other, or a first borehole comprising a first and second tubular device extending into the first borehole. The tubular device can be any tubular body, including any liner, pipe, tubing, casing, or the like, that can serve as a fluid conduit. The tubular device may be manufactured using any suitable material, including, for example, steel or plastic. The two borehole strings are interconnected at a distal nodal space. A fluid path is formed downward from the surface through the first borehole string and upward via the distal nodal space and the second borehole string. Alternatively, a fluid path is formed downward from the surface region through the second borehole string and upward via the distal nodal space and the first borehole string. A carrier fluid is injected at the surface region along the fluid paths to thereby in situ leach resource material from the resource deposit into the carrier fluid and circulate the carrier fluid containing the resource material up to the surface for processing.

In another preferred embodiment, three borehole strings are installed, including a third borehole string which can be adjacent to or spaced away from the first and second borehole strings, which are situated adjacent to each other. The third borehole string can be used to survey and detect the subterranean resource material. All three borehole strings are interconnected at a distal nodal space. Fluid paths are formed downward from surface through the first or second borehole string and upward via the distal nodal space and the first or second borehole string that didn't provide the downward fluid path. A carrier fluid is injected at surface along the fluid paths to thereby in situ leach resource material from the resource deposit into the carrier fluid and circulate the carrier fluid containing resource material up to surface for processing.

A challenge of many known processes and configurations for resource extraction is that only a small fraction of the resource materials of a resource deposit is extracted. At the same time a large ground surface area is required for the resource extraction operation, and often vehicular transport or pipeline transport of fluids between injection and discharge points is involved.

A further challenge with known processes for resource extraction is that large amounts of contaminating materials are recovered at the surface together with the resource material. Thus, separation of the contaminating materials from the resource materials is required at surface. Furthermore, disposal of the contaminating material often negatively impacts the environment, and can be costly.

A further challenge with known processes for resource extraction is that they do insufficiently permit the monitoring of operational parameters and properties of the resource material which negatively effects the efficiency of a solution-based resource extraction operation, including, for example, carrier fluid flow rate, carrier fluid temperature, resource deposit temperature, brine salinity and geometry of the borehole configurations.

A yet further challenge with known processes for resource extraction is that they comprise a single flow path.

In one aspect, at least one of the processes and configurations for resource extraction of the present disclosure allow for the extraction of a more substantial amount of the total resource content of a resource deposit, while at the same time using a more limited surface region compared to that which is used for traditional subterranean resource extraction processes. Thus, for example, using the processes and configurations of the present disclosure, 1 square mile (2.6 square kilometers) or less of above ground surface region may be used for in situ extraction of a portion of a subterranean potash deposit, also about a square mile in size, and, surprisingly, all or substantially all of the total available potash may be extracted from the mined potash deposit. In view of the limited surface region used to implement the mining configurations of the present disclosure, the environmental impact associated with operating the mining configurations of the present disclosure is limited. Furthermore, fewer inputs, such as water and energy, are used when compared to the inputs required in traditional mining processes.

In another aspect, at least one of the processes of the present disclosure can limit the quantity of contaminating material that is brought to surface, and thus can limit disposal costs and reduce the environmental impact of extraction operations run according to the processes of the present disclosure.

In another aspect, at least one of the processes and configurations for resource extraction of the present disclosure further permit monitoring of many operational parameters and properties including such as, but not limited to, solvent flow rate, solvent temperature, resource deposit temperature, brine salinity and cavern geometry, for example.

Furthermore, in another aspect, at least one of the processes and configurations for resource extraction of the present disclosure allow for the development of several flow paths.

Furthermore, in another aspect, at least one of the processes and configurations for resource extraction of the present disclosure allow for the distribution of carrier fluid and processing of discharged carrier fluid at a single fluid housing, and therefore no vehicular transport, and limited pipeline transport above surface of carrier fluid is required.

In what follows, example embodiments of the present disclosure are described with reference to the drawings. It is noted, in particular, in this respect that the embodiments generally involve selecting processes and configurations for the extraction of mineral materials from a subterranean mineral deposit. The terms "mineral materials" and "minerals", as used herein, refer to naturally occurring, substantially homogenous inorganic solid substances having a definite chemical composition and ordered atomic arrangement, commonly crystalline, and include, without limitation, silicates including tectosilicates, phyllosilicates, inosilicates, cyclosilicates, sorosilicates and orthosilicates, for example; oxides including aluminum oxide, titanium dioxide and uranium oxide, for example; halides including potassium chloride and sodium chloride, for example; sulfates including calcium sulfate and barium sulfate, for example; carbonates including sodium carbonate, for example; phosphates including phosphates belonging to the apatite group, fluorapatite, for example; chemical elements, including metallic elements such as gold and silver, for example, and semi-metallic elements, non-metallic elements, and metallic compounds, notably alloys, for example. In addition to mineral materials, non-mineral resource materials may also be extracted using the configurations and processes of the present disclosure. Non-mineral resources include, but are not limited to, hydrocarbon resources, such as petroleum, for example. It is understood that although the following example embodiments refer to mineral materials, the configurations of the present disclosure may also be used to extract non-mineral subterranean resource materials.

Implementation of the resource extraction configurations and processes of the present disclosure can result in the recovery at the surface of carrier fluids containing subterranean resource materials, such as one or more minerals, and other resource materials of interest.

The mineral of interest or resource of interest can be any mineral or resource which can be dissolved in a solvent fluid injected into boreholes. The mineral constituting a mineral deposit can, for example, be an evaporite, i.e. a geological mineral deposit formed following sea water evaporation. In specific example embodiments, the evaporite can be, but is not limited to, potash, trona, halite, or gypsum, for example.

The term "potash" as used herein, refers to a potassium containing mineral. Potassium may be present in various chemical forms including, for example, in the form of potassium chloride (KCl), also referred to in a commonly naturally occurring crystalized form as sylvite, potassium hydroxide (KOH), potassium carbonate ($K_2CO_3$), potassium nitrate (KNOB), potassium chlorate (KClO), potassium sulfate ($K_2SO_4$) potassium permanganate ($KMnO_4$), carnallite ($KMgCl\text{-}6\cdot(H_2O)$), langbeinite ($K_2Mg_2(SO_4)_3$), and polyhalite, ($K_2Ca_2Mg(SO_4)_4\cdot 2(H_2O)$), for example.

The mineral deposit besides one or more chemical forms of potassium, may contain other chemical compounds, including sodium chloride, (NaCl), also referred to in a common naturally occurring crystalized form as halite, for example.

In some embodiments, mineral deposits may comprise a mixture of minerals. Thus, for example, potash mineral deposits commonly comprise a mixture of KCl (sylvite) and NaCl (halite). Potash deposits may, for example, contain from about 30% to about 70% KCl, with the preponderance of the balance, up to almost 100%, containing NaCl. In embodiments in which a solvent saturated with NaCl is used, as brine migrates through mineral deposit, KCl may dissolve in the brine, while a porous matrix structure of NaCl may in remain in place.

In general, borehole openings maybe separated by any suitable distance. In certain preferred embodiments, a borehole opening may be separated from another borehole opening by 50 m or less, for example 45 m or less, 40 m or less, 35 m or less, 30 m or less, 25 m or less, 20 m or less, 15 m or less, 10 m or less, 5 m or less or 2 m or less and boreholes that are within 50 m of each other can be said to be adjacent to each other. It is noted that in embodiments, where a single bore hole includes first and second tubular devices the borehole strings may be particularly close, and the first and second tubular devices may be contacting one another. In other embodiments, any borehole opening of the borehole configurations described herein may be separated from another borehole opening by at least 75 m, at least 100 m, at least 200 m, at least 300 m, at least 400 m at least 500 m, at least 750 m, at least 1 km, at least 1.5 kms or at least 2 kms. Combinations of closer and farther boreholes may also be used.

Variations of borehole directions may be used in the present teachings. Boreholes are preferably substantially oriented in a vertical downward fashion (relative to the surface region). Vertical borehole extensions may further extend laterally into mineral deposit and generally in a horizontal direction relative to the surface region to form generally horizontal borehole extensions. Although borehole extensions preferably extend generally horizontally, some local deviations, for example, in the form of undulations, can occur along the length of borehole extensions.

As will readily be appreciated by those of skill in the art, the depth of a borehole depends on the geographical location of the surface region as well as the mineral deposit or subterranean resource of interest. In some locations it may be necessary to drill deeper to reach a mineral deposit or resource of interest, while in other locations, the mineral deposit may be situated closer to the surface region. In various embodiments, the length of vertical borehole extensions (depth) can range from approximately 200 meters to approximately 3,000 meters.

Figure 1B:
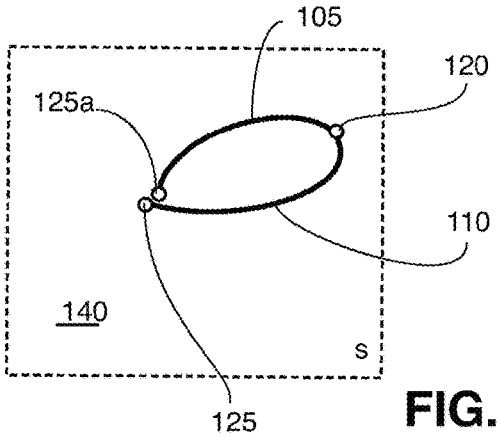
FIG. 1B is a schematic horizontal cross-sectional view of the resource extraction configuration of FIG. 1A.
Figure 1C:
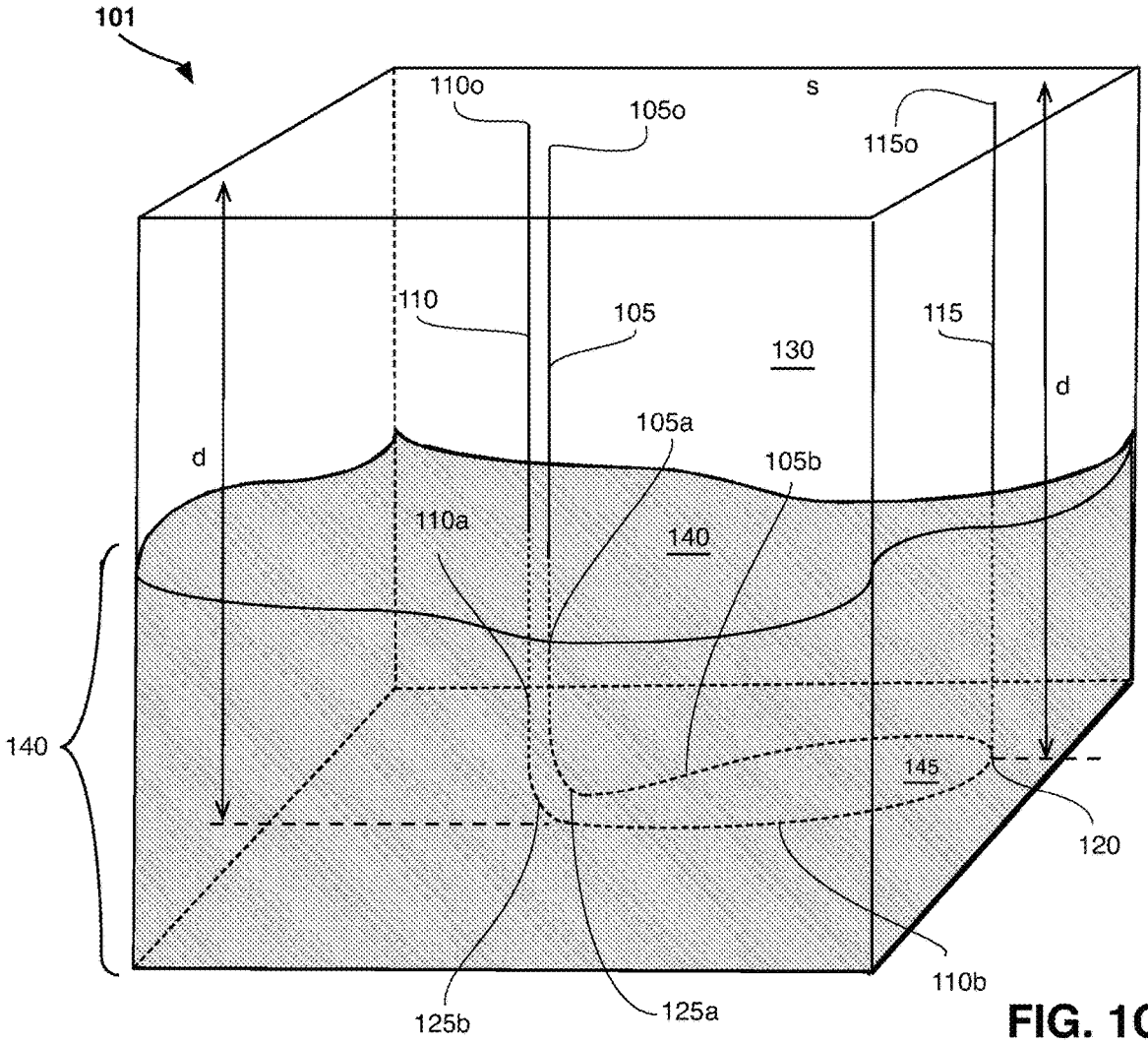
FIG. 1C is a schematic perspective view of a resource extraction configuration according to an example embodiment of the present disclosure.
Figure 1D:
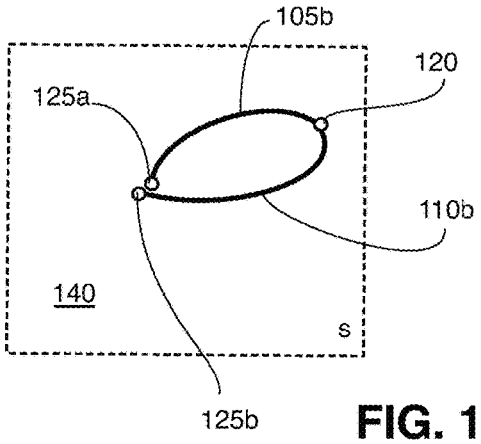
FIG. 1D is a schematic horizontal cross-sectional view of the resource extraction configuration of FIG. 1C.
Figure 1E:
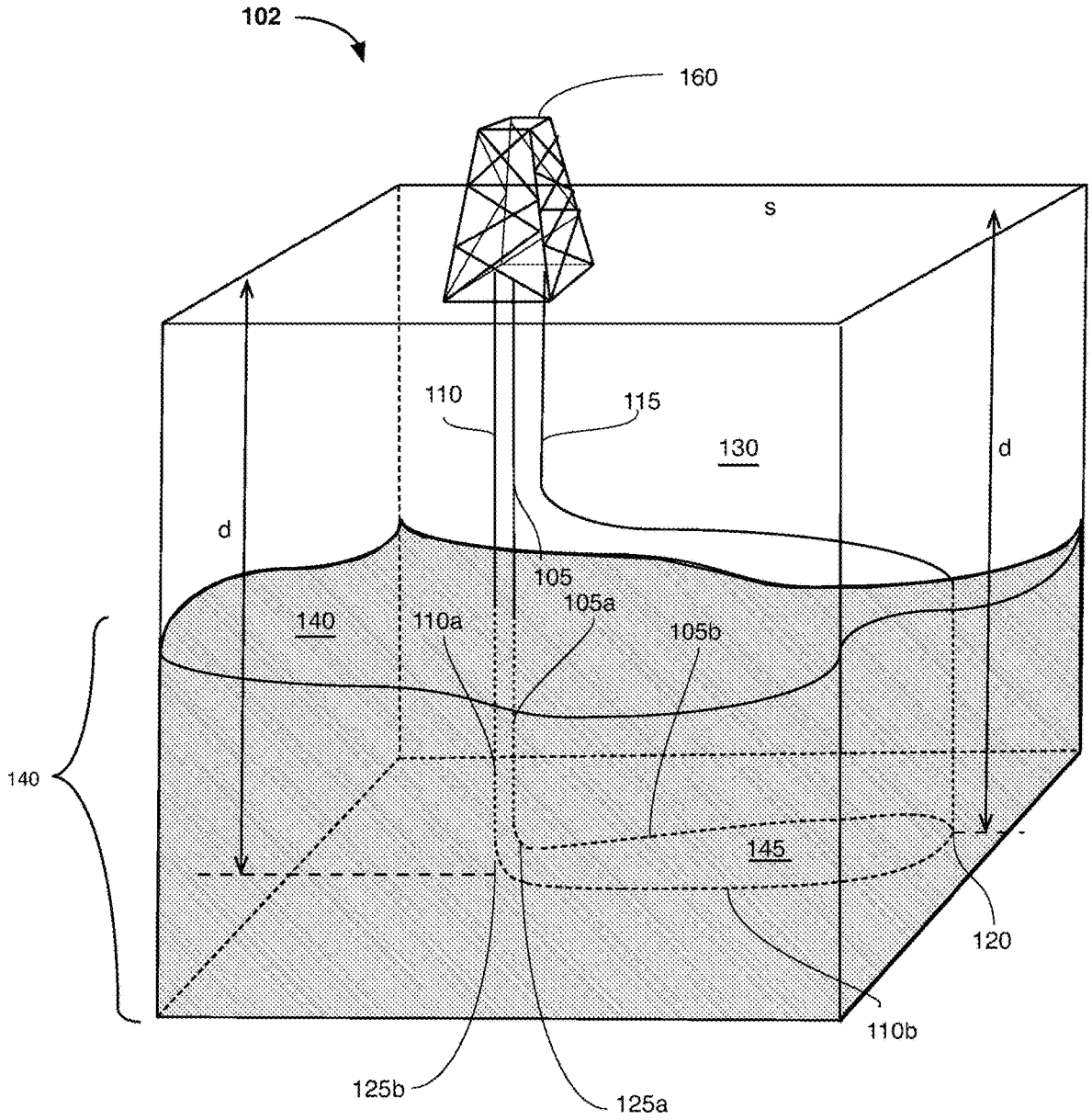
FIG. 1E is a schematic perspective view of a resource extraction configuration according to another example embodiment of the present disclosure.
Figure 2A:
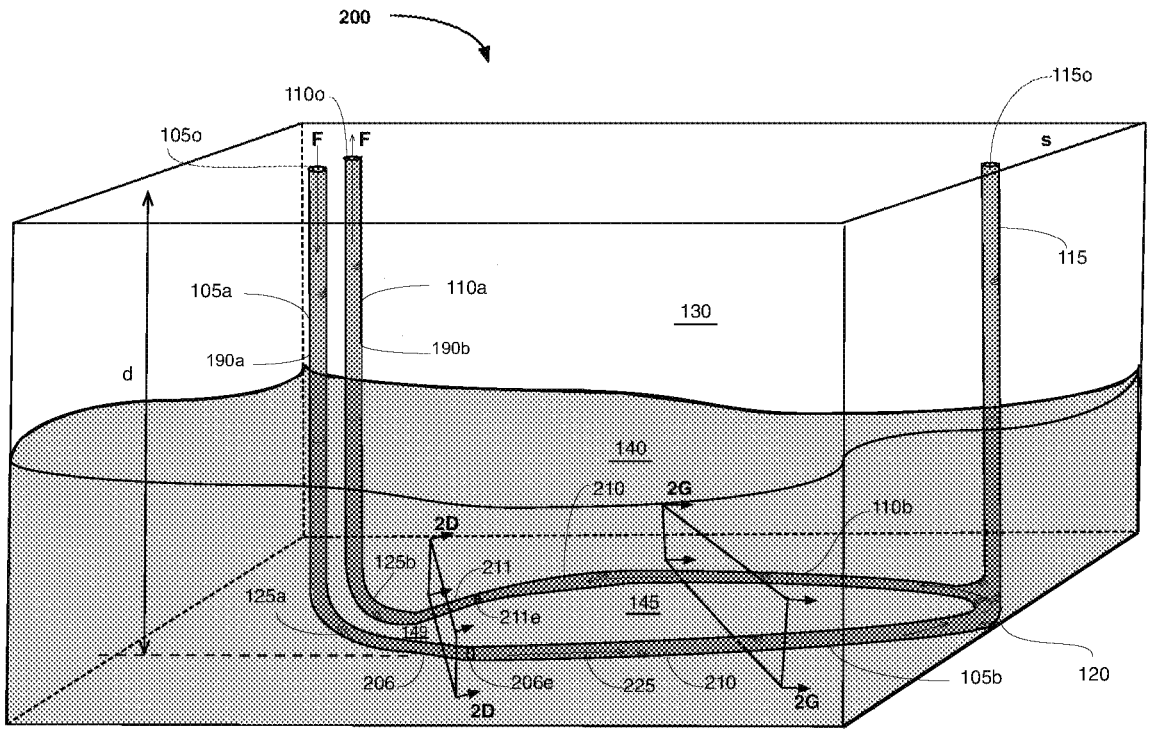
FIG. 2A is a schematic perspective view of resource extraction configuration in a first state corresponding according to another example embodiment of the present disclosure.

In a general overview, FIGS. 1A, 1C and 1E show schematic perspective views of three example resource extraction configurations 100, 101 and 102 according to the present disclosure. FIGS. 2A-2S show different aspects of another example resource extraction configuration 200. FIGS. 2A-2I, 2K-2S show several schematic perspective views (FIGS. 2A-2C and 2N-2S), cross-sectional views (FIGS. 2D-2I), and horizontal cross-sectional views (FIGS. 2K-2M), respectively, of example resource extraction configuration 200 in several operational states corresponding with several steps in an implementation of an example embodiment of a process according to the present disclosure. FIG. 2J shows a cross-sectional view similar to the cross-sectional view shown in FIG. 2I, of another mining configuration (not shown). FIGS. 3A, 3C, 3D and 3E show schematic perspective views of example mining configurations 300, 301, 302 and 303, respectively, according to the present disclosure. A horizontal cross-sectional subterranean view of mining configuration 300 is shown in FIG. 3B and a horizontal cross-sectional view of the example mining configuration 303 in FIG. 3E is shown in FIG. 3F. In addition, FIGS. 4A, 4B, 4C, 4D, 5A, 5B, 5C, 5D, 5E, horizontal cross-sectional views of different example embodiments 400, 401, 403, 404, 500, 502, 504, 505, 506, while FIGS. 6A, 6B, 6C and 6D show overhead views of example embodiments 601, 602, 603 and 604, respectively.

Referring initially to FIGS. 1A-1E, shown therein are example embodiments of resource extraction configurations 100, 101 and 102 for extraction and recovery of a mineral material from a subterranean deposit (which is generally referred to as a mineral deposit 140) according to the present disclosure. Shown are surface region s, boreholes 105, 110 having borehole openings 105*o* and 110*o*, respectively. For clarity, it is noted that borehole openings 105*o* and 110*o*, in some embodiments, can be separately drilled bore holes, while in other embodiments, borehole openings 105*o* and 110*o* can be two openings of two tubular devices installed in a single borehole. In the example embodiments shown in the drawings herein generally separate bore holes comprising separate borehole openings are shown, each borehole forming a borehole string. It will be understood, however that example embodiments, including single boreholes in which two or more borehole strings are installed are also intended to be include herein. Resource extraction configurations 101 and 102 (FIG. 1C and FIG. 1E) additionally include borehole 115 having borehole opening 115*o*. Borehole openings 105*o* and 110*o* are situated adjacent to each other at surface region s, while in resource extraction configuration 101 borehole opening 115*o* is spaced away from borehole openings 105*o* and 110*o* and in resource extraction configuration 102 borehole opening 115*o* is adjacent to borehole openings 105*o* and 110*o*. Boreholes 105, 110 and 115 are drilled through a subterranean portion 130 of the earth underneath surface region s and into mineral deposit 140 containing a mineral of interest.

Surface region s can be any above ground land surface having an area of any size. In some embodiments, surface region s can, for example, be a section of land i.e. one square mile (2.6 square kilometers). It is noted that the processes of the present disclosure require a small surface region relative to more traditional mining operations. This limits the environmental impact and input requirements to operate the mining configurations of the present disclosure. In general, borehole openings 105*o* and 110*o* are separated from one another by 50 m or less, for example 45 m or less, 40 m or less, 35 m or less, 30 m or less, 25 m or less, 20 m or less, 15 m or less, 10 m or less, 5 m or less or 2 m or less and thus boreholes 105 and 110 can be said to be adjacent to each other. Boreholes openings 105*o* and 110*o* may be spaced away from borehole opening 115*o*, for example, spaced away at least 75 m, at least 100 m, at least 200 m, at least 300 m, at least 400 m at least 500 m, at least 750 m, at least 1 km, at least 1.5 kms or at least 2 kms, as shown in in resource extraction configuration 100. Boreholes 105 and 110 comprise substantially vertical downward (relative to surfaces) borehole extensions 105*a* and 110*a* each extending into mineral deposit 140. Vertical borehole extensions 105*a* and 110*a* at depth d and extension points 125*a* and 125*b*, respectively, further extend laterally into mineral deposit 140 and generally in a horizontal direction relative to surface region s to form generally horizontal borehole extensions 105*b* and 110*b*, respectively. It is noted that although borehole extensions 105*b* and 110*b* extend generally horizontally there may be some local deviations, for example, in the form of undulations, that can occur along the length of borehole extensions 105*b* and 110*b*. Depth d, as will readily be appreciated by those of skill in the art, depends on the geographical location of surface region s, as well as the mineral deposit 140. In some locations it may be necessary to drill deeper to reach mineral deposit 140, while in other locations, mineral deposit 140 may be situated closer to surface region s. In various embodiments, the length of vertical borehole extensions 105*a* and 110*a* (i.e. depth d) can range from approximately 300 meters to approximately 3,000 meters. Thus, for example, in Saskatchewan, potash deposits may be located at a depth d of approximately 1,000 meters, while in regions further south of Saskatchewan the depth d generally increases. It should also be noted that the term "laterally" generally means that a given borehole section that extends laterally from a particular borehole section means that the given borehole section generally has a directional axis that is different compared to the longitudinal axis of that particular borehole section.

It is further noted that the three dimensional shape of resource deposits may vary. Thus, a resource deposit may, for example, be present in a substantially horizontal layer, or a resource deposit may, for example, be present in a layer with a generally upward or downward sloping angle, relative to surface region s, or, for example, a resource deposit may be present in a layer forming one or more wave like shapes. The lateral directions of borehole extensions 105*b* and 110*b* may be selected depending to the shape of the resource deposit. Thus, for example, where the deposits are present in a substantial horizontal layer, borehole extensions 105*b* and 110*b* may be selected to be situated generally horizontal relative to surface region s. In embodiments in which deposits are present in a layer with a generally upward or downward sloping angle, for example, borehole extensions 105*b* and 110*b* may be selected to extend generally at the same angle. In embodiments in which the deposit may be present in a layer with one or more wave like shapes, for example, borehole extensions 105*b* and 110*b* be may be constructed below the trough of the wave(s), or so as to conform with contours of the wave(s). Thus, those of skill in the art will be able to select appropriate lateral directions for borehole extensions 105*b* and 110*b* based on the general three dimensional shape of mineral deposit 140.

As noted above, surface region s may be one square mile or less. Similarly, the subterranean horizontal surface region of the portion of mineral deposit 140 in which horizontal borehole extensions 105*b* and 110*b* extend may be one square mile or less, e.g. about three quarters of a square mile or less, one half of a square mile or less, or even one quarter of a square mile or less. In other embodiments, larger surface regions may be used, for example, a surface region ranging from about 25 square miles (5 by 5 miles) to about 4 square miles (2 by 2 miles), e.g. a surface region of about 25 square miles, about 16 square miles, about 9 square miles, or about 4 square miles. As will be readily apparent by those of skill in the art, in embodiments wherein the mineral deposit is situated on a non-horizontal angle relative to surface region s, and wherein borehole extensions 105*b* and 110*b* laterally extend in a non-horizontal direction, for example, at a 45 degree angle relative to surface region s, the subterranean horizontal surface region of the portion of mineral deposit 140 in which horizontal borehole extensions 105*b* and 110*b* extend is smaller than the horizontal surface region of the portion of mineral deposit 140 in which horizontal borehole extensions 105*b* and 110*b* of the same length are situated horizontally relative to surface region s.

Horizontal borehole extensions 105*b* and 110*b* connect at distal nodal space 120. Further, horizontal borehole extensions 105*b* and 110*b* are planarly situated between extension points 125*a* and 125*b*, and distal nodal space 120, in such a manner that they together form a penannular extension, and further, in such a manner that separating portion 145 of mineral deposit 140 separates horizontal borehole extensions 105*b* and 110*b* and is embraced therein. Separating portion 145, in general, can be said to be the portion of mineral deposit 140 which is situated in between, and surrounded by, horizontal borehole extensions 105*b* and 110*b*, and separating portion 145 extends from extension points 125*a* and 125*b* to distal nodal space 120. Separating portion 145 may separate horizontal borehole extensions 105*b* and 110*b* by, for example, 15 m, 25 m, 50 m, 100 m, 150 m, 200 m, or up to 1 km and may alter as extraction operations in accordance herewith are conducted, as hereinafter further explained.

The mineral of interest can be any mineral which can be dissolved in a solvent fluid injected into boreholes 105, 110, or 115, as hereinafter further explained. Thus, the mineral constituting mineral deposit 140 can, for example, include without limitation an evaporite, i.e. a geological mineral deposit formed following sea water evaporation. In specific example embodiments, the evaporite can be potash, trona, halite, or gypsum. The mineral deposit 140, besides one or more chemical forms of potassium, may contain other chemical compounds, including sodium chloride, (NaCl), also referred to in a common naturally occurring crystalized form as halite, for example.

In general, in order to construct resource extraction configuration 100 (FIG. 1A), boreholes 105 and 110 are drilled adjacent to each other. In particular, boreholes 105 and 110 are drilled so that a first portion thereof (i.e. first portions 105*a* and 110*a*, respectively) extend substantially vertically from surface regions into mineral deposit 140. At extension points 125*a* and 125*b*, respectively, boreholes 105 and 110 are then further drilled out in first and second lateral directions, respectively, to form second portions 105*b* and 110*b* of borehole 105 and 110, and respectively, and extend penannularly to form a plane therebetween in which separating portion 145 is situated. Second portions 105*b* and 110*b* distally connect to form distal nodal space 120 in the mineral deposit 140.

In general, in order to construct resource extraction configuration 101 (FIG. 1C), initially exploratory borehole 115 is drilled, while boreholes 105 and 110 are drilled following completion of borehole 115. Borehole 115 extends from surface region s into mineral deposit 140 and distally initially forms distal nodal space 120 into mineral deposit 140. It is noted that the geometry of distal nodal space 120 may vary, but generally includes the distal portion of borehole 115, including the side walls and the end wall (not shown) of borehole 115. The distal side walls can be the portion of the side walls of borehole 115 extending upwards from the distal end wall of borehole 115 for, for example, about one meter up to 25 meters. Distal nodal space 120 may be accessed from surface region s using surveying equipment and known processes can be used to survey mineral deposit 140 and to detect mineral materials. Thus, for example, a solvent may be introduced into distal nodal space 120 via borehole 115 to fill distal nodal space 120, or a portion thereof. Upon dissolution of a quantity of mineral material from the cavern wall of distal nodal space 120, a sample of the solvent with the mineral dissolved therein can be brought to surface region s for analysis with respect to, for example, salinity or mineral content. Furthermore, rock core samples may be obtained from distal space 120 and brought to surface region s for examination. Additionally geological information regarding mineral deposit 140, such as seismic information for example, may be obtained by accessing nodal space 120 via borehole 115. Thus, it will be understood that it is possible to, upon having drilled borehole 115, assay mineral deposit 140 and detect the presence of mineral constituents therein, and evaluate other geological parameters of mineral deposit 140. Upon confirmation of the presence of mineral material, and the evaluation of other geological parameters, as desired, boreholes 105 and 110 can drilled, as hereinbefore noted, in such a manner that boreholes 105 and 110 distally terminate at distal nodal space 120 to thereby assemble resource extraction configuration 101. It is noted that in order to ensure that the vertical sections of boreholes 105 and 110 distally terminate at distal nodal space 120, an electromagnetic emitter may be inserted into distal nodal space 120 from surface. Electromagnetic waves emitted by the emitter provide a directional beacon towards which a drill equipped with a receiving antenna can be guided as drilling of boreholes 105 and 110 proceeds. Electromagnetic telemetry tools are known to those of skill in the art, see, e.g. US. Patent Application having Publication No. 2008/0068211.

In alternate resource extraction configuration 102 (FIG. 1E), borehole 115 is drilled at surface region s adjacent to boreholes 105 and 110, for example, within 100 m from boreholes 105 and 110. Borehole 115 is below surface region s and oriented so as to connect with distal nodal space 120, for example, by extending along a curved path, as shown in FIG. 1E. It will be clear to those of skill in the art that embodiment 102 permits operations at surface region s to be confined to a smaller surface region than the surface region that would be required for operations at surface in according with embodiment 101. It is noted that configuration 102 can be operated from single well pad 160 situated at surface s.

In general, in order to drill boreholes 105, 110 and 115 conventional drilling equipment and techniques may be used, including drilling rigs, and drilling tools such as down-hole mud-driven motor drilling equipment, and drill bits generally known to those of skill in the art. Thus, for example, conventional drilling equipment, such as the equipment used in oil well drilling can be used, for example, drag or fishtail bits to drill in soft rock, and rotary tricone or other suitable bits to drill in hard rock. Conventional water-based drilling fluid or mud systems can be used for drilling through clastic or carbonate sedimentary rock. When drilling through mineral deposits, non-water-based fluids, such as emulsion muds, mineral oil, or diesel oil, for example, can be used to avoid washing out the resource material, if the material is soluble in water, and to avoid enlarging the borehole. For directional drilling a downhole assembly using a steerable drill bit driven by mud pressure can be continuously controlled while its location and direction is recorded. Gyroscopic compasses contained in the drill pipe can be used to more or less constantly measure inclination and declination of the drill bit. Directional control can further be facilitated by measurement-while-drilling (MWD) or logging-while-drilling (LWD) equipment and techniques using, for example, gamma ray sensors and electromagnetic telemetry techniques, as will generally be known to those of skill in the art.

Drilling directions can be selected based on seismic data applicable to the surface region and underlying deposits. Furthermore, directional information and control commands can be transmitted digitally up or down through the mud column using pressure pulse coding through the mud. Furthermore, MWD and LWD techniques, known to those of skill in the art, allow continuous analysis of the rock without the need to take core samples. From LWD data, physical properties of the rock can be continuously monitored to allow driving the borehole through the desired stratigraphic location, and reach mineral deposit 140. More sophisticated well logging data collected after the drilling is finished can allow for more comprehensive geological interpretation. When drilling near or through mineral deposit 140 coring bits with core barrel collection systems can be used to collect samples of the rock for chemical and geological analysis as needed.

Borehole diameters when drilled may vary and can range, for example, from 0.2 m to 0.5 m, and generally decrease as the borehole extends downwards from surface.

Referring now to FIGS. 2A-2S, shown therein is an example embodiment of a resource extraction configuration 200 for mineral extraction and recovery in different states of an example process for mineral extraction and recovery of mineral material from mineral deposit 140.

Figure 2B:
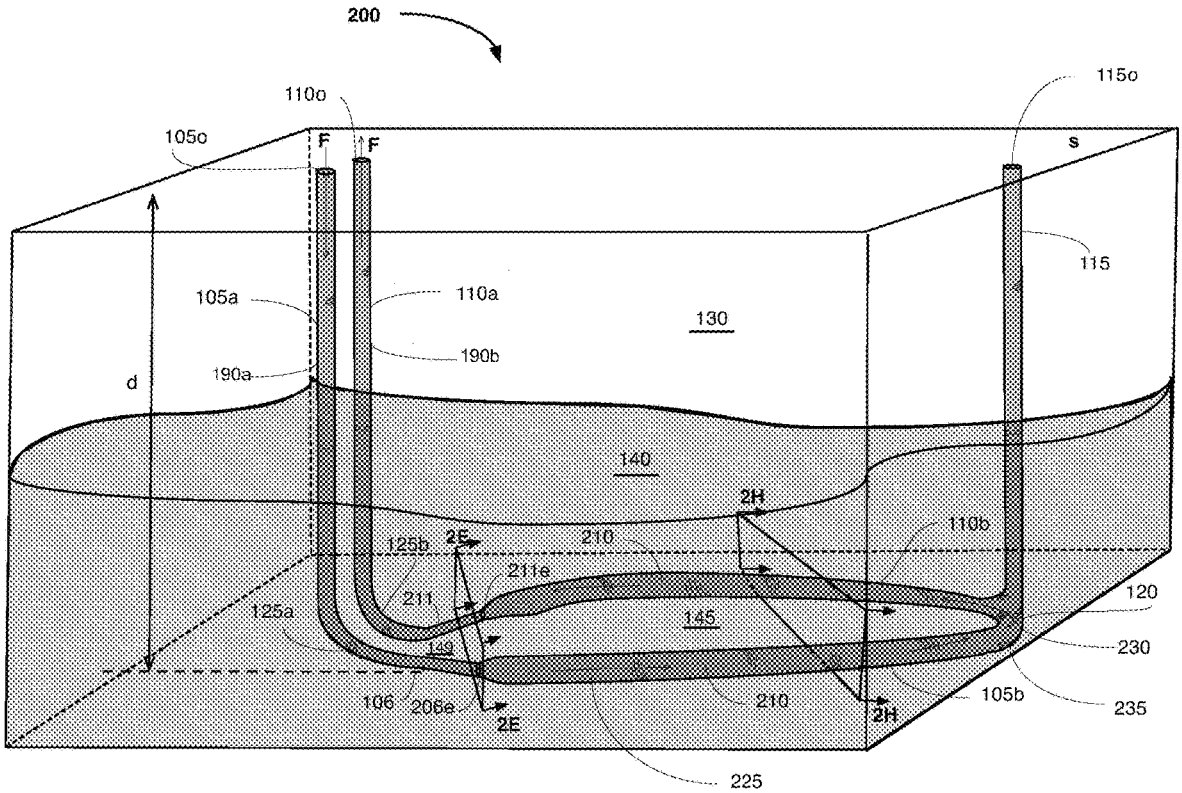
FIG. 2B is a schematic perspective view of a resource extraction configuration in a second state corresponding according to another example embodiment of the present disclosure.
Figure 2C:
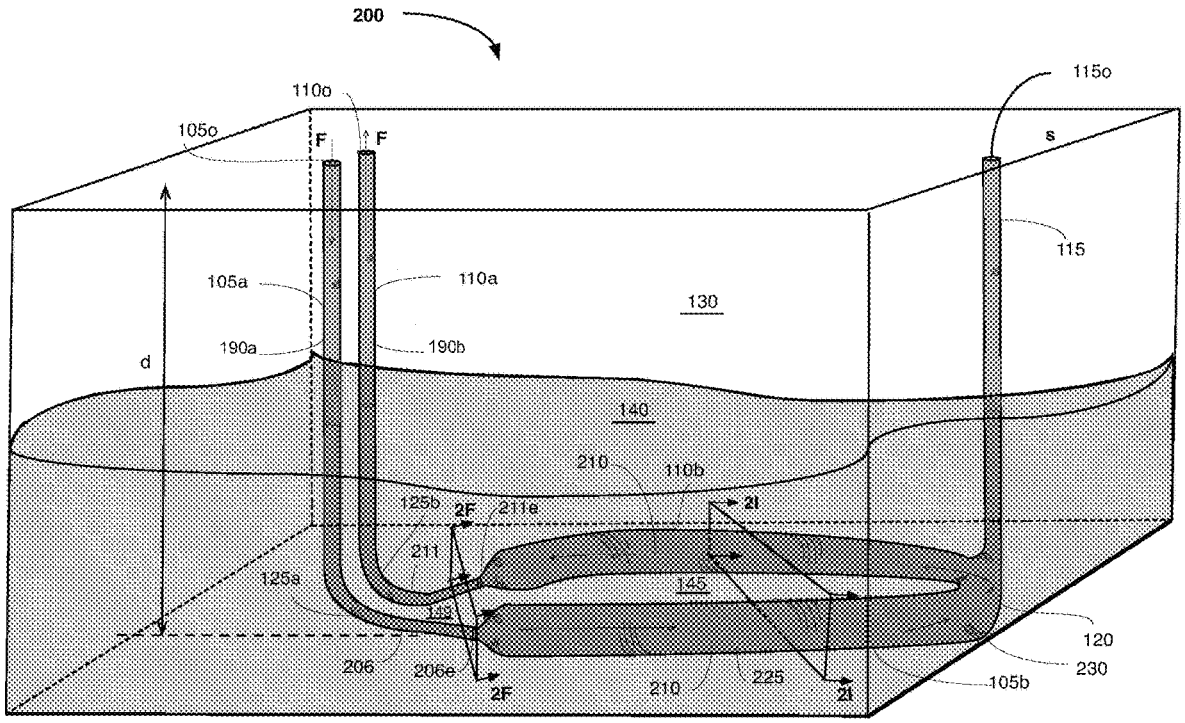
FIG. 2C is a schematic perspective view of a resource extraction configuration in a third state corresponding according to another example embodiment of the present disclosure.
Figure 2D:
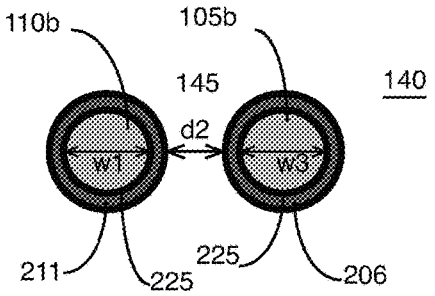
FIG. 2D is a cross-sectional view of the resource extraction configuration of FIG. 2A taken along plane 2D.
Figure 2G:
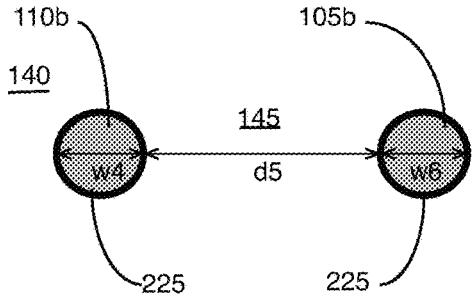
FIG. 2G is a cross-sectional view of the resource extraction configuration of FIG. 2A taken along plane 2G.
Figure 2E:
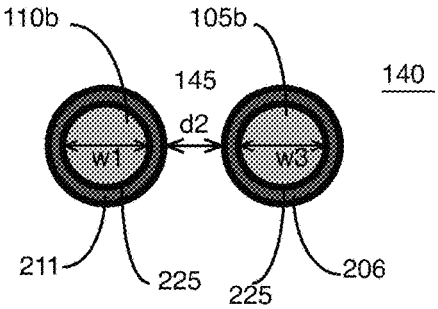
FIG. 2E is a cross-sectional view of the resource extraction configuration of FIG. 2B taken along plane 2E.
Figure 2H:
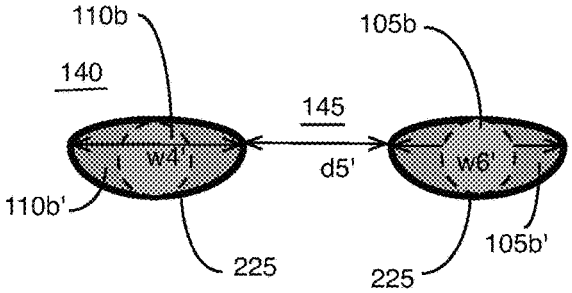
FIG. 2H is a cross-sectional view of the resource extraction configuration of FIG. 2B taken along plane 2H.
Figure 2F:
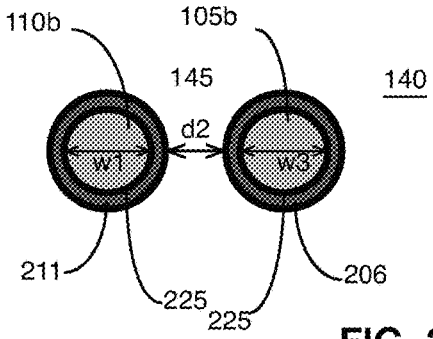
FIG. 2F is a cross-sectional view of the resource extraction configuration of FIG. 2C taken along plane 2F.
Figure 2I:
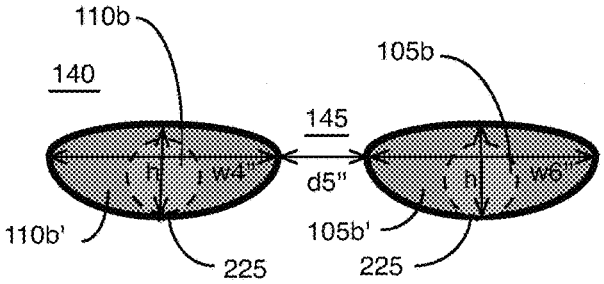
FIG. 2I is a cross-sectional view of the resource extraction configuration of FIG. 2C taken along plane 2I.
Figure 2J:
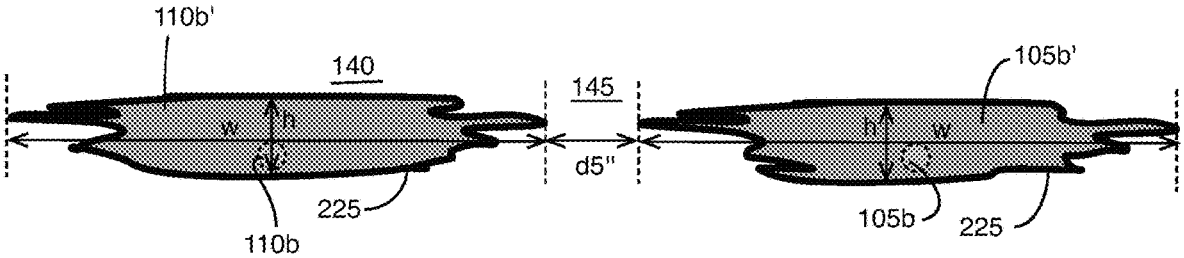
FIG. 2J is a cross-sectional view similar to the cross-sectional view shown in FIG. 2I, however of another resource extraction configuration (not shown).

Referring initially to FIGS. 2A-2C, shown therein are schematic perspective views, of first, second, and third states in the performance of the example process. Surface region s includes adjacent boreholes 105 and 110, and borehole 115 which is spaced away from boreholes 105 and 110. Each borehole 105, 110, and 115 is drilled from surface region s through a portion 130 of the earth and extending into mineral deposit 140. Boreholes 105 and 110 initially extend substantially vertically downward from surface region s, and then extend further laterally, each in somewhat divergent directions, and substantially horizontally, relative to the surface region s, at extension points 125*a* and 125*b*. Borehole 115 extends vertically from surface region s to depth d into mineral deposit 140 to terminate distally at distal nodal space 120. Boreholes 105 and 110 also connect at distal nodal space 120. Substantially horizontal borehole extensions 105*b* and 110*b* can be said to jointly form a penannular assembly between proximal extension points 125*a* and 125*b* and distal nodal space 120.

It is noted that borehole extension 105*a* and a first section of borehole extension 105*b* are cased with casing 206, with the cased section terminating at 206*e*. The remainder of borehole extension 105*b* is uncased, or cased with a permeable material, such as casing with a plurality of sidewall openings, for example slots forming a slotted liner, which may form a pattern. Similarly, borehole extension 110*a* and a first section of borehole extensions 110*b* are cased with casing 211, with the cased section terminating at 211*e*. (see: further FIGS. 2D-2I, hereinafter discussed). With the terms "casing" and "cased", in reference to a borehole, it is meant that a borehole is lined in such a manner that fluid contact between the borehole wall and fluid migrating through the borehole is prevented. Casing material that may be used will generally be known to those in the art, and includes, for example, steel casing. Thus, it will be understood that in embodiments hereof, wherein a single borehole comprises multiple tubular devices, i.e. multiple casings, such multiple tubular devices may extend partially into lateral sections 105*b* and 110*b*, but generally a substantial section is uncased or cased with a permeable material.

Further shown in FIGS. 2A-2C, is fluid path 210 through mineral deposit 140 that is formed downwards from surface region s by borehole 105 and distal nodal space 120 (e.g. which is like a cavern) and borehole 110. It will be clear if in the shown example configuration boreholes 105 and 110 are spaced away about 1.5 kms from borehole 115, the portion of the fluid path 210 between extension points 125*a*, 125*b*, and distal nodal space 120 is approximately 3 km in length. In other embodiments, boreholes 105 and 110 may be spaced further away, for example 3 kms from borehole 115, the portion of the fluid path 210 between extension points 125*a*, 125*b*, and distal nodal space 120 then is approximately 6 km in length. Resource extraction configuration 200 allows for the injection at surface region s of carrier fluid F through surface bore aperture 105*o*, and flow of carrier fluid F along a first portion of fluid path 210 through distal nodal space 120 and then through a second portion of fluid path 210 and then back upwards to surface region s through surface bore aperture 110*o*. In order to employ resource extraction configuration 200 for mineral extraction, carrier fluid F, which is a solvent in which mineral materials of mineral deposit 140 can dissolve, is injected into surface bore aperture 105*o*, thus resulting in surface contact between carrier fluid F and walls 225 of boreholes 105, 110 and distal nodal space 120. As a result of such contact mineral material of mineral deposit 140 can be said to in situ leach from mineral deposit 140, notably walls 225 of boreholes 105, 110 and distal nodal space 120 into carrier fluid F. Since, in this example embodiment the resource material is a mineral, carrier fluid F in general is selected to be a solvent in which mineral material can dissolve forming brine, as hereinafter further described.

Referring now to FIG. 2B, shown therein is a second state of resource extraction configuration 200, following the flow through of a substantial quantity of solvent and brine along fluid path 210. It is noted that the internal geometry of boreholes 105, 110, and distal nodal space 120 has expanded as a result of mineral material from walls 225 dissolving into solvent and discharge of brine at surface region s through surface bore aperture 110*o*. In general, walls 225 of borehole extensions 105*b* and 110*b* can be said to be laterally and radially expanding. Furthermore, the volume of distal nodal space 120 has increased to form cavern 230, the bottom portion of which is referred to as sump 235, and in which undissolved minerals may precipitate and settle. It is also noted that separating portion 145 of mineral deposit 140 has been reduced in size as a result of the radial expansion of walls 225 of substantially horizontal borehole extensions 105*b*, and 110*b*.

Referring now to FIG. 2C, shown therein is a third state of resource extraction configuration 200. Continued injection of carrier fluid F into surface bore aperture 105*o* results in downward flow of solvent through borehole 105 through cavern 230, along boreholes 105 and 110 upward to surface region s for carrier fluid F discharge through surface bore aperture 110*o*, respectively. As carrier fluid F flows along flow fluid path 210, walls 225 of substantially horizontal borehole extensions 105*b* and 110*b* gradually laterally and radially expand further, while at same time the internal geometry of cavern 230 increases.

Figure 2K:
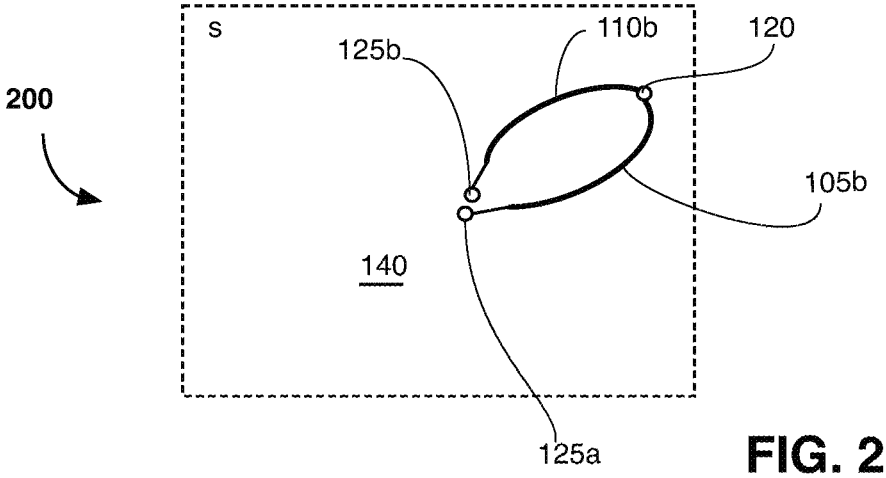
FIG. 2K is a schematic overhead view of the resource extraction configuration in a first state as shown in FIG. 2A.
Figure 2L:
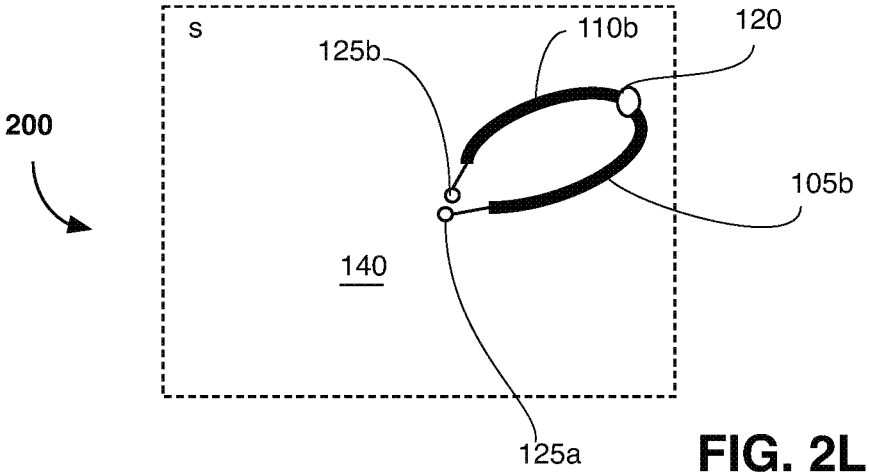
FIG. 2L is a schematic overhead view of the resource extraction configuration in a second state as shown in FIG. 2B.
Figure 2M:
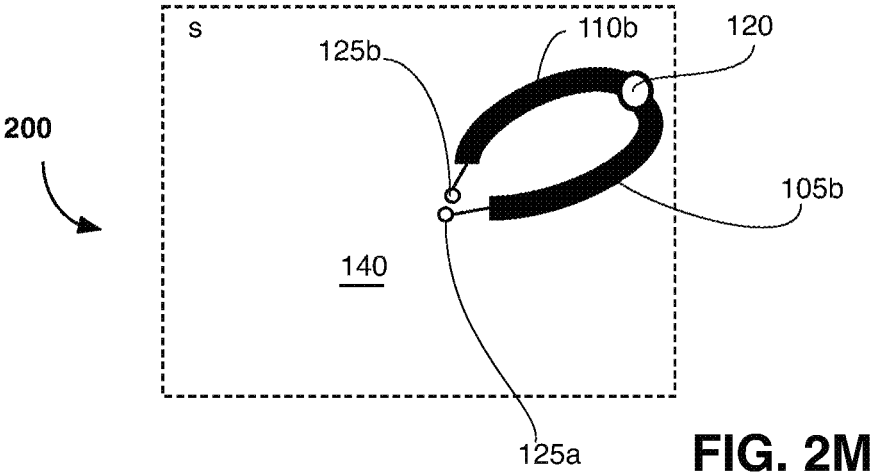
FIG. 2M is a schematic overhead view of the resource extraction configuration in a third state as shown in FIG. 2C.
Figure 2N:
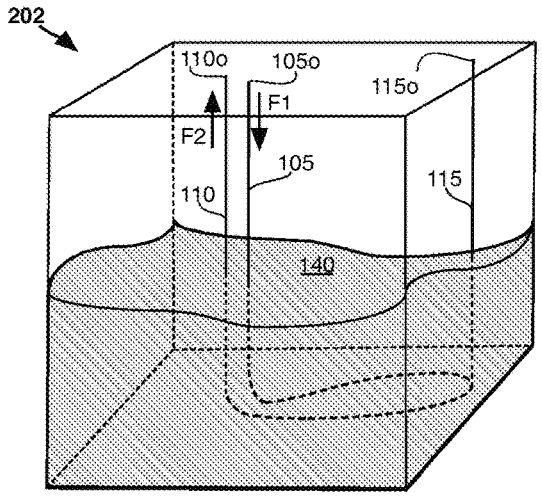
FIG. 2N is a schematic perspective view of a resource extraction configuration and process according to an example embodiment of the present disclosure.
Figure 2O:
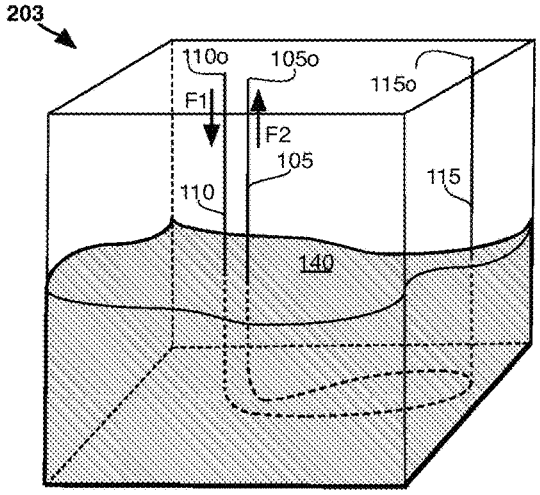
FIG. 2O is a schematic perspective view of a resource extraction configuration and process according to another example embodiment of the present disclosure.

Horizontal cross-sectional views of the first, second and third states shown in FIGS. 2A, 2B and 2C are shown in FIGS. 2K, 2L and 2M, respectively.

It is noted that in order to operate resource extraction configuration 200, at borehole opening apertures 105*o*, 110*o* and 115*o*, wellhead assemblies (not shown) may be installed to control fluid flow and pressure. Further equipment that may be installed at surface region s adjacent to borehole opening apertures 105*o*, 110*o* and 115*o*, which may be part of the wellhead assemblies, include but are not limited to, fluid pumps, fluid tanks, including fluid heating equipment, shut off valves, and flow measurement equipment.

Referring now to FIGS. 2D-2I, shown therein are vertical cross-sectional views through mineral deposit 140 including borehole extensions 105*b* and 110*b*, in each of the three states shown in FIGS. 2A-2C. These vertical cross-sectional views include borehole extensions 105*b* and 110*b* containing casings 206 and 211, respectively, (see FIGS. 2D, 2E, 2F), and vertical cross-sectional views including uncased borehole extensions 105*b* and 110*b* (see FIGS. 2G, 2H, 2I). As can be seen width w1 and w3 of the cased portions of borehole extensions 110*b* and 105*b*, respectively, does not alter between the three different states shown in FIGS. 2A-2C. In different embodiments the widths w1 and w3 can range, for example, from about 3 cm to about 40 cm. Consequently the distance d2 between the adjacent outer wall portions of walls 225 of borehole extensions 105*b* and 110*b* does not alter. By contrast, width w4 of uncased portions of borehole extension 105*b* increases to w4' (FIG. 2H) and w4" (FIG. 2I), as in situ leaching of mineral material proceeds, while, similarly, width w6 of uncased portions of borehole extension 110*b* increases to w6' (FIG. 2H) and w6" (FIG. 2I). Thus, due to the gradual radial expansion of walls 225 of uncased portions of borehole extensions 105*b* and 110*b*, the adjacent outer wall portions of walls 225 of borehole extensions 105*b* and 110*b* come in closer proximity as in situ leaching of mineral material proceeds. The increase in width w4 and w6 occurs at the expense of separating portion 145, which decreases in size, as denoted by the decrease in distance d5, d5' and d5" between the adjacent outer wall portions of walls 225 borehole extensions 105*b* and 110*b*, as in situ leaching of mineral material proceeds.

It is noted that portions 105*b* and 110*b* represent portions of rock formation 140 that have been drilled, while leached portions 105' and 110*b*' represent portions of rock formation 140 that have been in situ leached. Portions 105*b* and 110*b* are substantially hollow. However, leached portions 105' and 110*b*' may be more or less porous. In particular, if rock formation 140 comprises different chemical constituents, for example, crystalline potassium chloride and sodium chloride, selective in situ leaching may result in removal of potassium chloride into the solvent, as the solvent circulates, and in situ retention of sodium chloride, for example, in the form of a porous sodium chloride matrix. In this manner, the processes of the present disclosure can limit the quantities of contaminating materials extracted at surface region s.

It is noted that, in general, borehole expansion in the lateral direction is expected to outpace borehole expansion in the vertical direction, so that as the resource extraction process proceeds, the width w of uncased portions of boreholes 105*b* and 110*b* increases more than their height h (indicated in FIGS. 2I-J), for example, up to 2×, 5×, 10×, 20×, or more. Thus for example, the height may double while at the same time the width may increase about 3-fold, about 4-fold, about 5-fold, or about 10-fold. In some embodiments, a height h of up to 5 m and width w of up to 100 m or even more can be reached.

Referring now to FIG. 2J., it is noted that for purposes of illustrating the general principles in accordance with the disclosure, the geometries in FIGS. 2D-2I have been represented as regularly shaped geometries. However, in the implementation of the methods of the present disclosure, more irregular geometries, for example as illustrated by FIG. 2J, may develop for leached portions 105*b*' and 110*b*' as in situ leaching of mineral material proceeds from the original borehole extensions 105*b* and 110*b*. The development of the exact geometry, as will be appreciated by those of skill in the art, can be a function of the in situ subterranean conditions, and parameters associated with carrier fluid F and distribution thereof, such as the chemical constituents and flow rate of the carrier fluid F, for example.

It is also noted that variations in width (w) within borehole extensions 105*b* and 110*b* may occur depending on whether a cross-section closer to the proximal end (i.e. closer to extension points 125*a*, 125*b*) of these borehole extensions is considered or whether a cross-section closer to the distal end (i.e. closer to distal nodal space 120) of these borehole extensions is considered. In some embodiments, following a period of in situ leaching, as e.g. illustrated by FIG. 2C, the width (w) of borehole extensions 105*b* and 110*b* may gradually decrease when longitudinally traversing borehole extensions 105*b* through distal nodal space 120 and then to 110*b*, when borehole 105 is used for carrier fluid F injection and borehole 110 is used for carrier fluid F recovery. The gradual decrease in width (w) may occur as a result of carrier fluid F becoming gradually saturated with in situ leached mineral material as the carrier fluid F follows along a fluid path first through 105*b* and then 110*b*, and the more saturated carrier fluid F becomes, the less effective that in situ leaching mineral material from mineral deposit 140 into the carrier fluid F will be.

Referring again to FIGS. 2A-2C, it is further noted that a purpose of casings 206 and 211 is to protect sub-portion 149 of separation portion 145, situated adjacent to extension points 125*a* and 125*b*, and to prevent fluid contact between fluid in borehole extensions 105*b* and 110*b* as a result of the gradual radial expansion of borehole extensions 105*b* and 110*b*. Such fluid contact is deemed undesirable since it would interfere with the flow of carried fluid F along fluid path 210. In order to construct the cased sections, borehole extensions 105*b* and 110*b* are generally angled away from each other, so that the longitudinal axes of the cased sections of borehole extensions 105*b* and 110*b* form an angle of at least about 30 degrees, and up to about 90 degrees. Casing length may vary, but generally is a least about 10 meters and may be as long as about 150 meters.

Turning now to various conditions and parameters that may be selected to operate the resource extraction configurations and processes of the present disclosure, it is noted that carrier fluid F is selected depending on the resource material being extracted, as will be appreciated by those of skill in the art. In general, it is deemed beneficial that carrier fluid F is selected to be a solvent in which the resource material can dissolve. Thus, for example, when the resource material is a mineral, an aqueous solution in which the mineral dissolves can be selected for carrier fluid F. In one embodiment, a substantially pure solvent, for example, a substantially pure aqueous solution, such as water or steam, may be used for injection. The carrier fluid F can be injected in liquid form, however in other embodiments, the carrier fluid F may be heated and injected in the form a vapour or steam. In further embodiments, the carrier fluid F may be a gel or slurry.

In other embodiments, a sodium chloride (NaCl) solution, for example, a saturated NaCl solution, or a potassium chloride (KCL) solution, or a solution comprising NaCl and KCl may be used as a solvent. Possible additives that be included are NaOH and manganese salts. These solvents are particularly useful when the extracted resource is potash. It should be noted that solvent in which minerals are dissolved may be referred to by the term brine.

In embodiments, where non-mineral materials are extracted, other carrier fluids F may be selected. Thus, for example, when hydrocarbons are extracted it may be beneficial to use a less polar carrier fluid, or to add dispersants to the carrier fluid F to facilitate dissolving of the resource material.

It is further noted that in some embodiments the resource material may not dissolve or may poorly dissolve in the carrier fluid F, and instead the carrier fluid F may serve as a medium to transport the resource material in non-dissolved form, for example, in the form of particulate material suspended in the carrier fluid F.

In another aspect, the solvent temperature of the carrier fluid F may be varied, and preheated (or precooled) carrier fluid having a temperature in a range of, for example, from about 10° C. to about 110° C. may be used, or even higher when the carrier fluid F is injected in the form of vapour or steam. It is noted that in situ temperatures at depths, for example, from 1,000 m to 3,000 m from surface region s are generally higher than at surface region s and can range, for example, from about 25° C. to about 80° C. Thus, the carrier fluid temperature can gradually increase as it is injected from surface region s and migrates towards mineral deposit 140. In embodiments herein where potash in the form of KCl is mined, higher solvent temperatures, for example in excess of 50° C. are generally deemed beneficial, since the solubility of KCl in aqueous solutions generally increases. Thus, in some embodiments a heated solvent may be injected into borehole 105.

In general, the concentration of mineral dissolved in the solvent increases along fluid path 210. However, at the same time, the rate of mineral dissolution generally decreases as the brine becomes saturated with dissolved mineral material. A further decrease in the rate of dissolution, and a decrease in the maximum saturation concentration, also generally occurs as the temperature of the brine decreases. Thus, in embodiments where a heated solvent is used the rate of dissolution may decrease as the solvent migrates along flow path 210. Fluid flow rate may be controlled from surface region s using a pump system (not shown) operably installed at surface region s or a downhole pump system installed into borehole 105.

In some embodiments, mineral deposit 140 may comprise a mixture of minerals. Thus, for example, potash mineral deposits commonly comprise a mixture of KCl (sylvite) and NaCl (halite). Potash deposits may, for example, contain from about 30% to about 70% KCl, with the preponderance of the balance, up to almost 100%, containing NaCl. In embodiments in which a solvent saturated with NaCl is used, as brine migrates through mineral deposit 140, KCl may dissolve in the brine, while a porous matrix structure of NaCl may in remain in place.

In some embodiments, initially carrier fluid F is injected through surface bore aperture 105*o* and fluid flow is established to achieve a certain flow rate. Initially the transit time, i.e. the time required for carrier fluid F to migrate from borehole 105*o* to borehole 110*o*, is generally shorter and may be, for example, about 3-6 hours. The transit time gradually increases as the volumes of horizontal borehole extensions 105*b* and 110*b* increase, and can increase to, for example 24 hrs, 48 hrs, 60 hrs, 120 hrs, 240 hrs or more as the widths of the horizontal borehole extensions 105*b* and 110*b* increase.

In general, the width of horizontal borehole extensions 105*b*, 110*b* is developed so that a substantial portion of separating portion 145 can remain. Thus, for example, the processes described herein may be performed such that the distance d between substantially horizontal borehole extension 105*b* and 110*b* may be no less than 100 m, no less than 50 m or no less than 25 m during the processes. It is noted that the width of horizontal borehole extensions 105*b*, 110*b* may be monitored by accessing distal node 120. Once a certain width has been attained, fluid circulation may be stopped and thereafter fluid may be maintained stagnant for a period of time, for example, at least one day, several days (e.g. 2, 3, 4, 5, 6 or 7 days), at least one week, several weeks (e.g. 2, 3, or 4 weeks), at least one month, or several months (e.g. 2, 3, 4, 6, 9 or 12 months), along the flow path without arranging for an upward flow to soak and further facilitate in situ leaching of mineral material. Thereafter, fluid flow upwards through surface bore aperture 110*o* may be initiated from surface region s.

In some embodiments, boreholes 105, 110 or distal nodal space 120 are rubblized prior to injection of solvent, using, for example, explosives to break pieces of borehole extensions 105*b*, 110*b*, or distal nodal space 120.

Carrier fluid F discharged from borehole aperture 110*o* can be used to recover resource material at surface region s, for example, by crystallizing minerals present in the brine and separating the crystallized mineral material from the fluid, and/or to separate minerals from each other; for example, potash may be separated from sodium chloride. Thus, at surface region s mineral recovery operations may be set up, for example, in close proximity to borehole aperture 110*o*. Mineral recovery techniques are known to those of skill in the art, and include, for example, the use of brine crystallizers.

In some embodiments, borehole 115 is used to monitor one or more subterranean parameters relating to mineral deposit 140 by accessing nodal cavern 230 with a monitoring device through borehole 115, and situating a monitoring device within nodal cavern 230, for example, at sump 235. Various parameters may be monitored in this manner using certain types of sensors and equipment as is known by those skilled in the art. These include, for example, solvent salinity, undissolved sodium chloride in the solvent, solvent flow rate, solvent pressure, solvent temperature, electrical conductivity (as a measure of total dissolved salt), radioactivity (to measure KCl), photoelectric absorption and neutron absorption and borehole geometry. Resource extraction operations, such as fluid flow, for example, may be adjusted as a result of such monitoring.

It is noted that the various resource extraction configurations of the present disclosure allow for a variety of flow paths, as illustrated by the examples in FIGS. 2N-2S. Thus, for example, in one, some or all of the embodiments of the resource configurations described herein, fluid flow along fluid path 210 may periodically be reversed. Thus, for example, surface borehole opening 105*o* after being used for a first period of time for fluid entry (see: F1 in FIG. 2N), may be used for a second period of time for fluid exit (see: F2 in FIG. 2O), and conversely surface borehole opening 110*o* may for the first period of time be used for fluid exit (see: F2 in FIG. 2O), and then for the second period of time be used for fluid entry (see: F1 in FIG. 2N). For one, some or all of the embodiments described herein, the periodicity for varying the direction of fluid flow may be varied and may be selected as desired. For example, a periodicity of 1 day, 1 week, 1 month, or 3 months may be selected. Further, for one, some or all of the embodiments described herein, the periodicity may further be selected as a function of transit time, which as hereinbefore noted may vary. Shorter periodicities may also be implemented, for example 1 hour, 6 hours, or 12 hours periodicities. Thus, for example, fluid flow may be reversed after the completion of, for example, 2, 3, or 4 transit times. In this manner the geometry and growth of nodal cavern 230 may be controlled. In particular, reversal of fluid flow can keep the width of substantially horizontal extensions 105*a* and 110*b* more or less the same along the entire length of the extensions. In addition, in potash resource extraction operations, flow reversal can result in redistribution of precipitated halite which may otherwise interfere with fluid flow by blocking pore spaces which have resulted from KCl dissolution.

Figure 2P:
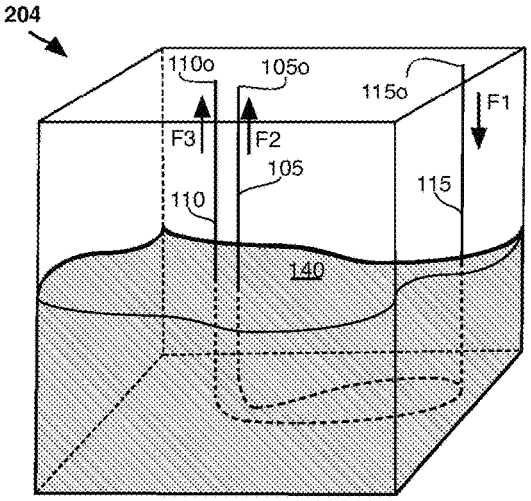
FIG. 2P is a schematic perspective view of a resource extraction configuration and process according to another example embodiment of the present disclosure.
Figure 2Q:
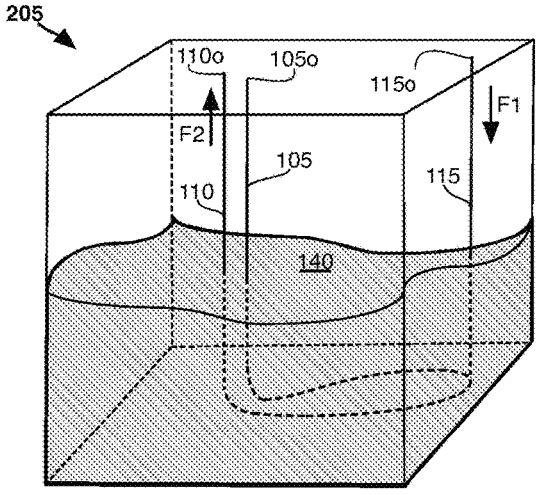
FIG. 2Q is a schematic perspective view of a resource extraction configuration and process according to another example embodiment of the present disclosure.

In a further embodiment, the fluid flow path may be reversed by using borehole opening 115*o* as a fluid entry point, and using borehole openings 105*o* and/or 110*o* as a fluid exit point, as illustrated in FIGS. 2P and 2Q. Thus, in FIG. 2P, surface borehole opening 115*o* is used for fluid entry (F1), while surface borehole openings 105*o* and 110*o* are each used for fluid exit (F2, F3, respectively). In FIG. 2Q surface borehole opening 115*o* is used for fluid entry (F1) and surface borehole opening 110 is used for fluid exit (F2), and wherein it is noted that a flow-control valve closed at surface region s prevents fluid flow up through surface borehole opening 105*o*. The reversal of flow created in accordance with the embodiments shown in FIGS. 2P and 2Q, may be beneficial to extract mineral material closer to the distal ends of borehole extensions 105*b* and 110*b* and to develop sump 235, where, as hereinbefore noted, undesirable mineral material may precipitate and accumulate. In particular, in instances when brine saturation occurs at the distal ends of borehole extensions 105*b* and 110*b* resulting in limited mineral extraction at these distal ends when borehole openings 105*o* and/or 110*o*, are used, extraction may still be achieved at these distal ends when borehole opening 115*o* is used as a fluid entry point, and brine containing relatively low concentrations of the mined mineral first migrates through the distal portions of borehole extensions 105*b* and 110*b*. Furthermore, the operation of this alternate fluid path, may result in a further expansion in width of the distal portions of borehole extensions 105*b* and 110*b*, and thus the operation of this alternate fluid path permits further control over the development of the geometry of borehole extensions 105*b* and 110*b*.

Figure 2R:
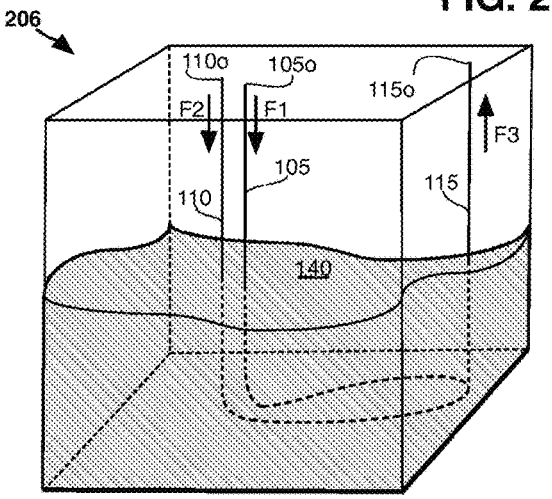
FIG. 2R is a schematic perspective view of a resource extraction configuration and process according to another example embodiment of the present disclosure.
Figure 2S:
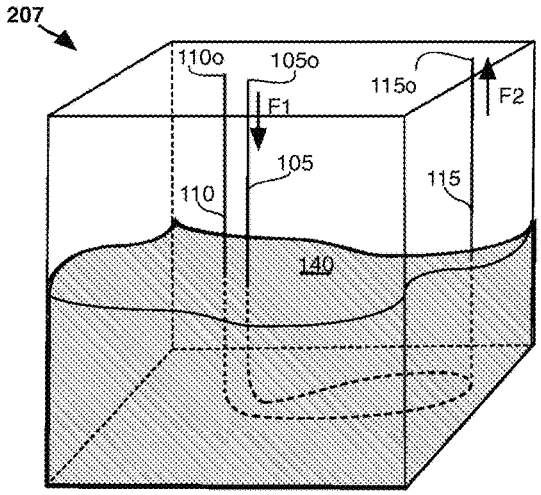
FIG. 2S is a schematic perspective view of a resource extraction configuration and process according to another example embodiment of the present disclosure.

Further example flow paths are illustrated in FIGS. 2R-2S, wherein in FIG. 2R, surface borehole openings 105*o* and 110*o* are each used for fluid entry (F1, F2, respectively) and surface borehole opening 115*o* is used for fluid exit (F3). In FIG. 2S, surface borehole opening 105*o* is used for fluid entry (F1) and surface borehole opening 115*o* is used for fluid exit (F2), and wherein it is noted that a flow-control valve closed at surface region s prevents fluid flow up through surface borehole opening 110*o*. The foregoing are only some examples of operable fluid paths that may be used in conjunction with example resource extraction configuration 200 according to the present disclosure. Those of skill in the art will appreciate that other fluid paths that may be used in conjunction with resource extraction configuration 200 the fluid flow paths shown in FIGS. 2N-2S are not meant to be exhaustive as there may be other operable fluid paths, all of which may be used in accordance with the present disclosure. Furthermore it is noted that the number of possible fluid paths is even larger when more complex resource extraction configurations are operated in accordance herewith, such as, resource extraction configurations 300, 301, 302 and 303, shown in FIGS. 3A-3F, for example, It is noted that the adjacent positioning of boreholes 105 and 110 permits operation of the boreholes 105 and 110 from a single well pad at surface region s positioned at borehole openings 105*o* and 110*o* (see: FIGS. 1A-1B), thereby limiting the need of transport of fluids used in operation of the resource extraction configurations of the present disclosure. In this manner construction of pipelines at surface region s and operating of pumps, or truck transport of fluids can be limited. Furthermore, when operating in colder temperatures heat loss of discharged brine is avoided, which in turn can improve the mineral recovery process, since many mineral recovery processes require the recovered brine to be at a higher temperature, for example, 50° C., 60° C., or higher. It is noted that in this respect, embodiments comprising a single borehole in which two or more borehole strings have been installed may offer superior insulation and thus provide for recovered brine having higher temperatures.

Figure 3A:
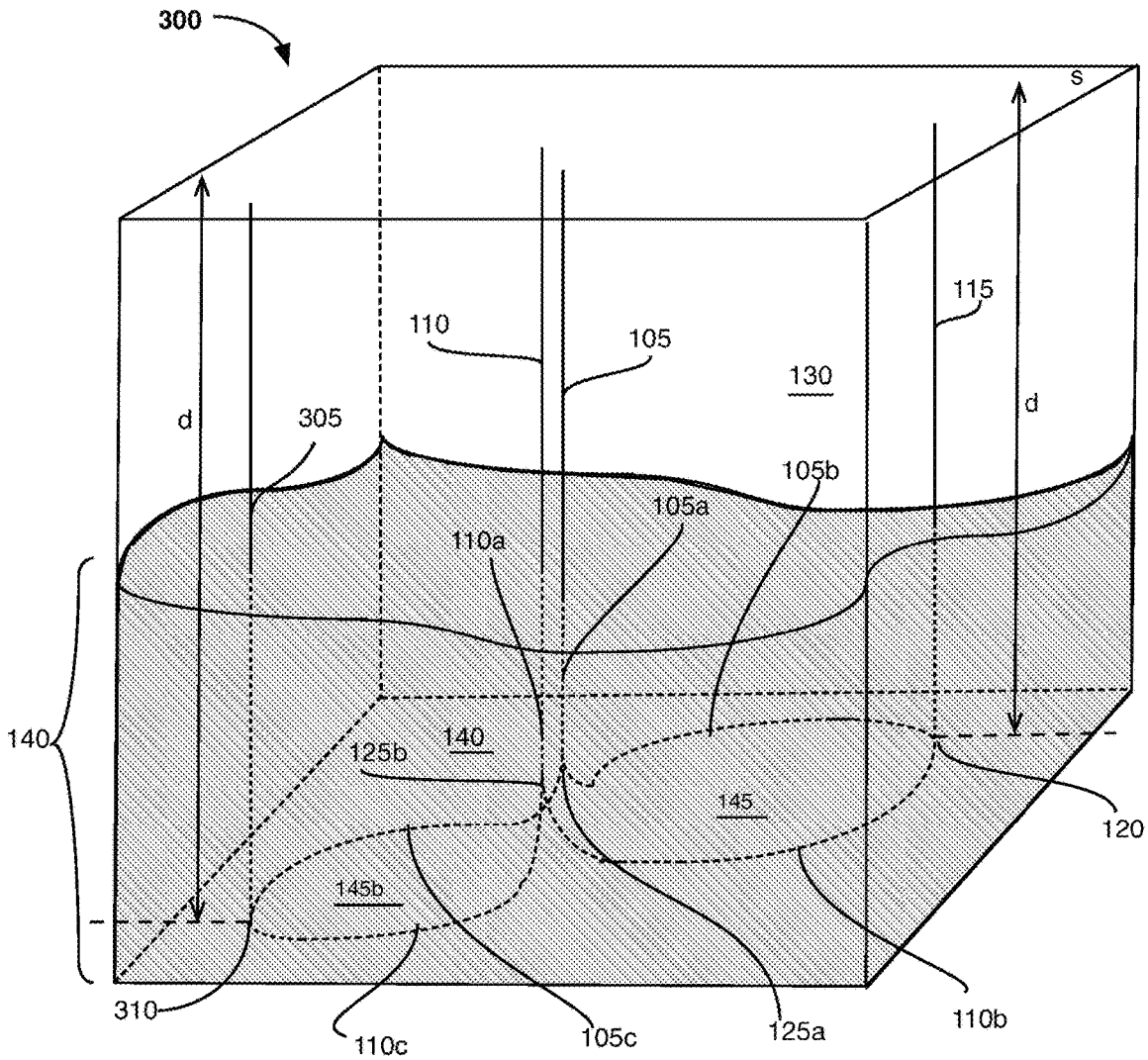
FIG. 3A is a schematic perspective view of a resource extraction configuration according to another example embodiment of the present disclosure.
Figure 3B:
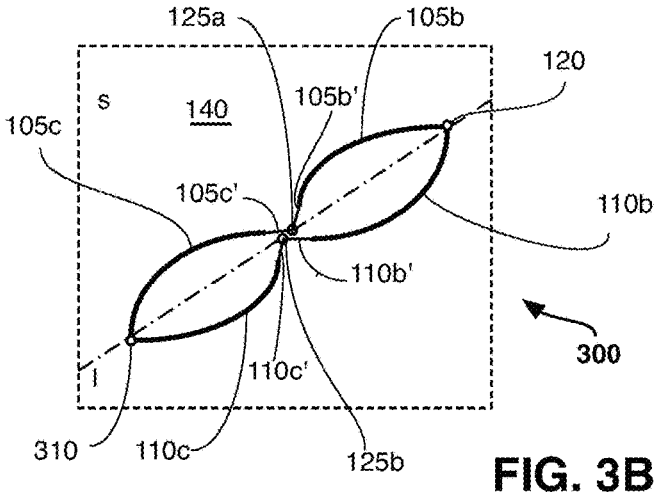
FIG. 3B is a schematic overhead view of the resource extraction configuration of FIG. 3A.
Figure 3C:
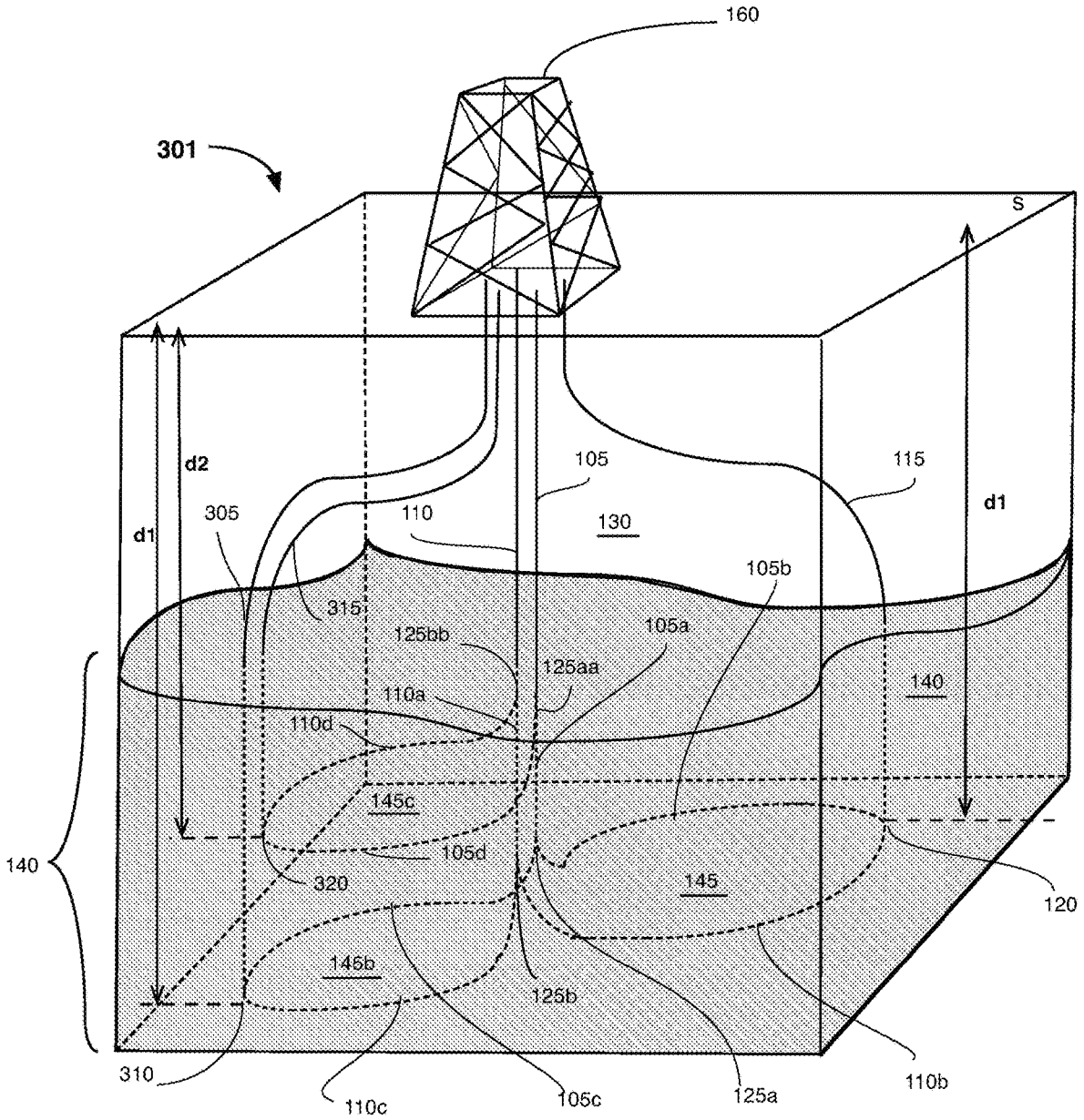
FIG. 3C is a schematic perspective view of a resource extraction configuration according to another example embodiment of the present disclosure.
Figure 3D:
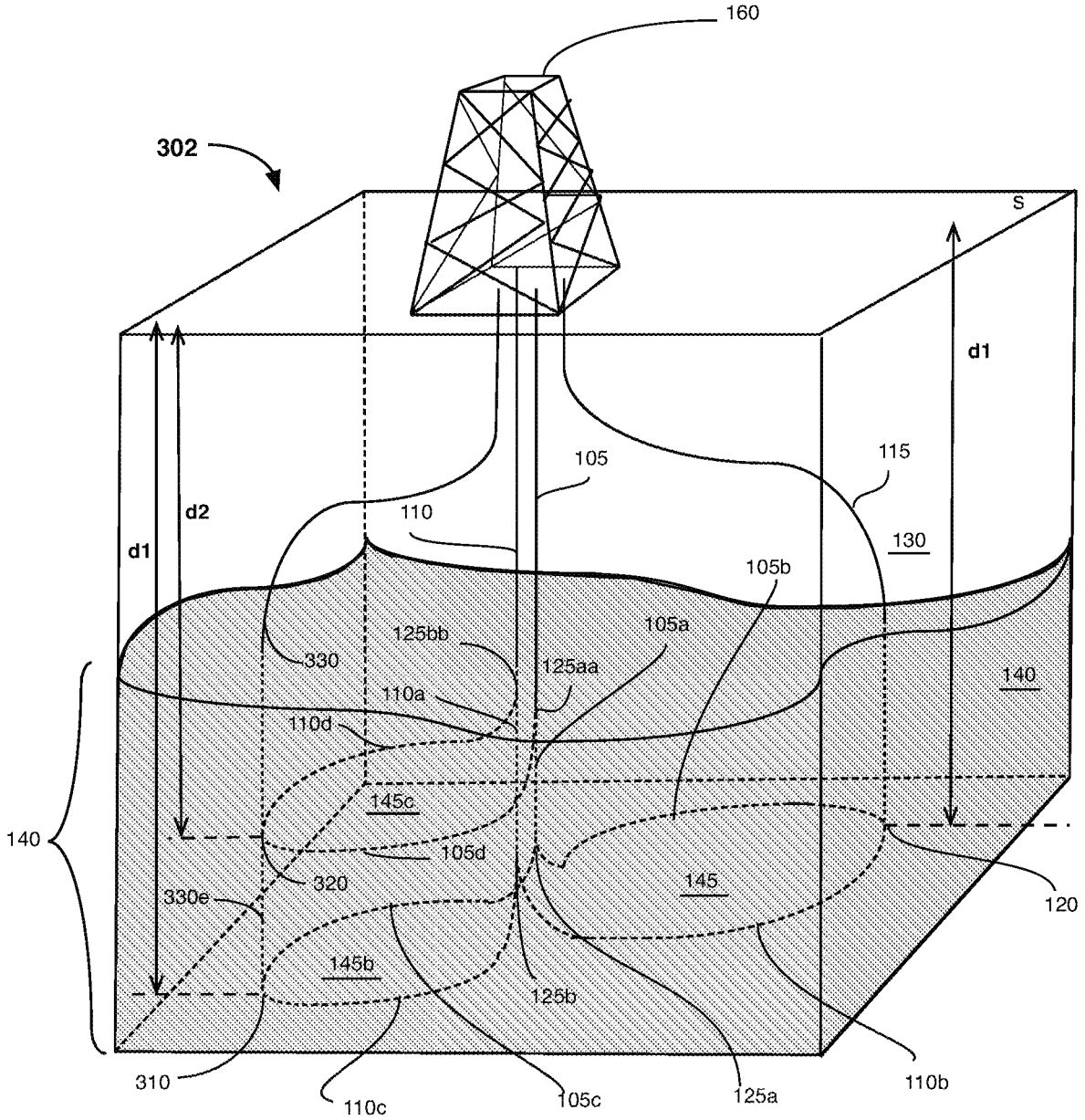
FIG. 3D is a schematic perspective view of a resource extraction configuration according to another example embodiment of the present disclosure.
Figure 3E:
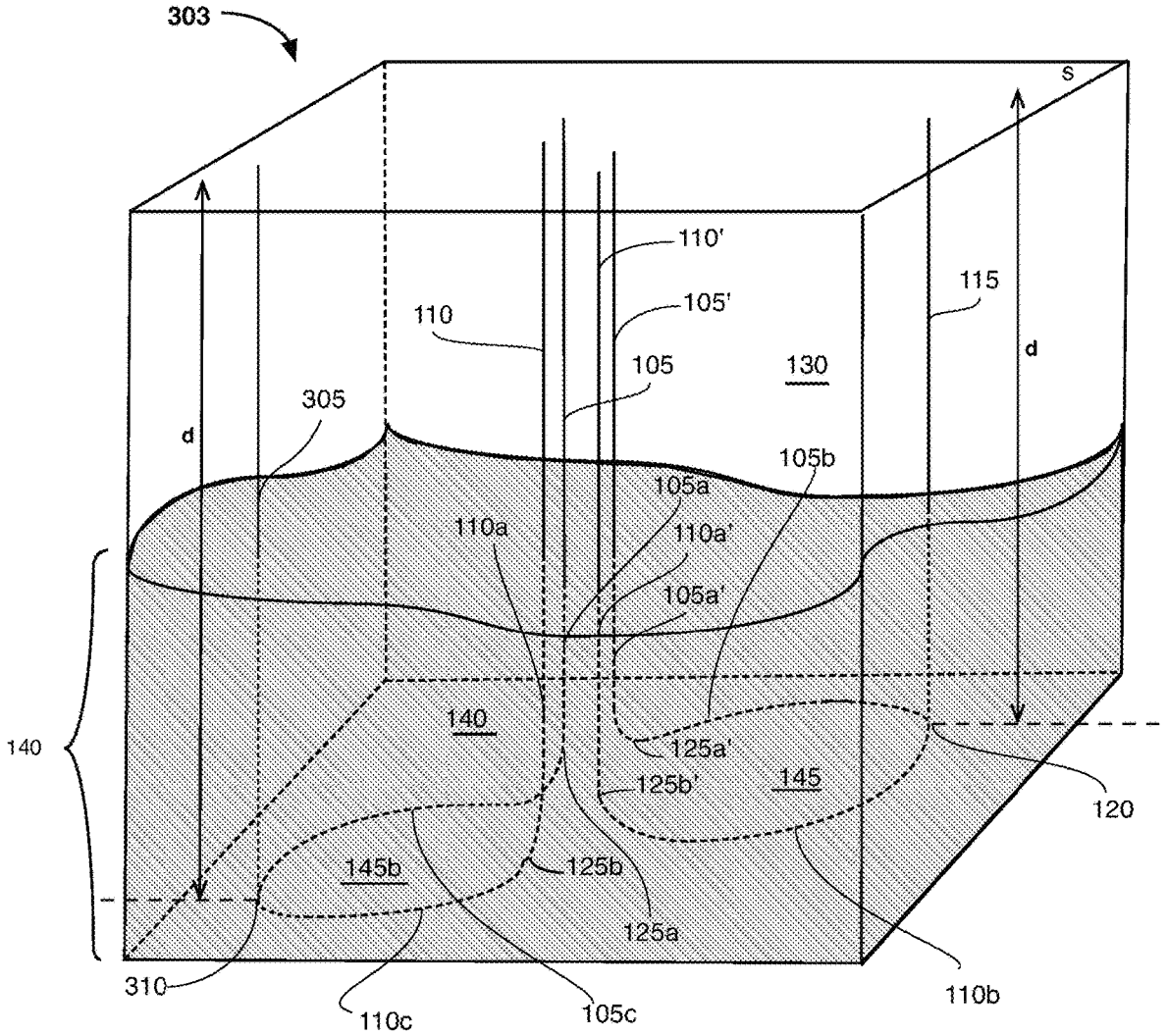
FIG. 3E is a schematic perspective view of a resource extraction configuration according to another example embodiment of the present disclosure.
Figure 3F:
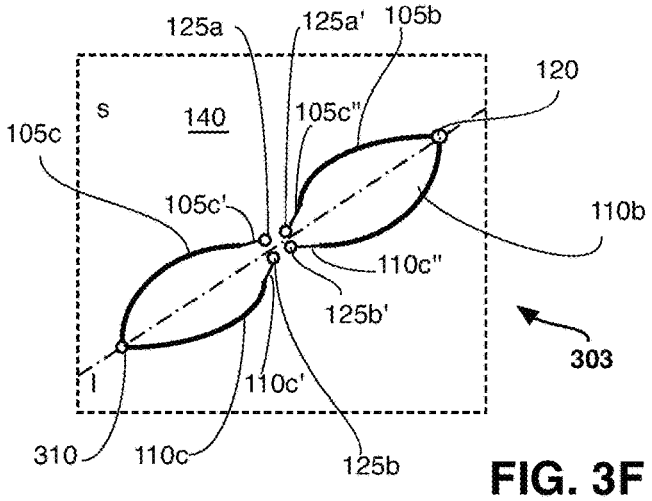
FIG. 3F is a schematic horizontal cross-sectional view of the resource extraction configuration of FIG. 3E.

Referring now to FIGS. 3A-3F, shown therein are additional resource extraction configurations 300 (FIG. 3A-3B), 301 (FIG. 3C) and 302 (FIG. 3D). Resource extraction configuration 300 is configured to comprise a second substantially horizontal borehole extension 105*c* extending from vertical borehole extension 105*a* of borehole 105, and a second substantially horizontal borehole extension 110*c* extending from vertical borehole extension 110*a* of borehole 110. Horizontal borehole extensions 105*c* and 110*c* connect at second distal nodal space 310. Horizontal borehole extensions 105*b* and 110*b* are planarly situated between extension points 125*a* and 125*b*, and distal nodal space 120, in such a manner that they together form a penannular extension, and, further, in such a manner that separating portion 145 of mineral deposit 140 separates and is surrounded or embraced by horizontal borehole extensions 105*b* and 110*b*. Similarly, horizontal borehole extensions 105*c* and 110*c* are planarly situated between extension points 125*a* and 125*b*, and distal nodal space 310, in such a manner that they together form another penannular extension, and further, in such a manner that separating portion 145*b* of mineral deposit 140 separates and is surrounded or embraced by horizontal borehole extensions 105*c* and 110*c*. In addition, substantially vertical borehole 305 which is spaced away from boreholes 105, 110 and 115, terminates at distal nodal space 310. A horizontal cross-sectional view at depth d of the configuration 300 is shown in FIG. 3B. It is noted that an imaginary straight line l can be drawn from first distal nodal space 120 approximately through extension points extension points 125*a* and 125*b* to second distal nodal space 310. Resource extraction configuration 300 can accommodate solvent flows downward from surface region s through borehole extension 105*a* and then both borehole extensions 105*b* and 105*c* and upwards via distal nodal space 120 and 310, respectively, through borehole extensions 110*b* and 110*c* and upwards to surface region s through borehole extension 110*a*. It is noted that portions 105*b*', 105*c*, 110*b*' and 110*c*' (see FIG. 3B) of horizontal borehole extension 105*b*, 105*c*, 110*b* and 110*c* are cased sections, while the remaining portions of horizontal borehole extension 105*b*, 105*c*, 110*b* and 110*c* are uncased.

Referring now to FIG. 3C, resource extraction configuration 301 is configured to include additional extension points 125*aa* and 125*bb*, to serve as extension points for borehole extensions 105*d* and 110*d* in such a manner that they form another penannular extension, and further, in such a manner that separating portion 145*c* of mineral deposit 140 separates and is surrounded (e.g. embraced) by horizontal borehole extensions 105*d* and 110*d*. In addition, borehole 315 terminates at distal nodal space 320. It is noted that distal nodal space 310 and horizontal borehole extensions 105*c* and 110*c* are situated at depth d1, whereas distal nodal space 310 and horizontal borehole extensions 105*c* and 110*c* are situated at depth d2. Thus, resource extraction configuration 301 allows for mining of mineral deposit 140 at two different depths, relative to surface region s. Accordingly, in different embodiments, a plurality of extension points at a plurality of depths may be implemented to thereby allow for resource extraction at a plurality of depths relative to surface region s.

Referring now to FIG. 3D showing resource extraction configuration 302, which much like resource extraction configuration 301 in FIG. 3C allows for resource extraction of mineral deposit 140 at two different depths, d1 and d2, relative to surface region s. In resource extraction configuration 302 however, rather than having two borehole extensions 315 and 320, extending to distal nodal spaces 310 and 320, resource extraction configuration 302 includes single borehole extension 330 extending from surface region s to both distal nodal spaces 310 and 320. It is noted that terminal section 330*e* of borehole extension 330 is coupled to distal nodal spaces 310 and 320 to establish a subterranean fluidic communication between distal nodal spaces 310 and 320.

Referring now to FIGS. 3E-3F, shown therein is resource extraction configuration 303 which includes horizontal borehole extensions 105*b*, 110*b* and 105*c*, 110*c* which are configured in a similar fashion as horizontal borehole extensions 105*b*, 110*b* and 105*c*, 110*c* in resource extraction configuration 300 (FIGS. 3A-3B). However, resource extraction configuration 303 includes 2 borehole pairs (105, 110) and (105' 110'). Borehole pair (105, 110) comprises vertical borehole extensions 105*a* and 110*a* extending vertically from surface region s to extension points 125*a* and 125*b*, and further extending horizontally from extension points 125*a* and 125*b* to form horizontal borehole extensions 105*c* and 110*c* and connect at distal nodal space 310. Borehole pair (105', 110') comprises vertical borehole extensions 105*a'* and 110*a'* extending vertically from surface region s to extension points 125*a'* and 125*b'*, and further extending horizontally from extension points 125*a'* and 125*b'* to form horizontal borehole extensions 105*b* and 110*b* and connect at distal nodal space 120. It is noted that in resource extraction configuration 303, borehole pairs (105, 110) and (105' 110') are fluidically not connected below surface region s, and each of the borehole pairs (105, 110) and (105' 110') can be independently operated. A permanent or temporary fluidic connection may be established above surface region s, as desired (not shown).

Figure 4A:
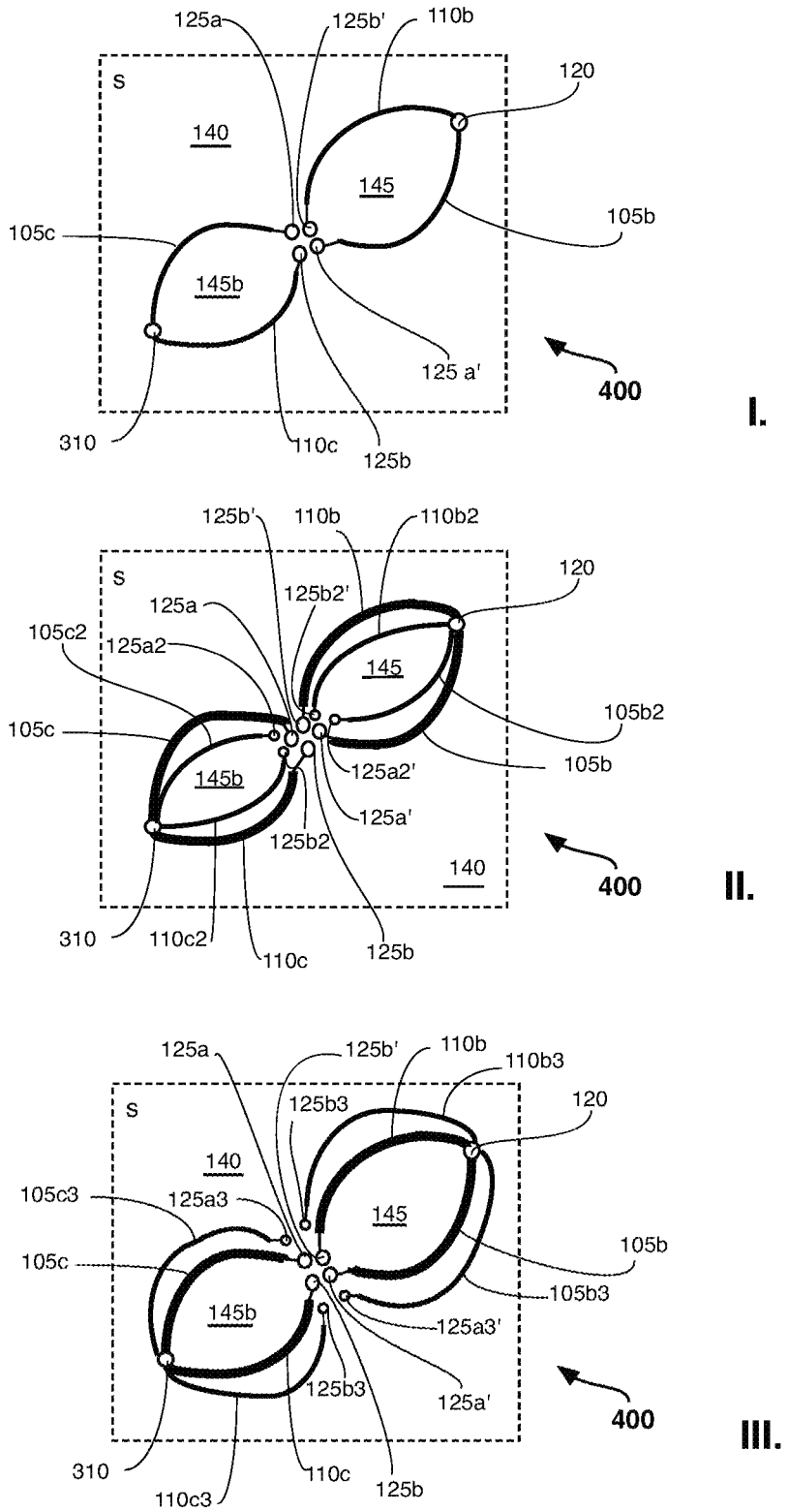
FIG. 4A is a schematic horizontal cross-sectional view of a resource extraction configuration according to another example embodiment of the present disclosure, in a first state (I), and a second state (II), developed starting from state (I), and an alternate second state (III), developed starting from state (I).

Referring now to FIGS. 4A-4D, further resource extraction configurations 400, 401, 403 and 404 according to the present disclosure are shown. Referring initially to FIG. 4A, shown therein is resource extraction configuration 400 shown in an initial state (I), from which two alternate states (II) and (III) are developed. State (I) corresponds with a state when a limited amount of mineral material has been extracted from horizontal borehole extensions 105*b*, 110*b*, 105*c* and 110*c*. Following a period of mineral extraction in accordance with the herein described processes, the width of horizontal borehole extensions 105*b*, 110*b*, 105*c* and 110*c* increases, as generally previously shown in FIGS. 2A-2C. In order to develop state (II) from state (I), each of horizontal borehole extensions 105*b*, 110*b*, 105*c* and 110*c*, having extension points 125*a'*, 125*b'*, 125*a* and 125*b*, respectively, are closed using a flow-control valve, installed within borehole extensions 105*b*, 110*b*, 105*c* or 110*c*, or at surface region s. New horizontal extensions 105*b*2, 110*b*2, 105*c*2 and 110*c*2, including extension points 125*a*2', 125*b*2', 125*a*2 and 125*b*2, respectively located interior relative 105*b*, 110*b*, 105*c* and 110*c* are drilled and operated, essentially as described before. It should be noted that in the absence of flow-control valves installed at within borehole extensions 105*b*, 110*b*, 105*c* or 110*c* or at surface region s, boreholes may also be closed in other ways, for example by installing a cement plug.

It is noted that a further alternate embodiment may be developed starting from state (I) by drilling a single additional horizontal borehole extension e.g. only 110*b*2 or only 105*b*2 through separating portion 145, or, only 105*c*2 or only 110*c*2 through separating portion 145*b* to connect with distal nodal cavities 120 and 310, respectively, and use such single additional horizontal borehole in conjunction with the existing horizontal borehole extension 105*b* and/or 110*b*; or 105*c* and/or 110*c* as a flow path (now shown). Flow-control valves installed within borehole extensions 105*b*, 110*b*, 105*c* or 110*c* or at surface region s may be used to close 105*b* or 110*b*, or 105*c* or 110*c*.

In order to develop state (III) from state (I), each of horizontal borehole extensions 105*b*, 110*b*, 105*c* and 110*c* are closed with a flow-control valve installed at within borehole extensions 105*b*, 110*b*, 105*c* or 110*c* or surface region s. New horizontal extensions 105*b*3, 110*b*3, 105*c*3 and 110*c*3, including extension points 125*a*3', 125*b*3', 125*a*3 and 125*b*3, located exterior relative to 105*b*, 110*b*, 105*c* and 110*c*, are drilled and operated, essentially as described before. States (II) and (III) allow for further extraction of mineral deposit 140 using existing vertical boreholes.

Figure 4B:
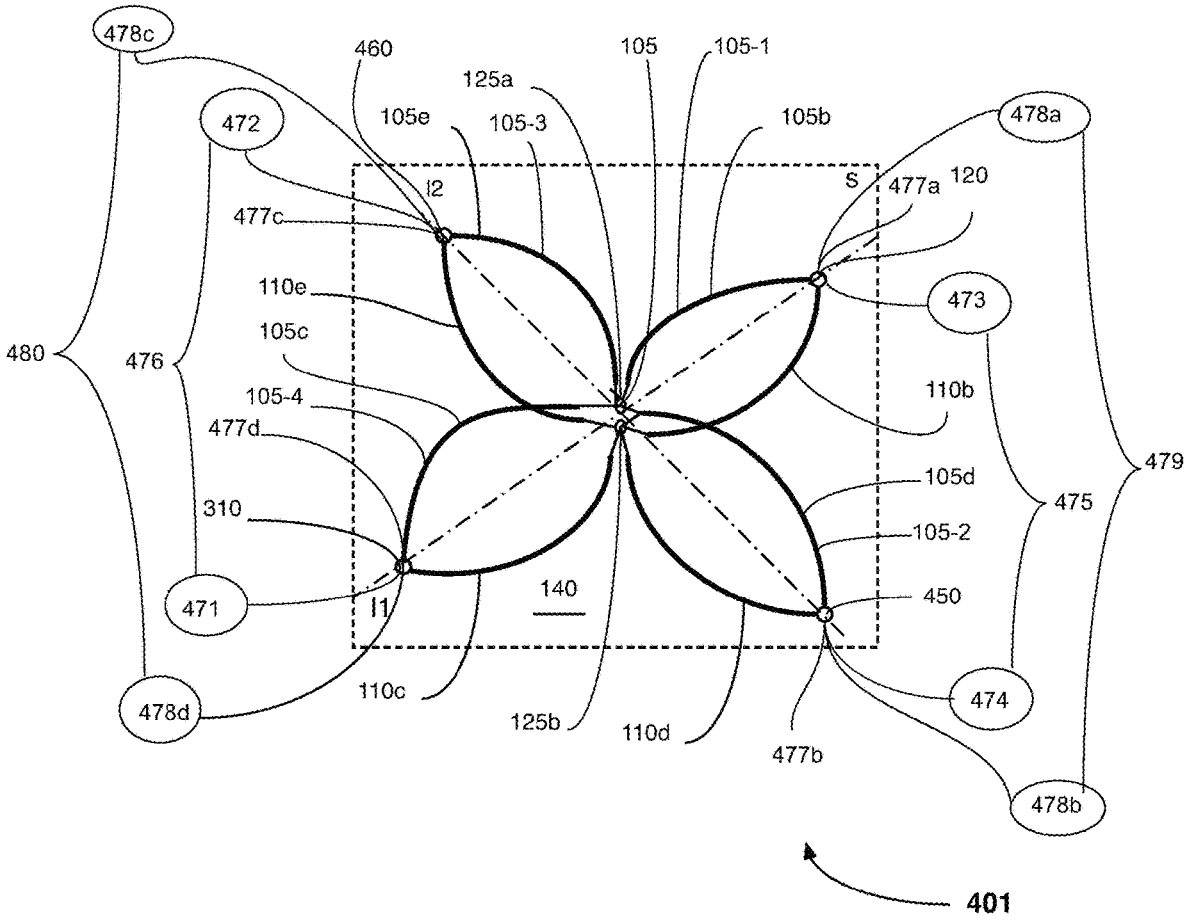
FIG. 4B is a schematic horizontal cross-sectional view of a resource extraction configuration according to another example embodiment of the present disclosure.

Referring now to FIG. 4B, shown therein is another resource extraction configuration 401, comprising four distal nodal spaces 120, 310, 450 and 460, each representing a contact point between a substantially horizontal borehole, 105*b*, 105*c*, 105*d* and 105*e*, respectively, extending from extension point 125*a*, and substantially horizontal boreholes 110*b*, 110*c*, 110*d* and 110*e* extending from extension point 125*b*. Resource extraction configuration 402 can accommodate solvent flows downward from surface region s via extension point 125*a* through both borehole extensions 105*b*, 105*c*, 105*d* and 105*e* to distal nodal spaces 120, 310, 450 and 460 then upwards via extension point 125*a* to surface region s. It is noted that a first imaginary straight line l1 can be drawn from first distal nodal space 120 through extension points extension points 125*a* and 125*b* to second distal nodal space 310, and a second imaginary straight line l2 can be drawn from third distal nodal space 450 approximately through extension points extension points 125*a* and 125*b* to fourth distal nodal space 460.

Figure 4C:
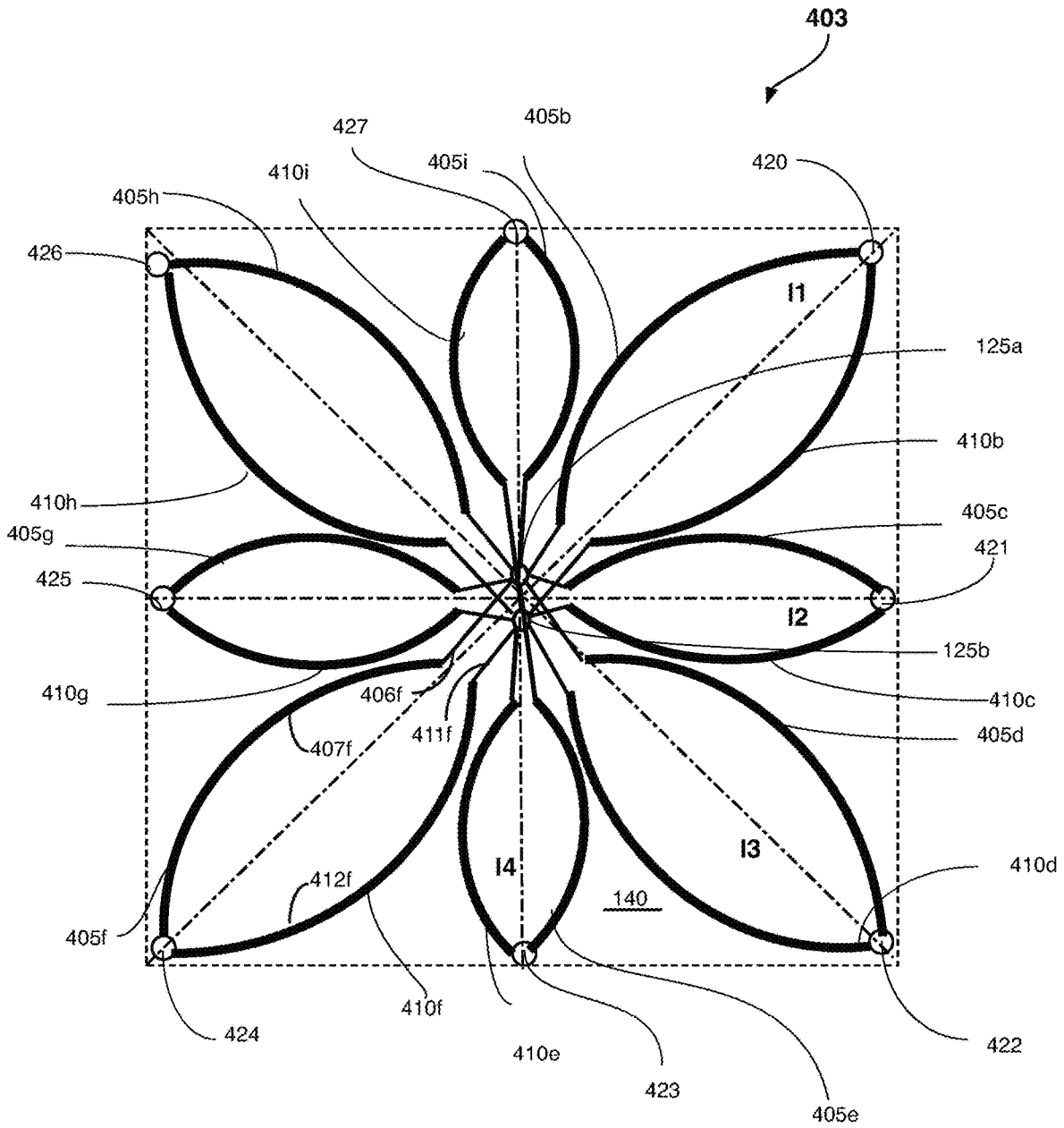
FIG. 4C is a schematic horizontal cross-sectional view of a resource extraction configuration according to another example embodiment of the present disclosure.

Referring now to FIG. 4C, shown therein is another resource extraction configuration 403, comprising eight distal nodal spaces 420, 421, 422, 423, 424, 425, 426 and 427, each representing a contact point between a substantially horizontal borehole extension 405*b*, 405*c*, 405*d*, 105*e*, 405*f*, 405*g*, 405*h* and 405*i*, respectively, extending from extension point 125*a*, and a substantially horizontal borehole extension, 410*b*, 410*c*, 410*d*, 410*e*, 410*f*, 410*g*, 410*h* and 410*i*, respectively, extending from extension point 125*b*. It is noted that, by way of example, cased sections 406*f* and 411*f*, and non-cased sections 407*f* and 412*f* of horizontal borehole extensions 405*f* and 410*f* have been denoted for illustrative purposes. Cased and non-cased sections for the other horizontal borehole extensions are also shown in FIG. 4C, however they have not been numbered to avoid cluttering the figure. Resource extraction configuration 403 can accommodate solvent flows through borehole extensions 405*b*, 405*c*, 405*d*, 405*e*, 405*f*, 405*g*, 405*h* and 405*i* downward from surface region s to distal nodal spaces 420, 421, 422, 423, 424, 425, 426 and 427 and then upwards through borehole extensions 410*b*, 410*c*, 410*d*, 410*e*, 410*f*, 410*g*, 410*h* and 410*i* to surface region s. It is noted that a first imaginary straight line l1 can be drawn from first distal nodal space 420 approximately through extension points 125*a* and 125*b* to fifth distal nodal space 424, a second imaginary straight line l2 can be drawn from second distal nodal space 421 approximately through extension points 125*a* and 125*b* to sixth distal nodal space 425, a third imaginary straight line 13 can be drawn from third distal nodal space 422 approximately through extension points 125*a* and 125*b* to sixth distal nodal space 426, and a fourth imaginary straight line 14 can be drawn from fourth distal nodal space 423 approximately through extension points 125*a* and 125*b* to sixth distal nodal space 427.

Figure 4D:
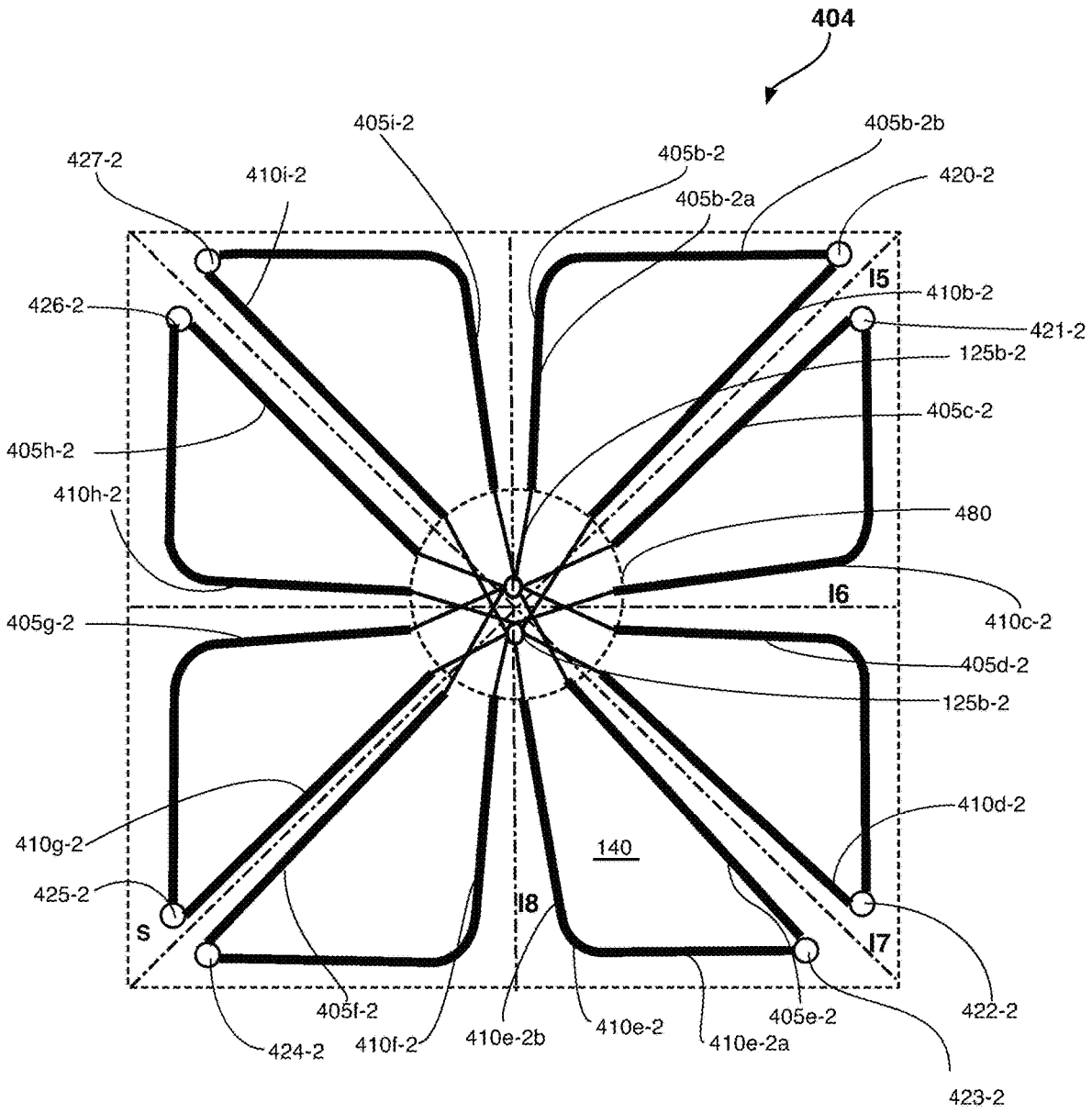
FIG. 4D is a schematic horizontal cross-sectional view of a resource extraction configuration according to another example embodiment of the present disclosure.

Referring now to FIG. 4D, shown therein is another resource extraction configuration 404 on an approximately square area of surface region s comprising eight distal nodal spaces 420-2, 421-2, 422-2, 423-2, 424-2, 425-2, 426-2 and 427-2, each representing a contact point between a substantially horizontal borehole extension 405*b*-2, 405*c*-2, 405*d*-2, 105*e*-2, 405*f*-2, 405*g*-2, 405*h*-2 and 405*i*-2, respectively, extending from extension point 125*a*-2, and a substantially horizontal borehole extension 410*b*-2, 410*c*-2, 410*d*-2, 410*e*-2, 410*f*-2, 410-2, 410*h*-2 and 410*i*-2, respectively, extending from extension point 125*b*-2. It is noted that, one of each pair of substantially horizontal borehole extensions (405*b*-2, 410*b*-2), (405*c*-2, 410*c*-2), (405*d*-2, 410*d*-2), (405*e*-2, 410*e*-2), (405*f*-2, 410*f*-2), (405*g*-2, 410*g*-2), (405*h*-2 410*h*-2), and (4051-2 410*i*-2), comprises two different portions extending each in a different direction. By way of example denoted in FIG. 4D are substantially horizontal borehole 405*b*-2 comprising a section 405*b*-2*a* from which 405*b*-2*b* laterally extends; and substantially horizontal borehole 410*e*-2 comprising a section 410*e*-2*a* from which 410*e*-2*b* laterally extends. Resource extraction configuration 404 can accommodate solvent flows through borehole extensions 405*b*-2, 405*c*-2, 405*d*-2, 405*e*-2, 405*f*-2, 405*g*-2, 405*h*-2 and 405*i*-2 downward from surface region s to distal nodal spaces 420-2, 421-2, 422-2, 423-2, 424-2, 425-2, 426-2 and 427-2 and then upwards through borehole extensions 410*b*-2, 410*c*-2, 410*d*-2, 410*e*-2, 410*f*-2, 410*g*-2, 410*h*-2 and 410*i*-2 to surface region s. It is noted that imaginary diagonal lines 15 and 17 extending from the corners of the approximately square area on surface region s and imaginary diagonal lines 16 and 18, divide surface region s into four equal sized squares, and do not cross any of the substantially horizontal boreholes extensions.

It is noted that the order in which the pairs of horizontal boreholes (405*b*-2, 410*b*-2), (405*c*-2, 410*c*-2), (405*d*-2, 410*d*-2), (405*e*-2, 410*e*-2), (405*f*-2, 410*f*-2), (405*g*-2, 410*g*-2), (405*h*-2 410*h*-2), and (405*i*-2 410*h*-2) are implemented, or operated may be varied. Thus, for example, all horizontal boreholes (405*b*-2, 410*b*-2), (405*c*-2, 410*c*-2), (405*d*-2, 410*d*-2), (405*e*-2, 410*e*-2), (405*f*-2, 410*f*-2), (405*g*-2, 410*g*-2), (405*h*-2 410*h*-2), and (405*i*-2 410*h*-2) may be constructed and then operation of all may follow more or less simultaneously, or some, but not all, of the pairs of horizontal borehole extensions (405*b*-2, 410*b*-2), (405*c*-2, 410*c*-2), (405*d*-2, 410*d*-2), (405*e*-2, 410*e*-2), (405*f*-2, 410*f*-2), (405*g*-2, 410*g*-2), (405*h*-2 410*h*-2), and (405*i*-2 410*h*-2) may initially be constructed and operated, and at a later stage additional borehole extensions may be constructed and operated. Accordingly, at different points in time, the pairs of horizontal borehole extensions (405*b*-2, 410*b*-2), (405*c*-2, 410*c*-2), (405*d*-2, 410*d*-2), (405*e*-2, 410*e*-2), (405*f*-2, 410*f*-2), (405*g*-2, 410*g*-2), (405*h*-2 410*h*-2), and (405*i*-2 410*h*-2), may be in different operational stages.

The inventors have determined that implementing resource extraction configuration 404 shown in FIG. 4D on a section of land (1 square mile), will allow the development of eight substantially horizontal borehole sections (e.g. 405*b*-2 and 410*b*-2, combined), each 1,367 meters in length, assuming a diameter of circle 480 of 636 meters comprising cased sections. The substantially horizontal borehole sections can each reach a width of up to about 50 m to 100 m. It is estimated that in embodiments where potash is mined up to approximately at least 40%, at least 50%, at least 75%, and up to 100% of the total available potash within the section at the depth that the resource extraction configuration 404 is implemented may be recovered. For a similar design relying instead on six substantially horizontal borehole sections (not shown), the inventors have determined that up to at least 40%, at least 50%, at least 75%, and up to 100% of the total available potash may be recovered at surface region s. It is noted that the percentage of total available potash that may be mined using configuration 403 in FIG. 4C is somewhat lower than when configuration 404 in FIG. 4D is used.

As hereinbefore noted, in other embodiments, resource extraction configuration 404 shown in FIG. 4D may be implemented in a manner wherein horizontal borehole sections (e.g. 405*b*-2 and 410*b*-2, combined) extend further, for example, 2 miles, 3 miles or 4 miles.

Figure 5A:
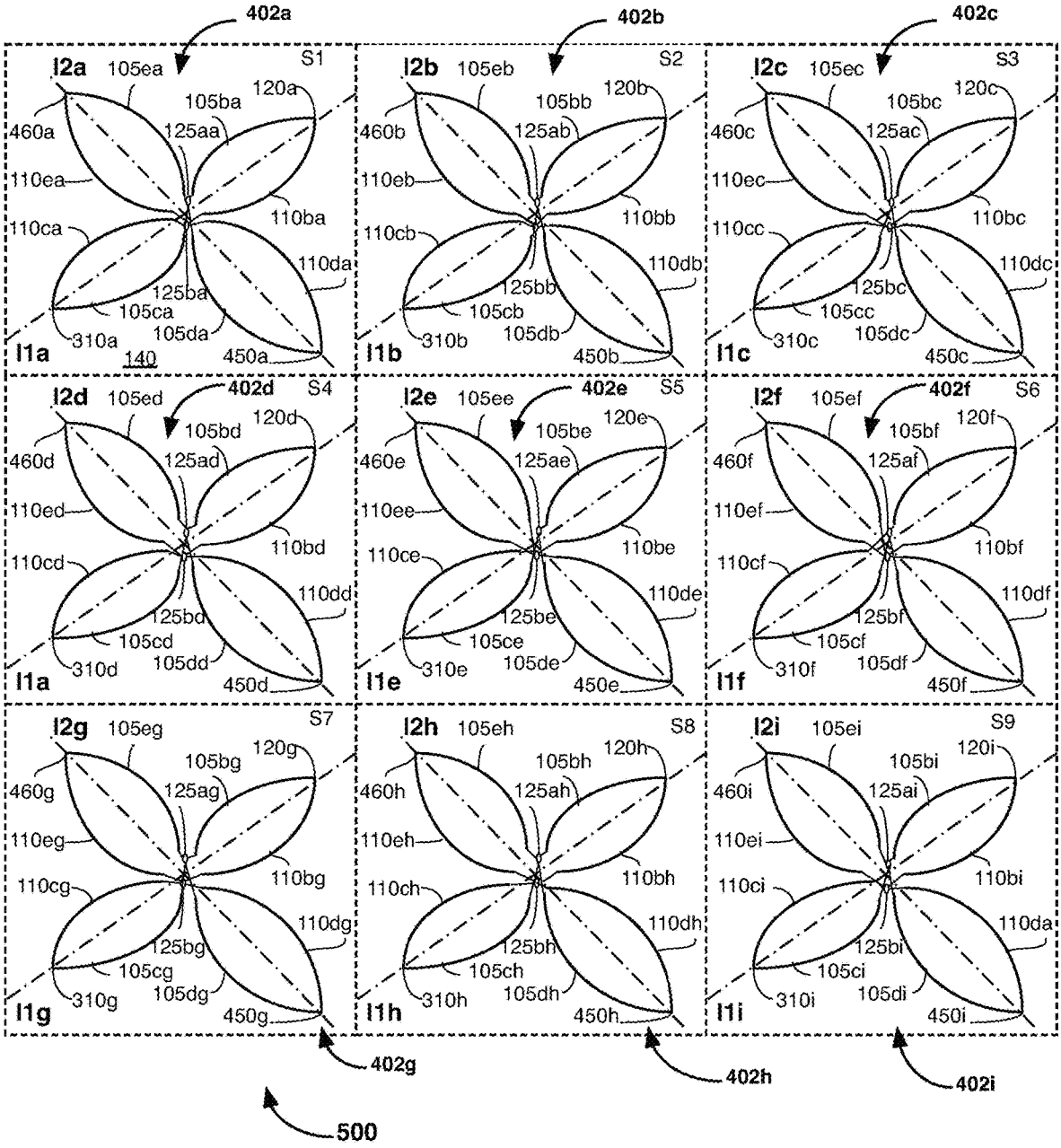
FIG. 5A is a schematic horizontal cross-sectional view of a resource extraction configuration according to another example embodiment of the present disclosure.

Referring now to FIG. 5A, shown therein is resource extraction configuration 500, comprising an array of nine of resource extraction sub-configurations 402*a*, 402*b*, 402*c*, 402*d*, 402*e*, 402*f*, 402*g*, 402*h* and 402*i*, configured below surface regions s1, s2, s3, s4, s5, s6, s7, s8 and s9, respectively, and the underlying subterranean spaces associated with these surface regions. As hereinbefore noted, in some embodiments, surface regions s1, s2, s3, s4, s5, s6, s7, s8 and s9, can each be a separate section of land. Resource extraction sub-configuration 402*a* comprises four distal nodal spaces 120*a*, 310*a*, 450*a* and 460*a*, each representing a contact point between a substantially horizontal borehole 105*ba*, 105*ca*, 105*da* and 105*ea*, respectively, extending from extension point 125*aa*, and a substantially horizontal borehole 110*ba*, 110*ca*, 110*da* and 110*ea*, respectively, extending from extension point 125*ba*. Resource extraction configuration 402*a* can accommodate solvent flows downward from surface region s1 through both borehole extensions 105*ba*, 105*ca*, 105*da* and 105*ea*, to distal nodal spaces 120*a*, 310*a*, 450*a* and 460*a* through borehole extensions 110*ba*, 110*ca*, 110*da* and 110*ea* and then upwards to surface region s1. It is noted that a first imaginary straight line I1*a* can be drawn from first distal nodal space 120*a* approximately through extension points extension points 125*aa* and 125*ba* to second distal nodal space 310*a*, and a second imaginary straight line I2*a* can be drawn from third distal nodal space 450*a* approximately through extension points extension points 125*aa* and 125*ba* to fourth distal nodal space 460*a*.

Resource extraction sub-configuration 402*b* comprises four distal nodal spaces 120*b*, 310*b*, 450*b* and 460*b*, each representing a contact point between a substantially horizontal borehole 105*bb*, 105*cb*, 105*db* and 105*eb*, respectively, extending from extension point 125*ab*, and a substantially horizontal borehole 110*bb*, 110*cb*, 110*db* and 110*eb*, respectively, extending from extension point 125*bb*. Resource extraction configuration 402*b* can accommodate solvent flows downward from surface region s2 through borehole extensions 105*bb*, 105*cb*, 105*db* and 105*eb* to distal nodal spaces 120*b*, 310*b*, 450*b* and 460*b* through borehole extensions 110*bb*, 110*cb*, 110*db* and 110*eb* and then upwards to surface region s2. It is noted that a first imaginary straight line l1*b* can be drawn from first distal nodal space 120*b* approximately through extension points extension points 125*ab* and 125*bb* to second distal nodal space 310*b*, and a second imaginary straight line l2*b* can be drawn from third distal nodal space 450*b* approximately through extension points extension points 125*ab* and 125*bb* to fourth distal nodal space 460*b*.

Resource extraction sub-configuration 402*c* comprises four distal nodal spaces 120*c*, 310*c*, 450*c* and 460*c*, each representing a contact point between a substantially horizontal borehole 105*bc*, 105*cc*, 105*dc* and 105*ec*, respectively, extending from extension point 125*ac*, and a substantially horizontal borehole 110*bc*, 110*cc*, 110*dc* and 110*ec*, respectively, extending from extension point 125*bc*. Resource extraction configuration 402*c* can accommodate solvent flows downward from surface region s3 through borehole extensions 105*bc*, 105*cc*, 105*dc* and 105*ec* to via distal nodal spaces 120*c*, 310*c*, 450*c* and 460*c* through borehole extensions 110*bc*, 110*cc*, 110*dc* and 110*ec* and then upwards to surface region s3. It is noted that a first imaginary straight line I1*c* can be drawn from first distal nodal space 120*c* approximately through extension points extension points 125*ac* and 125*bc* to second distal nodal space 310*c*, and a second imaginary straight line l2*c* can be drawn from third distal nodal space 450*c* approximately through extension points extension points 125*ac* and 125*bc* to fourth distal nodal space 460*c*.

Resource extraction sub-configuration 402*d* comprises four distal nodal spaces 120*d*, 310*d*, 450*d* and 460*d*, each representing a contact point between a substantially horizontal borehole 105*bd*, 105*cd*, 105*dd* and 105*ed*, respectively, extending from extension point 125*ad*, and a substantially horizontal borehole 110*bd*, 110*cd*, 110*dd* and 110*ed*, respectively, extending from extension point 125*bd*. Resource extraction configuration 402*d* can accommodate solvent flows downward from surface region s4 through borehole extensions 105*bd*, 105*cd*, 105*dd* and 105*ed* to distal nodal spaces 120*d*, 310*d*, 450*d* and 460*d* through borehole extensions 110*bd*, 110*cd*, 110*dd* and 110*ed* and then upwards to surface region s4. It is noted that a first imaginary straight line l1*d* can be drawn from first distal nodal space 120*d* approximately through extension points extension points 125*ad* and 125*bd* to second distal nodal space 310*d*, and a second imaginary straight line l2*d* can be drawn from third distal nodal space 450*d* approximately through extension points extension points 125*ad* and 125*bd* to fourth distal nodal space 460*d*.

Resource extraction sub-configuration 402*e* comprises four distal nodal spaces 120*e*, 310*e*, 450*e* and 460*e*, each representing a contact point between a substantially horizontal borehole 105*be*, 105*ce*, 105*de* and 105*ee*, respectively, extending from extension point 125*ae*, and a substantially horizontal borehole 110*be*, 110*ce*, 110*de* and 110*ee*, respectively, extending from extension point 125*be*. Resource extraction configuration 402*e* can accommodate solvent flows downward from surface region s5 through borehole extensions 105*be*, 105*ce*, 105*de* and 105*ee* to distal nodal spaces 120*e*, 310*e*, 450*e* and 460*e* through borehole extensions 110*be*, 110*ce*, 110*de* and 110*ee* and then upwards to surface region s5. It is noted that a first imaginary straight line l1*e* can be drawn from first distal nodal space 120*e* approximately through extension points extension points 125*ae* and 125*be* to second distal nodal space 310*e*, and a second imaginary straight line l2*e* can be drawn from third distal nodal space 450*e* approximately through extension points extension points 125*ae* and 125*be* to fourth distal nodal space 460*e*.

Resource extraction sub-configuration 402*f* comprises four distal nodal spaces 120*f*, 310*f*, 450*f* and 460*f*, each representing a contact point between a substantially horizontal borehole 105*bf*, 105*cf*, 105*df* and 105*ef*, respectively, extending from extension point 125*af*, and a substantially horizontal borehole 110*bf*, 110*cf*, 110*df* and 110*ef*, respectively, extending from extension point 125*bf*. Resource extraction configuration 402*f* can accommodate solvent flows downward from surface region s6 through both borehole extensions 105*bf*, 105*cf*, 105*df* and 105*ef* to distal nodal spaces 120*f*, 310*f*, 450*f* and 460*f* through borehole extensions to 110*bf*, 110*cf*, 110*df* and 110*ef* and then upwards to surface region s6. It is noted that a first imaginary straight line l1*a* can be drawn from first distal nodal space 120*f* approximately through extension points extension points 125*af* and 125*bf* to second distal nodal space 310*f*, and a second imaginary straight line l2*f* can be drawn from third distal nodal space 450*f* approximately through extension points extension points 125*af* and 125*bf* to fourth distal nodal space 460*f*.

Resource extraction sub-configuration 402*g* comprises four distal nodal spaces 120*g*, 310*g*, 450*g* and 460*g*, each representing a contact point between a substantially horizontal borehole 105*bg*, 105*cg*, 105*dg* and 105*eg*, respectively, extending from extension point 125*ag*, and a substantially horizontal boreholes 110*bg*, 110*cg*, 110*dg* and 110*eg*, respectively, extending from extension point 125*bg*. Resource extraction configuration 402*g* can accommodate solvent flows downward from surface region s7 through borehole extensions 105*bg*, 105*cg*, 105*dg* and 105*eg* to distal nodal spaces 120*g*, 310*g*, 450*g* and 460*g* through borehole extensions 110*bg*, 110*cg*, 110*dg* and 110*eg* and then upwards to surface region s7. It is noted that a first imaginary straight line I1*g* can be drawn from first distal nodal space 120*g* approximately through extension points extension points 125*ag* and 125*bg* to second distal nodal space 310*g*, and a second imaginary straight line l2*g* can be drawn from third distal nodal space 450*g* approximately through extension points extension points 125*ag* and 125*bg* to fourth distal nodal space 460*g*.

Resource extraction sub-configuration 402*h* comprises four distal nodal spaces 120*h*, 310*h*, 450*h* and 460*h*, each representing a contact point between a substantially horizontal borehole, 105*bh*, 105*ch*, 105*dh* and 105*eh*, respectively, extending from extension point 125*ah*, and a substantially horizontal borehole 110*bh*, 110*ch*, 110*dh* and 110*eh*, respectively, extending from extension point 125*bh*. Resource extraction configuration 402*h* can accommodate solvent flows downward from surface region s8 through borehole extensions 105*bh*, 105*ch*, 105*dh* and 105*eh* to distal nodal spaces 120*h*, 310*h*, 450*h* and 460*h* through borehole extensions 110*bh*, 110*ch*, 110*dh* and 110*eh* and then upwards to surface region s8. It is noted that a first imaginary straight line l1*h* can be drawn from first distal nodal space 120*h* approximately through extension points extension points 125*ah* and 125*bh* to second distal nodal space 310*h*, and a second imaginary straight line l2*h* can be drawn from third distal nodal space 450*h* approximately through extension points extension points 125*ah* and 125*bh* to fourth distal nodal space 460*h*.

Resource extraction sub-configuration 402*i* comprises four distal nodal space 120*i*, 310*i*, 450*i* and 460*i*, each representing a contact point between a substantially horizontal borehole, 105*bi*, 105*ci*, 105*di* and 105*ei*, respectively, extending from extension point 125*ai*, and a substantially horizontal borehole 110*bi*, 110*ci*, 110*di* and 110*ei*, respectively, extending from extension point 125*bi*. Resource extraction configuration 402*i* can accommodate solvent flows downward from surface region s9 through borehole extensions 105*bi*, 105*ci*, 105*di* and 105*ei* to distal nodal spaces 120*i*, 310*i*, 450*i* and 460*i* through borehole extensions 110*bi*, 110*ci*, 110*di* and 110*ei* and then upwards to surface region s9. It is noted that a first imaginary straight line I1*i* can be drawn from first distal nodal space 120*i* approximately through extension points extension points 125*ai* and 125*bi* to second distal nodal space 310*i*, and a second imaginary straight line l2*i* can be drawn from third distal nodal space 450*i* approximately through extension points extension points 125*ai* and 125*bi* to fourth distal nodal space 460*i*.

Figure 5B:
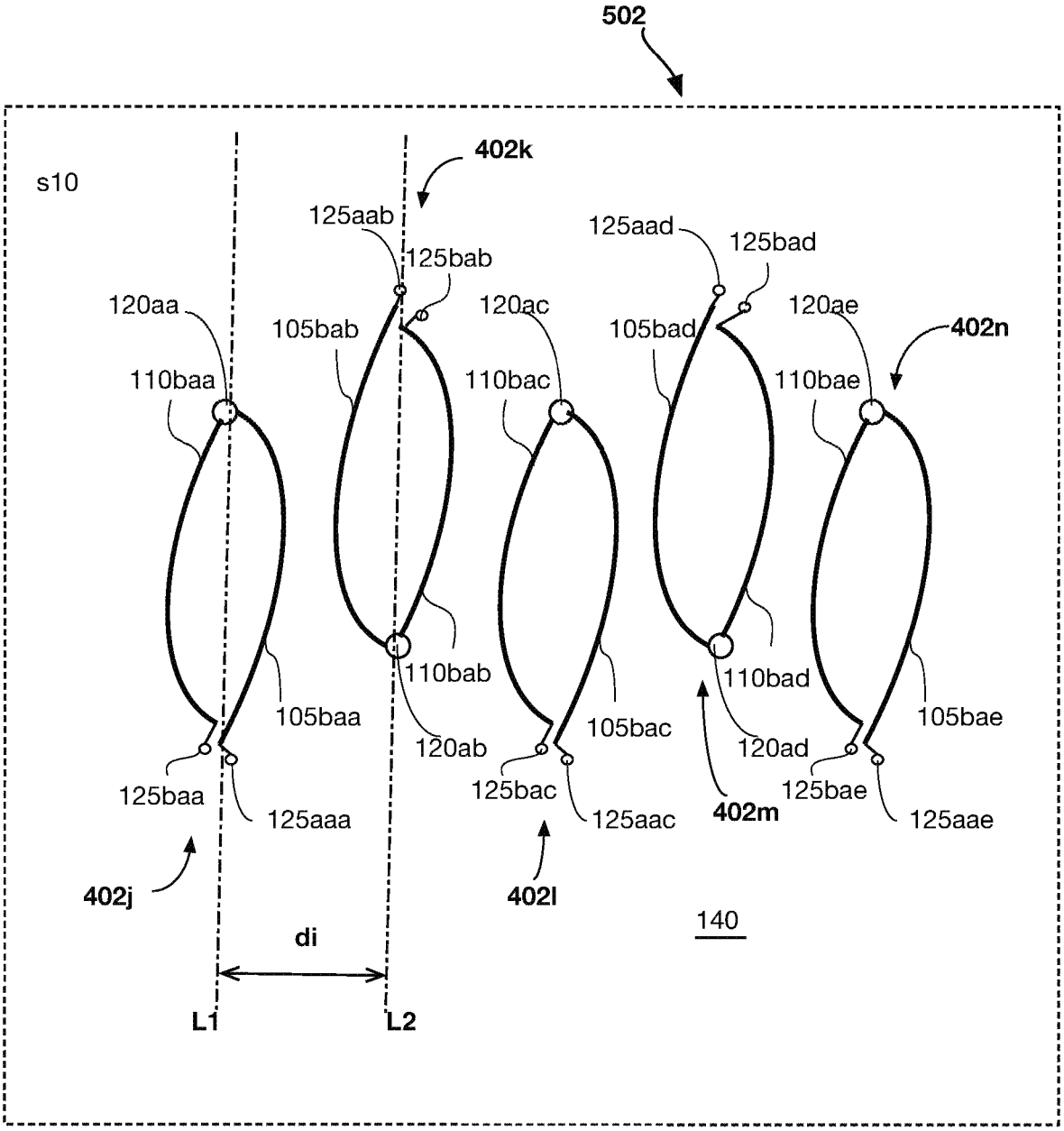
FIG. 5B is a schematic horizontal cross-sectional view of another resource extraction configuration according to another example embodiment of the present disclosure.

Referring now to FIG. 5B, shown therein is resource extraction configuration 502 comprising an array of five of resource extraction sub-configurations 402*j*, 402*k*, 402*l*, 402*m*, and 402*n*, configured below surface region s10. As hereinbefore noted in some embodiments, surface region s10 can be a section of land. Resource extraction sub-configurations 402*j*, 402*k*, 402*l*, 402*m*, and 402*n*, each comprise one distal nodal space 120*aa*, 120*ab*, 120*ac*, 120*ad* and 120*ae*, respectively, each representing a contact point between a substantially horizontal borehole, 105*baa*, 105*bab*, 105*bac*, 105*bad* and 105*bae*, respectively, extending from extension points 125*aaa*, 125*aab*, 125*aac*, 125*aad*, and 125*aae*, and a substantially horizontal borehole 110*baa*, 110*bab*, 110*bac*, 110*bad* and 110*bae*, respectively, extending from extension points 125*baa*, 125*bab*, 125*bac*, 125*bad*, and 125*bae*. Resource extraction sub-configurations 402*j*, 402*k*, 402*l*, 402*m*, and 402*n* can each individually accommodate solvent flows downward from surface region s10 through borehole extensions 105*baa*, 105*bab*, 105*bac*, 105*bad* and 105*bae*, respectively, to distal nodal spaces 120*aa*, 120*ab*, 120*ac*, 120*ad* and 120*ae*, respectively, and back through boreholes 110*baa*, 110*bab*, 110*bac*, 110*bad* and 110*bae*, respectively, and via extension points 125*baa*, 125*bab*, 125*bac*, 125*bad*, and 125*bae* up to surface region s10. It is noted that the flow paths formed by borehole extensions 105*baa*, 105*bab*, 105*bac*, 105*bad* and 105*bae* and 110*baa*, 110*bab*, 110*bac*, 110*bad* and 110*bae*, respectively, are configured to run in a substantial parallel direction, e.g. the flow path formed by borehole extensions 105*ba* and 110*baa* runs substantially parallel to the flow path formed by borehole extensions 105*bab* and 110*bab*, while the depth from surface region s10 to nodal spaces 120*aa*, 120*ab*, 120*ac*, 120*ad*, and 120*ae* (not indicated), as well as the depth from surface region s10 to nodal spaces 125*aaa*, 125*aab*, 125*aac*, 125*aad*, and 125*aae* (not indicated) are approximately the same. It is noted that if resource extraction sub-configurations 402*j*, 402*k*, 402*l*, 402*m*, and 402*n* are operated such that the carrier fluid enters via extension points 125*aaa*, 125*aab*, 125*aac*, 125*aad*, and 125*aae*, and exits via 125*baa*, 125*bab*, 125*bac*, 125*bad*, and 125*bae* so that carrier fluid flow through resource extraction sub-configurations 402*j*, 402*l*, and 402*n* proceeds in one set of directions (e.g. for 402*j* towards one end T through 105*baa*, and towards another end B through 110*baa*), while carrier fluid flow through resource extraction sub-configurations 402*k*, and 402*m* proceeds in the opposite set of directions (e.g. for 402*k* towards the end B through 105*baa*, and towards the end T of FIG. 5B through 110*baa*) However, as hereinbefore noted, exit and entry paths may be reversed for each extraction sub-configuration, as desired. It is also noted that resource extraction sub-configurations 402*j*, 402*k*, 402*l*, 402*m*, and 402*n* can be, but do not necessarily need to be, situated at the same depth relative to surface region s10, and thus some or all of resource extraction sub-configurations 402*j*, 402*k*, 402*l*, 402*m*, and 402*n* can be situated at the same or at different depths relative to surface region s10. Furthermore, each of resource sub-configurations 402*j*, 402*k*, 402*l*, 402*m*, and 402*n* is spaced apart from an adjacent neighbouring resource sub-configuration by a given distance di. In this respect the distance di between imaginary lines L1 and L2 is for example is about 200 m or less, or 1 km or less.

Figure 5C:
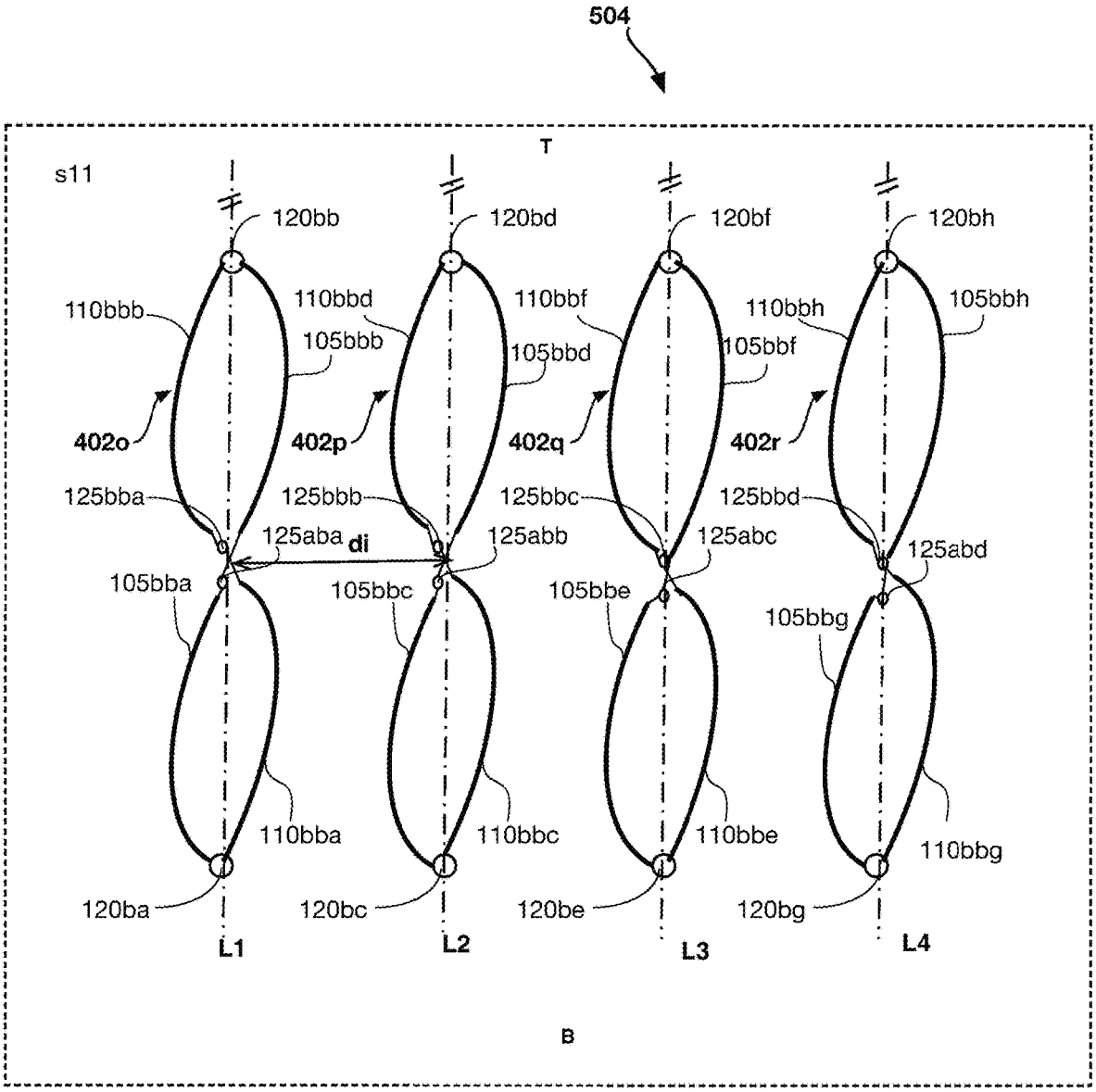
FIG. 5C is a schematic horizontal cross-sectional view of another resource extraction configuration according to another example embodiment of the present disclosure.

Referring now to FIG. 5C, shown therein is resource extraction configuration 504 comprising an array of four of resource extraction sub-configurations 402*o*, 402*p*, 402*q*, and 402*r*, configured below surface region s11. As hereinbefore noted in some embodiments, surface region s11, can be a section of land. Resource extraction sub-configurations 402*o*, 402*p*, 402*q*, and 402*r*, each comprise a pair of distal nodal spaces (120*ba*, 120*bb*), (120*bc*, 120*bd*), (120*be*, 120*bf*), and (120*bg*, 120*bh*), respectively, and resource extraction sub-configurations 402*o*, 402*p*, 402*q*, and 402*r* are extending substantially parallel to each other between the pairs of distal nodal spaces (120*ba*, 120*bb*), (120*bc*, 120*bd*), (120*be*, 120*bf*), and (120*bg*, 120*bh*). The depth relative to surface region s11 of each resource extraction sub-configurations 402*o*, 402*p*, 402*q*, and 402*r* may vary. In one embodiment, each of resource extraction sub-configurations 402*o*, 402*p*, 402*q*, and 402*r* is situated at approximately equal depth relative to surface region s11. Each pair of distal nodal spaces represents a contact point between two substantially horizontal boreholes, extending from centrally located extension points. Thus, the distal nodal spaces of distal nodal space pair (120*ba*, 120*bb*) represent contact points between substantially horizontal boreholes 105*bba* and 110*bba*, and between 105*bbb* and 110*bbb*, respectively. Similarly, the distal nodal spaces of distal nodal space pair (120*bc*, 120*bd*) represent contact points between substantially horizontal boreholes 105*bbc* and 110*bbc*, and between 105*bbd* and 110*bbd*, respectively. Similarly, the distal nodal spaces of distal nodal space pair (120*be*, 120*bf*) represent contact points between substantially horizontal boreholes 105*bbe* and 110*bbe*, and between 105*bbf* and 110*bbf*, respectively; and, finally, the boreholes of distal nodal space pair (120*bg*, 120*bh*) represent contact points between substantially horizontal boreholes 105*bbg* and 110*bbg*, and between 105*bbh* and 110*bbh*, respectively. In resource extraction sub-configuration 402*o*, substantially horizontal boreholes 105*bba* and 105*bbb* extend from extension point 125*aba*, while horizontal boreholes 110*bba* and 110*bbb* extend from extension point 125*bba*. Similarly, in resource extraction sub-configuration 402*p*, substantially horizontal boreholes 105*bbc* and 105*bbd* extend from extension point 125*abb*, while horizontal boreholes 110*bbc* and 110*bbd* extend from extension point 125*bbb*. Similarly, in resource extraction sub-configuration 402*q*, substantially horizontal boreholes 105*bbe* and 105*bbf* extend from extension point 125*abc*, while horizontal boreholes 110*bbe* and 110*bbf* extend from extension point 125*bbc*. And finally, similarly, in resource extraction sub-configuration 402*r*, substantially horizontal boreholes 105*bbg* and 105*bbh* extend from extension point 125*abd*, while horizontal boreholes 110*bbg* and 110*bbh* extend from extension point 125*bbd*. Imaginary parallel straight lines L1, L2, L3 and L4 can be run from each distal nodal space in distal nodal space pairs (120*ba*, 120*bb*), (120*bc*, 120*bd*), (120*be*, 120*bf*), and (120*bg*, 120*bh*) to the other node, approximately through extension points (125*aba*, 125*bba*), (125*abb*, 125*bbb*), (125*abc*, 125*bbc*) and (125*abd*, 125*bbd*), respectively.

Resource extraction configurations 402*o*, 402*p*, 402*q*, and 402*r* can each individually accommodate solvent flows downward from surface region s11 and then through both borehole extensions (105*bba*, 105*bbb*), (105*bbc*, 105*bbd*), (105*bbe*, 105*bbf*) and, (105*bbg*, 105*bbh*) respectively to distal nodal spaces (120*ba*, 120*bb*), (120*bc*, 120*bd*), (120*be*, 120*bf*) and (120*bg*, 120*bh*), respectively, and back through boreholes (110*bba*, 110*bbb*), (110*bbc*, 110*bbd*), (110*bbe*, 110*bbf*) and, (110*bbg*, 110*bbh*), respectively, to extension points (125*aba*, 125*bba*), (125*abb*, 125*bbb*), (125*abc*, 125*bbc*) and (125*abd*, 125*bbd*) and then upwards to surface region s11. Each of resource extraction sub-configurations 402*o*, 402*p*, 402*q*, and 402*r* is spaced apart by a distance di to an adjacent neighbouring sub-configuration. In this respect the distance di between imaginary line L1 and L2 is for example about 200 m or less, or 1 km or less.

Figure 5D:
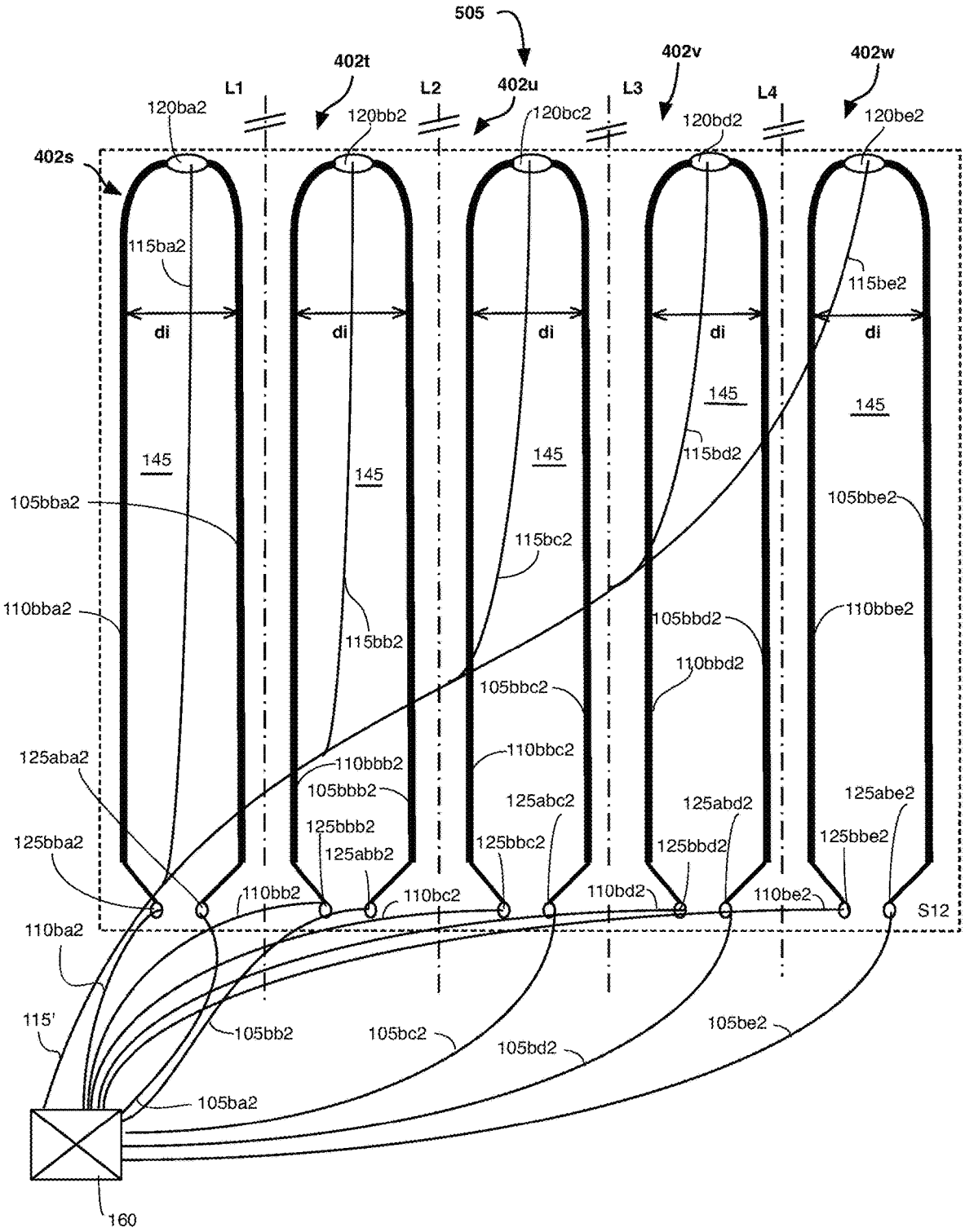
FIG. 5D is a schematic horizontal cross-sectional view of another resource extraction configuration according to another example embodiment of the present disclosure.

Referring now to FIG. 5D, shown therein is resource extraction configuration 505 comprising an array of five of resource extraction sub-configurations 402*s*, 402*t*, 402*u*, 402*v* and 402*w*, configured below approximately square surface region s12. As hereinbefore noted in some embodiments, surface region s12 can be a section of land. Resource extraction sub-configurations 402*s*, 402*t*, 402*u*, 402*v* and 402*w* each comprise a distal nodal space 120*ba*2, 120*bb*2, 120*bc*2, 120*bd*2, and 120*be*2, respectively, and resource extraction sub-configurations 402*s*, 402*t*, 402*u*, 402*v* and 402*w* are extending substantially parallel relative to each other. The depth relative to surface region s12 of each resource extraction sub-configuration 402*s*, 402*t*, 402*u*, 402*v* and 402*w* may vary. In one embodiment, each of resource extraction sub-configurations 402*s*, 402*t*, 402*u*, 402*v* and 402*w* is situated at approximately equal depth relative to surface region s12 while in other embodiments at least two of the resource extraction sub-configurations 402*s*, 402*t*, 402*u*, 402*v* and 402*w* may be at different depths. Each distal nodal space represents a contact point between two substantially horizontal boreholes, extending from centrally located extension points. Thus, distal nodal space 120*ba*2 represents a contact point between substantially horizontal boreholes 105*bba*2 and 110*bba*2. Similarly, borehole 120*bb*2, represents a contact point between substantially horizontal boreholes 105*bbb*2 and 110*bbb*2. Similarly, distal nodal space 120*bc*2, represents a contact point between substantially horizontal boreholes 105*bbc*2 and 110*bbc*2. Similarly, distal nodal space 120*bd*2 represents a contact point between substantially horizontal borehole 105*bbd*2 and 110*bbd*2. Finally, distal nodal space 120*be*2 represents a contact point between substantially horizontal boreholes 105*bbe*2 and 110*bbe*2. In resource extraction sub-configuration 402*s*, substantially horizontal borehole 105*bba*2 extends from extension point 125*aba*2, while substantially horizontal borehole 110*bba*2 extends from extension point 125*bba*2. Similarly, in resource extraction sub-configuration 402*t*, substantially horizontal borehole 105*bbb*2 extends from extension point 125*abb*2, while horizontal borehole 110*bbb*2 extends from extension point 125*bbb*2. Similarly, in resource extraction sub-configuration 402*u*, substantially horizontal borehole 105*bbc*2 extends from extension point 125*abc*2, while horizontal borehole 110*bbc*2 extends from extension point 125*bbc*2. Similarly, in resource extraction sub-configuration 402*v*, substantially horizontal borehole 105*bbd*2 extends from extension point 125*abd*2, while horizontal borehole 110*bbd*2 extends from extension point 125*bbd*2. And finally, similarly, in resource extraction sub-configuration 402*w*, substantially horizontal boreholes 105*bbe*2 extends from extension point 125*abe*2, while horizontal borehole 110*bbe*2 extends from extension point 125*bbe*2. Boreholes 115*ba*2, 115*bb*2, 115*bc*2, 115*bd*2 and 115*be*2 extend from surface region s to connect with distal nodal spaces 120*ba*2, 120*bb*2, 120*bc*2, 120*bd*2 and 120*be*2, respectively. Imaginary parallel straight lines L1, L2, L3, L4 separate approximately square surface region s12 into five approximately equally size rectangles, each accommodating one of the approximately equally sized resource extraction sub-configurations 402*s*, 402*t*, 402*u*, 402*v* and 402*w*.

Resource extraction sub-configurations 402*s*, 402*t*, 402*u*, 402*v* and 402*w* can each individually accommodate solvent flows downward from surface region s12 via extension points 125*aba*2, 125*abb*2, 125*abc*2, 125*abd*2, and 125*abe*2, through borehole extensions 105*bba*2, 105*bbb*2, 105*bbc*2, 105*bbd*2, and 105*bbe*2, respectively, to distal nodal spaces 120*ba*2, 120*bb*2, 120*bc*2, 120*bd*2, and 120*be*2, respectively, and back through boreholes 110*bba*2, 110*bbb*2, 110*bbc*2, 110*bbd*2, and 110*bbe*2, respectively, to extension points 125*bba*2, 125*bbb*2, 125*bbc*2, 125*bbd*2, and 125*bbe*2 back up to surface region s12. Each of resource extraction sub-configurations 402*s*, 402*t*, 402*u*, 402*v* and 402*w* is spaced apart from adjacent neighbouring resource extraction sub-configurations. Furthermore, it is noted that resource extraction sub-configurations 402*s*, 402*t*, 402*u*, 402*v*, and 402*w* can be, but do not necessarily need to be, situated at the same depth relative to surface region s12, and thus some or all of resource extraction sub-configurations 402*s*, 402*t*, 402*u*, 402*v*, and 402*w* can be situated at the same or at different depths relative to surface region s12.

Further also shown in FIG. 5D is a single well pad 160 situated adjacent relative to resource extraction sub-configurations 402*s*, 402*t*, 402*u*, 402*v* and 402*w*. Single well pad 160 is used to establish borehole extensions 105*ba*2, 105*bb*2, 105*bc*2, 105*bd*2 and 105*be*2 extending from surface region s12 towards 125*aba*2, 125*abb*2, 125*abc*2, 125*abd*2, and 125*abe*2. Single well pad 160 is also used to establish borehole extensions 110*ba*2, 110*bb*2, 110*bc*2, 110*bd*2 and 110*be*2 extending from surface region s12 towards 125*bba*2, 125*bbb*2, 125*bbc*2, 125*bbd*2, and 125*bbe*2, respectively. Well pad 160 is also used to establish borehole extensions 115*ba*2, 115*bb*2, 115*bc*2, 115*bd*2 and 115*be*2 from surface region s12 to distal nodal spaces 120*ba*2, 120*bb*2, 120*bc*2, 120*bd*2 and 120*be*2.

It is noted that in order to establish boreholes 115*ba*2, 115*bb*2, 115*bc*2, 115*bd*2 and 115*be*2, an initial proximal section 115*c* is shared between all of boreholes 115*ba*2, 115*bb*2, 115*bc*2, 115*bd*2 and 115*be*2, and thus these boreholes share a single common borehole opening at well pad 160. By contrast, boreholes 105*ba*2, 105*bb*2, 105*bc*2, 105*bd*2 and 105*be*2, as well as boreholes 110*ba*2, 110*bb*2, 110*bc*2, 110*bd*2 and 110*be*2 are configured to each have a separate borehole opening at well pad 160. In other embodiments, resource extraction configurations may be constructed which are similar to resource extraction configuration 505, provided, however that different arrangements regarding shared borehole openings may be provided for, as can be readily further understood by referencing, comparatively, the resource extraction configurations shown in FIGS. 2A-2B and FIGS. 2E-2F.

The inventors have determined that implementing resource extraction configuration 505 shown in FIG. 5D on a section of land (e.g. 1 square mile), will allow the development of five substantially horizontal borehole sections, each about 1,300 meters in length (i.e. not including the cased sections). In this case, the substantially horizontal borehole sections can each attain a width of about 100 m, while the distance di of separating portion 145 between the outer walls of the horizontal borehole extensions (e.g. between 105*bba*2 and 110*bba*2) can be about 60 m. It is estimated that in embodiments where potash is mined up to approximately 52% of the total available potash within the section at the depth resource extraction configuration 505 is implemented may be extracted. For a similar design relying instead on four substantially horizontal borehole sections (not shown) with a borehole width 100 m and a distance di of 100 m, the inventors have determined that up to 42% of the total available potash may be mined. For a similar design relying instead on six substantially horizontal borehole sections (not shown) with a borehole width 100 m and a distance di of 33 m, the inventors have determined that up to 62% of the total available potash may be mined. And, finally, for a similar design relying instead on eight substantially horizontal borehole sections (not shown) with a borehole width 80 m and a distance di of 20 m, the inventors have determined that up to 66% of the total available potash may be mined. Further designs including more borehole extensions may be constructed to further increase the total percentage of available potash that may be mined. Thus, in general, by constructing a sufficient quantity of boreholes and allowing for a sufficient amount of time to circulate carrier fluid F, in accordance with the processes of the present disclosure, all or substantially all of the total available potash may be mined, i.e. 95% or more, 96% or more, 97% or more, 98% or more, or 99% or more.

Figure 5E:
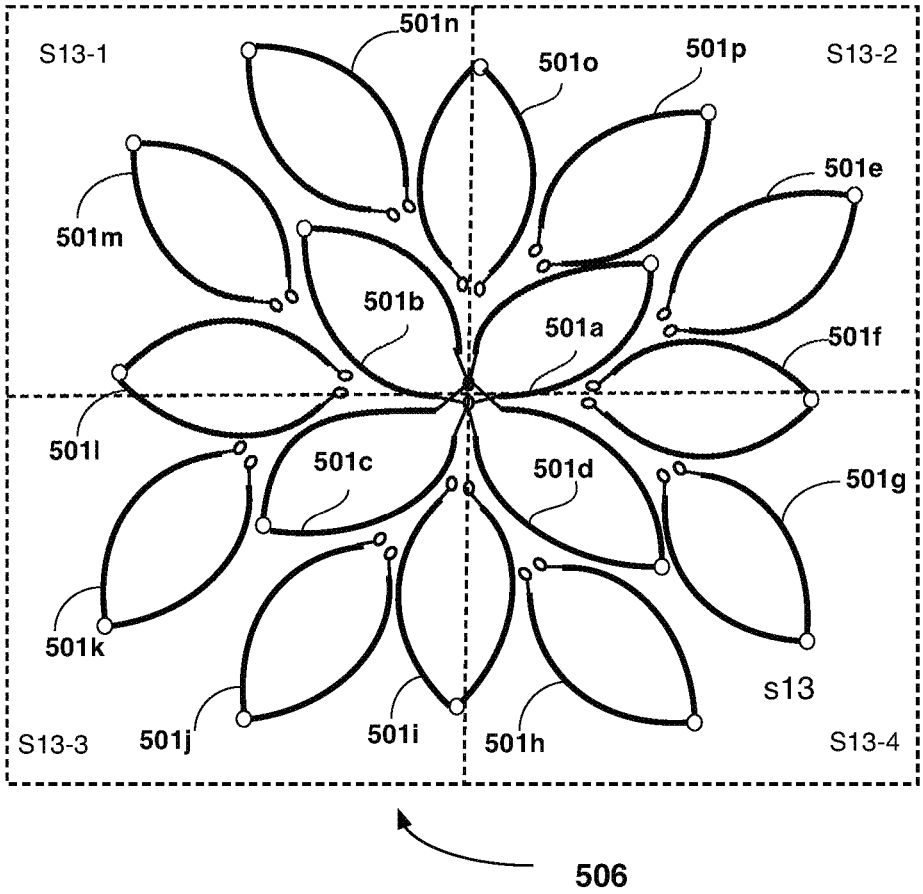
FIG. 5E is a schematic horizontal cross-sectional view of another resource extraction configuration according to another example embodiment of the present disclosure.

Referring now to FIG. 5E, shown therein is resource extraction configuration 506, comprising an array of sixteen resource extraction sub-configurations 501*a*, 501*b*, 501*c*, 501*d*, 501*e*, 501*f*, 501*g*, 501*h*, 501*i*, 501*j*, 501*k*, 501*l*, 501*m*, 501*n*, 501*o*, and 501*p* configured on surface region s13. Centrally located resource extraction sub-configurations 501*a*, 501*b*, 501*c*, 501*d* together from a central configuration similar to the configuration shown in FIG. 4B. Remaining resource extraction sub-configurations 501*e*, 501*f*, 501*g*, 501*h*, 501*i*, 501*j*, 501*k*, 501*l*, 501*m*, 501*n*, 501*o*, and 501*p* are located radially outwardly relative to the central sub-configuration formed by resource extraction sub-configurations 501*a*, 501*b*, 501*c*, 501*d*, substantially encircle resource extraction sub-configurations 501*a*, 501*b*, 501*c*, 501*d* in an intercalating fashion, and generally occupy subterranean space to the exterior of each of the horizontal extensions of resource extraction sub-configurations 501*a*, 501*b*, 501*c*, 501*d*. It is noted that each of the resource extraction sub-configurations 501*e*, 501*f*, 501*g*, 501*h*, 501*i*, 501*j*, 501*k*, 501*l*, 501*m*, 501*n*, 501*o*, and 501*p* may be constructed and operated independently. Furthermore, each of the resource extraction sub-configurations 501*e*, 501*f*, 501*g*, 501*h*, 501*i*, 501*j*, 501*k*, 501*l*, 501*m*, 501*n*, 501*o*, and 501*p* may be constructed and operated independently from resource extraction sub-configurations 501*a*, 501*b*, 501*c*, 501*d*. It is noted that resource extraction configuration 506 is implemented on four sections of land S13-*a*, S13-*b*, S13-*c* and S13-*d*. As previously noted, each of the resource extraction sub-configurations 501*e*, 501*f*, 501*g*, 501*h*, 501*i*, 501*j*, 501*k*, 501*l*, 501*m*, 501*n*, 5010 and 501*p* can be constructed and/or operated simultaneously, but they can also be constructed and/or operated sequentially in various orders, as desired, and it may take multiple years before the entire resource extraction configuration 506 is achieved. Furthermore, it is noted that extraction sub-configurations 501*e*, 501*f*, 501*g*, 501*h*, 501*i*, 501*j*, 501*k*, 501*l*, 501*m*, 501*n*, 5010 and 501*p* can be, but do not necessarily need to be, situated at the same depth relative to surface regions s13-1, s13-2, s13-3 and s13-4, and thus some or all of extraction sub-configurations 501*e*, 501*f*, 501*g*, 501*h*, 501*i*, 501*j*, 501*k*, 501*l*, 501*m*, 501*n*, 5010 and 501*p* can be situated at the same or at different depths relative to surface regions s13-1, s13-2, s13-3 and s13-4.

Referring now to FIGS. 6A-6D, further resource extraction configurations 601, 602, 603 and 604 according to the present disclosure are shown. As hereinbefore noted solvent is injected from the surface region through a first borehole and collected via an adjacent second borehole. The configurations of the present disclosure permit solvent injection and brine collection at surface regions that are within close proximity of one another. Thus liquid injection and collection equipment may be included in a single housing. This may be advantageous for various of reasons. Thus, for, example, the supply of electric and other power can be provided by a single location. Furthermore, the operational footprint at the surface region is limited and the terrain surrounding the surface operations can be used for other purposes, e.g. farming. Furthermore, no vehicle transport of solvent or brine is required.

Figure 6A:
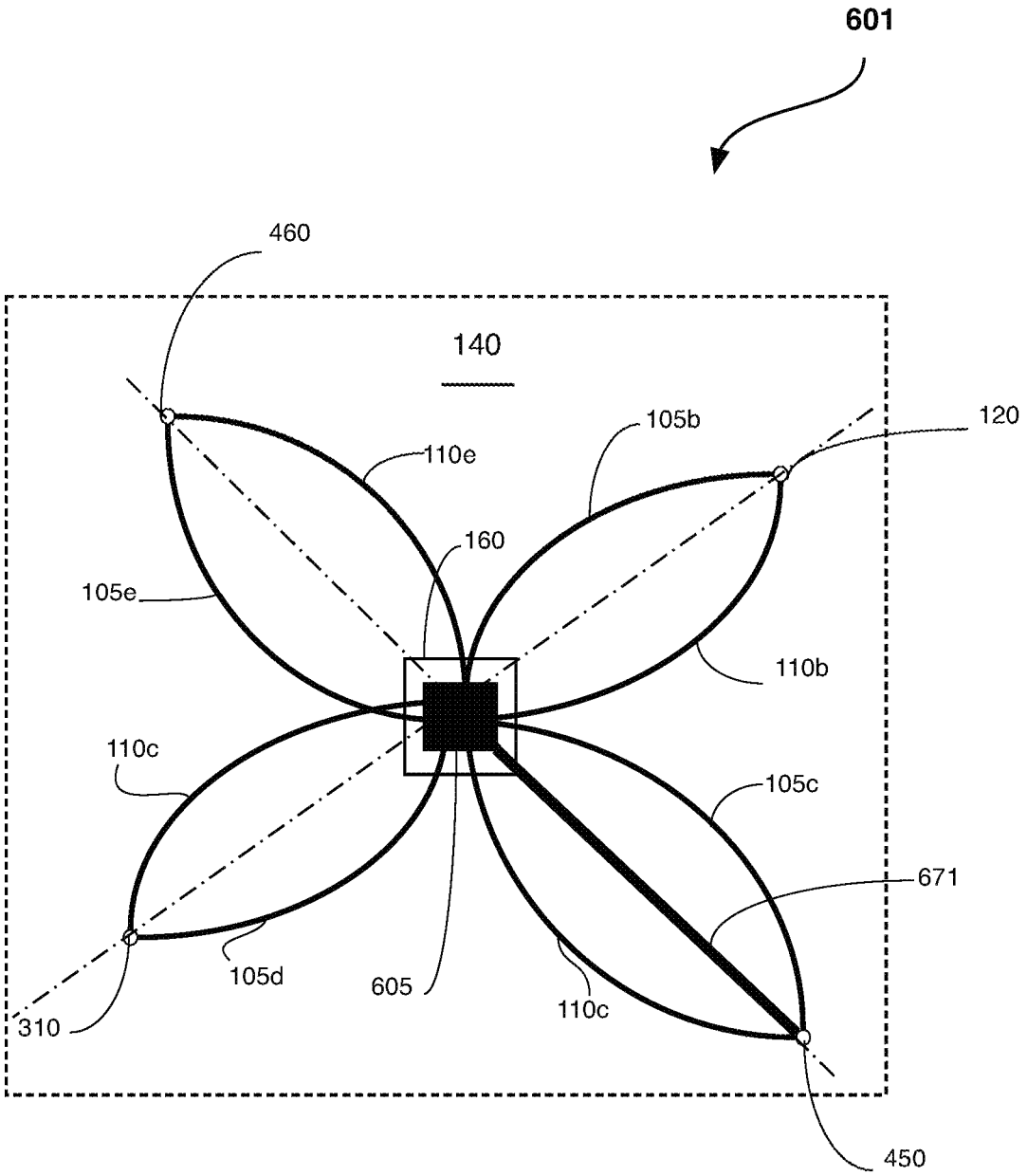
FIG. 6A is a schematic overhead view of a resource extraction configuration according to another example embodiment of the present disclosure.

Referring now to FIG. 6A, shown therein is resource extraction configuration 601, comprising horizontal borehole extensions 105*b*, 105*c*, 105*d* and 105*e* connecting via distal nodal spaces 120, 450, 310 and 460, respectively, to borehole extensions 110*b*, 110*c*, 110*d* and 110*e*. Solvent can be injected at the surface region 140 from a centrally located fluid control housing 605, and brine can be received within fluid control housing 605 situated on well pad 160. Resource extraction configuration 601 further includes conduit 671 which allows for brine transported across the surface region 140 via for injection of brine into nodal space 450, or receipt of brine migrating upward from nodal space 450.

Figure 6B:
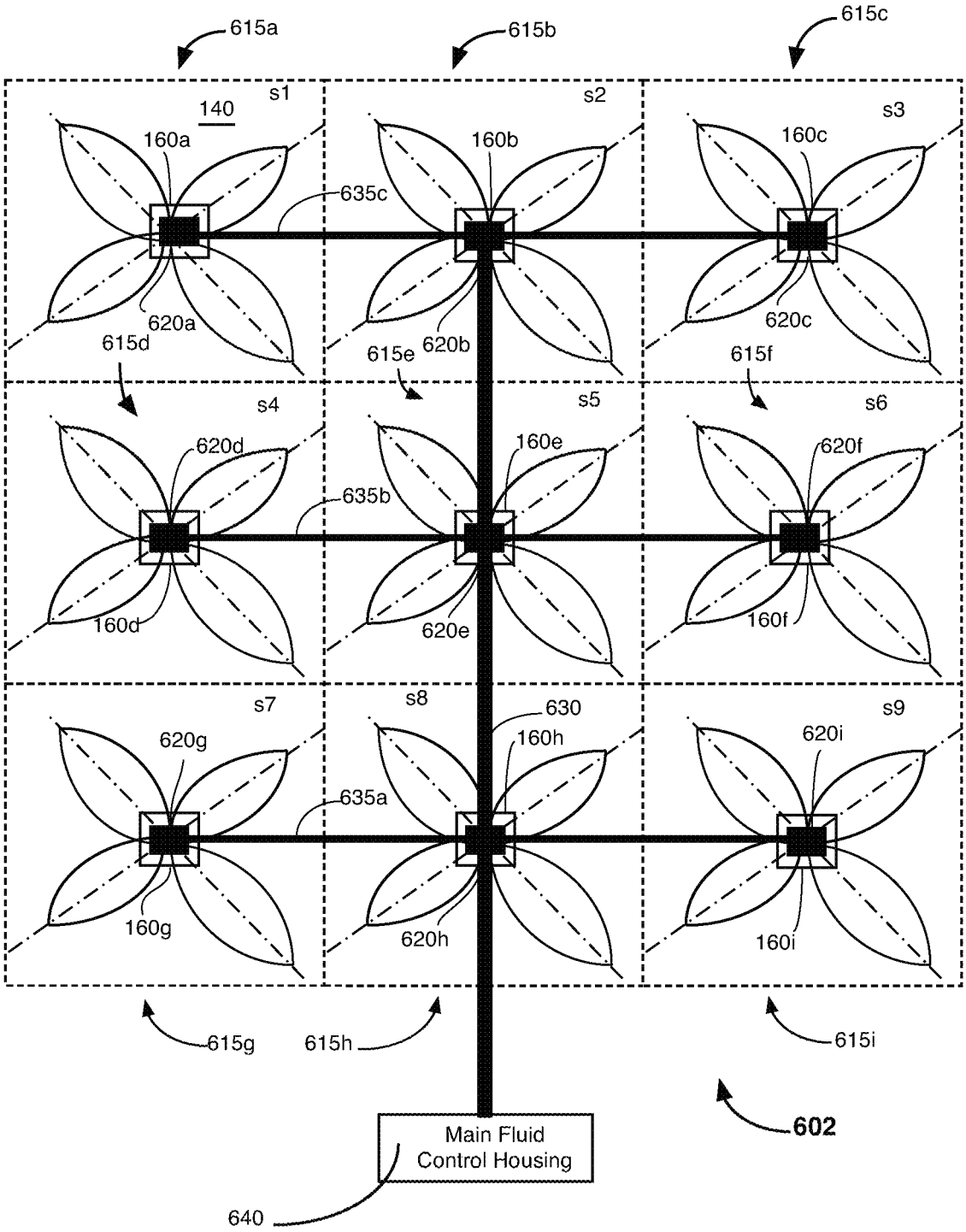
FIG. 6B is a schematic overhead view of a resource extraction configuration according to another example embodiment of the present disclosure.

Referring now to FIG. 6B, shown therein is resource extraction configuration 602 comprising an array of nine of resource extraction sub-configurations 615*a*, 615*b*, 615*c*, 615*d*, 615*e*, 615*f*, 615*g*, 615*h* and 615*i* configured on surface regions s1, s2, s3, s4, s5, s6, s7, s8 and s9, respectively. Main fluid control housing 640 is located laterally to surface regions s1, s2, s3, s4, s5, s6, s7, s8 and s9. Main fluid conduit 630 is connected to fluid control housing 640 and traverses surface regions s8, s5 and s2 to reach well pads 160*h*, 160*e* and 160*b*, respectively. From main fluid conduit 630, fluid can flow through lateral fluid conduits 635*a*, 635*b* and 635*c*, connected to main fluid conduit 630, to reach well pads 160*g* and 160*i*, 160*d* and 160*f*, and 160*a* and 160*c*, respectively. Well pads 160*a*, 160*b*, 160*c*, 160*d*, 160*e*, 160*f*, 160*g*, 160*h* and 160*i* contain sub fluid control housings 620*a*, 620*b*, 620*c*, 620*d*, 620*e*, 620*f*, 620*g*, 620*h* and 620*i*, which can be used to control fluid flow through each of resource extraction sub-configurations 615*a*, 615*b*, 615*c*, 615*d*, 615*e*, 615*f*, 615*g*, 615*h* and 615*i*. In different embodiments the fluid conduits may be constructed above or below surface regions s1, s2, s3, s4, s5, s6, s7, s8 and s9. Thus, main fluid control housing 640 can accommodate fluid injection and discharge for resource extraction configuration 602.

Figure 6C:
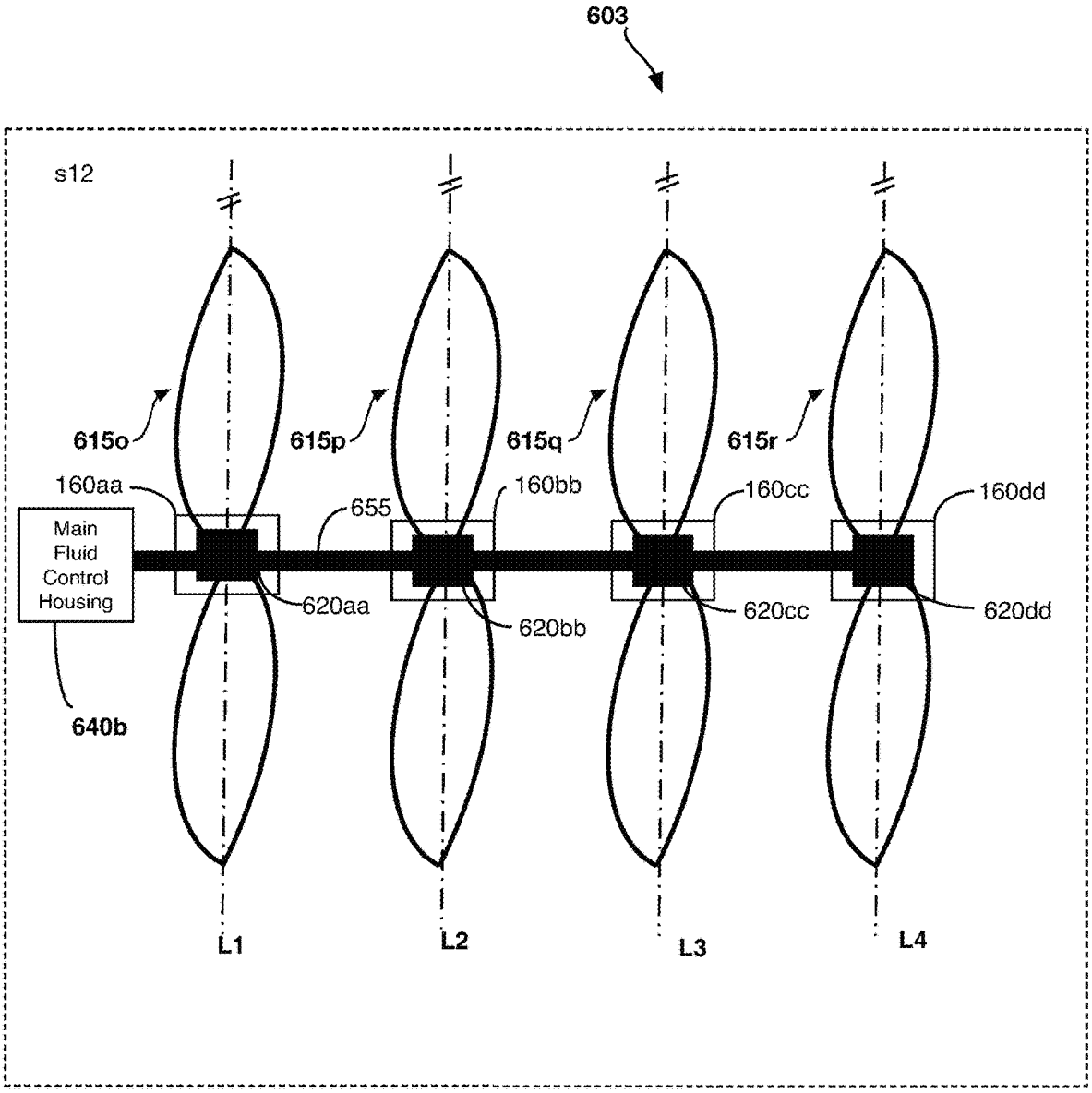
FIG. 6C is a schematic overhead view of a resource extraction configuration according to another example embodiment of the present disclosure.

Referring now to FIG. 6C, shown therein is resource extraction configuration 603, comprising an array of four of resource extraction sub-configurations 615*o*, 615*p*, 615*q* and 615*r* configured on surface region s12. Main fluid control housing 640*b* is located on surface region s12, lateral to resource extraction sub-configuration 615*o*. Main fluid conduit 655 is connected to main fluid control housing 640*b* and traverses surface region s12 to reach well pads 160*aa*, 160*bb*, 160*cc* and 160*dd* containing sub fluid control housings 620*aa*, 620*bb*, 620*cc* and 620*dd*. Thus, single fluid control housing 640*b* located on surface region s12, adjacent to the resource extraction sub-configurations 615*o*, 615*p*, 615*q* and 615*r*, can accommodate fluid injection and discharge for resource extraction configuration 603. It is noted that sub-configurations 615*o*, 615*p*, 615*q* and 615*r* may be operated sequentially, in any order, as desired, or simultaneously. It is noted that in an alternate embodiment, a single well pad may be used to operate resource extraction sub-configurations 615*o*, 615*p*, 615*q* and 615*r*, as will be understood by referring to FIG. 5D.

Figure 6D:
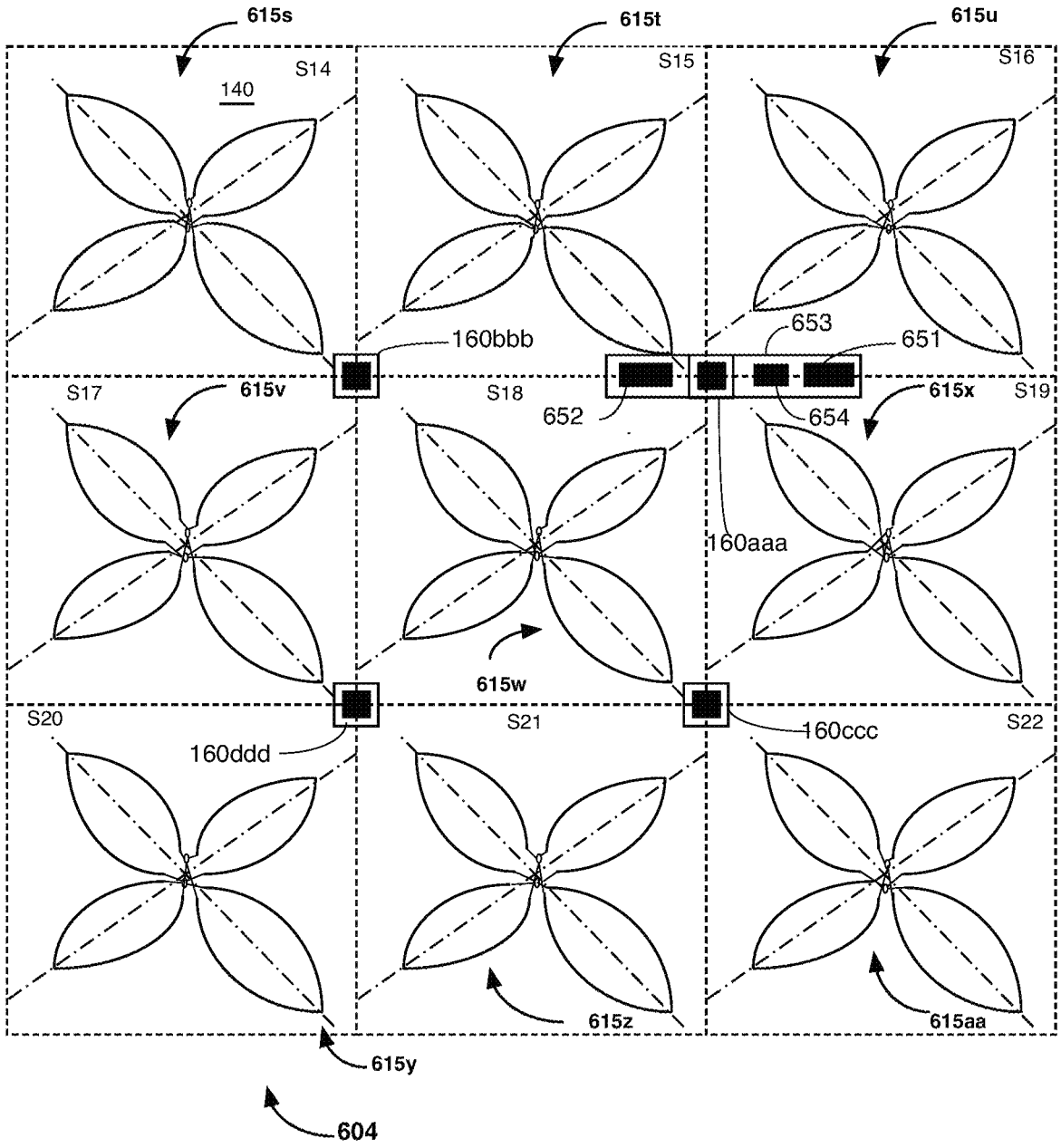
FIG. 6D is a schematic overhead view of a resource extraction configuration according to another example embodiment of the present disclosure.

Referring now to FIG. 6D, shown therein is resource extraction configuration 604 comprising an array of nine of resource extraction sub-configurations 615*s*, 615*t*, 615*u*, 615*v*, 615*w*, 615*x*, 615*y*, 615*z* and 615*aa* configured on surface regions s14, s15, s16, s17, s18, s19, s20, s21 and s22, respectively. Resource extraction configuration 604 comprises four well pads 160*aaa*, 160*bbb*, 160*ccc* and 160*ddd*.

Well pad 160*aaa* serves resource extraction sub-configurations 615*t*, 615*u* and 615*x*. Well pad 160*bbb* serves resource extraction sub-configurations 615*s* and 615*w*. Well pad 160*ccc* serves resource extraction sub-configurations 615*z* and 615*aa*, and well pad 160*ddd* serves resource extraction sub-configurations 615*v* and 615*y*. Surface structure 653 may include, besides well pad 615*aaa*, other built structures, including office and control building 652, vehicle and equipment storage and maintenance building 654, and living quarters 651 for operational personnel.

Referring now to FIG. 6D, shown therein is resource extraction configuration 604 comprising an array of nine of resource extraction sub-configurations 615*s*, 615*t*, 615*u*, 615*v*, 615*w*, 615*x*, 615*y*, 615*z* and 615*aa* configured on surface regions s14, s15, s16, s17, s18, s19, s20, s21 and s22, respectively. Resource extraction configuration 604 comprises four well pads 160*aaa*, 160*bbb*, 160*ccc* and 160*ddd*. Well pad 160*aaa* serves resource extraction sub-configurations 615*t*, 615*u* and 615*x*. Well pad 160*bbb* serves resource extraction sub-configurations 615*s* and 615*w*. Well pad 160*ccc* serves resource extraction sub-configurations 615*z* and 615*aa*, and well pad 160*ddd* serves resource extraction sub-configurations 615*v* and 615*y*. Surface structure 653 may include, besides well pad 160*aaa*, other built structures, including office and control building 652, vehicle and equipment storage and maintenance building 654, and living quarters 651 for operational personnel. As can now be appreciated, the resource extraction configurations and processes of the present disclosure can be used for resource extraction from resource deposits. The configurations of the present disclosure allow for particularly efficient extraction through monitoring and control of the development of boreholes and associated caverns.

Of course, the above described example embodiments of the present disclosure are intended to be illustrative only and in no way limiting. The described embodiments are susceptible to many modifications of composition, details and order of operation. The claimed subject matter, rather, is intended to encompass all such modifications within its scope, as defined by the claims, which should be given a broad interpretation consistent with the description as a whole.

The invention claimed is:

1. A resource extraction configuration for in situ resource extraction from a resource deposit in an underlying subterranean space associated with a surface region, wherein the resource extraction configuration comprises:

at least one borehole configuration, each borehole configuration comprising:

a first borehole string extending downward from the surface region into the resource deposit, the first borehole string comprising first and second sections, the first section extending downward from the surface region and the second section extending laterally in a first lateral direction from the first section into the resource deposit; and a second borehole string extending downward from the surface region into the resource deposit, the second borehole string situated adjacent to the first borehole string and comprising first and second sections, the first section of the second borehole string extending downward from the surface region and the second section of the second borehole string extending laterally in a second lateral direction from a distal portion of the first section of the second borehole string into the resource deposit, where the second sections of the first and second borehole strings have walls made of permeable material to allow contact between fluid in the second sections and the resource deposit to allow for in situ leaching of resource material into the second sections and penannularly extend to form a first planar region, and the second sections distally connect at a nodal space and form a fluid path downward from the surface region through the first borehole string to the nodal space and from the nodal space upward to the surface region through the second borehole string; and wherein at least one of the at least one borehole configurations comprises a third borehole string extending downward from the surface region, the third borehole string having a distal end at the nodal space in the resource deposit.

2. The resource extraction configuration according to claim 1, wherein there are a plurality of borehole configurations, and all of the borehole configurations comprise a respective third borehole string extending downward from the surface region, all of the third borehole strings having a distal end at a respective nodal space in the resource deposit.

3. The resource extraction configuration according to claim 1, wherein the first section of the first borehole string, or the first section of the second borehole string, or the third borehole string, of the at least one borehole configuration are positioned to extend substantially vertical.

4. The resource extraction configuration according to claim 1, wherein the second sections of the first and second borehole strings of the at least one borehole configuration are positioned to extend substantially horizontal parallel direction relative to the surface region.

5. The resource extraction configuration according to claim 1, wherein the resource extraction configuration comprises a plurality of borehole configurations having a plurality of borehole strings, wherein fluid paths through each of laterally extending second sections of a first portion of the plurality of borehole strings extend substantially parallel and adjacent to corresponding fluid paths of a second portion of the plurality of borehole strings.

6. The resource extraction configuration according to claim 5, wherein the plurality of borehole configurations comprises first and second borehole configurations that have first and second nodal spaces and are situated side by side so that a first imaginary straight line runs from the first nodal space towards the first and second borehole strings of the first borehole configuration and a second imaginary straight line runs from the second nodal space towards the first and second borehole strings of the second borehole configuration, wherein the first and second imaginary lines run approximately parallel to one another.

7. The resource extraction configuration according to claim 6, wherein a distance between the parallel first and second lines is 1 kilometer, or less.

8. The resource extraction configuration according to claim 6, wherein a distance between the parallel first and second lines is 200 meters, or less.

9. The resource extraction configuration according to claim 1, wherein the first borehole string of the at least one borehole configuration comprises a third section extending laterally in a third lateral direction from the first section of the first borehole string into the resource deposit; and the second borehole string of the at least one borehole configuration comprise a third section extending laterally in a fourth lateral direction from the first section of the second borehole string into the resource deposit, where the third sections of the first and second borehole strings penannularly extend to form a second planar region, and the third sections of the first and second borehole strings distally connect to form a second nodal space and a second fluid path is formed from the surface region through the first borehole string to the second nodal space and from the second nodal space upward to the surface region through the second borehole string.

10. The resource extraction configuration according to claim 1, wherein the surface region below which the at least one borehole configuration is implemented is twenty five square miles or less.

11. The resource extraction configuration according to claim 1, wherein the surface region below which the at least one borehole configuration is implemented is one square mile or less.

12. The resource extraction configuration according to claim 1, wherein the first borehole string of the at least one borehole configuration comprises a first plurality of sections extending laterally in a first plurality of different lateral directions from the first section of the first borehole string into the resource deposit; the second borehole string of the at least one borehole configuration comprises a second plurality of sections penannularly extending in a second plurality of lateral directions from the first section of the second borehole string into the resource deposit, the first plurality of sections being equal in number to the second plurality of sections, and each section of the first plurality of sections penannularly extends with one section of the second plurality of sections to collectively form a plurality of planar regions, and distally connects with the one section of the second plurality of sections to collectively form a plurality of nodal spaces so that a plurality of fluid paths extend from the surface region through the first borehole string to each of the nodal spaces and from the plurality of nodal spaces upward to the surface region through the second borehole string.

13. The resource extraction configuration according to claim 12, wherein the at least one borehole configuration comprises a first plurality of additional borehole strings that extend downward from the surface region into the resource deposit, each of the additional borehole strings being spaced away from one another and from the first, second and third borehole string, and each of the first plurality of additional borehole strings are distally connected to one of the plurality of nodal spaces.

14. The resource extraction configuration according to claim 13, wherein the first plurality of additional borehole strings is radially disposed relative to the first and second borehole strings.

15. The resource extraction configuration according to claim 13, wherein the at least one borehole configuration comprises a second plurality of additional borehole strings comprising first, second and third boreholes extending in a same manner as the first, second and third borehole strings of the first plurality of additional borehole strings, the second plurality of additional borehole strings comprising second and third extensions oriented so as to be radially disposed relative to the second and third borehole strings, and the second plurality of additional borehole strings is oriented so as to be encircling and intercalating the first plurality of additional borehole strings.

16. A plurality of adjacent borehole configurations that each include a plurality of borehole strings and are associated with adjacent surface regions to facilitate resource extraction from a resource deposit in an underlying subterranean space, each borehole configuration comprising:

a first borehole string extending downward from the surface region into the resource deposit, the first borehole string comprising first and second sections, the first section of the first borehole string extending downward from the surface region and the second section of the first borehole string extending laterally in a first lateral direction from the first section into the resource deposit; and a second borehole string that extends downward from the surface region into the resource deposit, the second borehole string situated adjacent to the first borehole string and comprising first and second sections, the first section of the second borehole string extending downward from the surface region and the second section of the second borehole string extending laterally in a second lateral direction from the first section of the second borehole string into the resource deposit, where the second sections of the first and second borehole strings have walls made of permeable material to allow contact between fluid in the second sections and the resource deposit to allow for in situ leaching of resource material into the second sections and, where proximal portions of the second sections of the first and second borehole strings curve away from one another and then penannularly extend to form a first planar region and to distally connect at a nodal space and form a fluid path from the surface region through the first borehole string to the nodal space and from the nodal space to the surface region through the second borehole string.

17. The plurality of adjacent borehole configurations according to claim 16, wherein each borehole configuration comprises a third borehole string extending downward from the surface region, the third borehole string having a distal end at the nodal space in the resource deposit.

18. The plurality of adjacent borehole configurations according to claim 16, wherein for each borehole configuration in the plurality of adjacent borehole configurations the first borehole string comprises a first plurality of sections extending laterally in a first plurality of different lateral directions from the first section of the first borehole string into the resource deposit; the second borehole string comprises a second plurality of sections extending laterally in a second plurality of lateral directions from the first section of the second borehole string into the resource deposit, the first plurality of sections being equal in number to the second plurality of sections, and each section of the first plurality of sections penannularly extends with one section of the second plurality of sections to collectively form a plurality of planar regions, and distally connects with the section of the second plurality of sections to collectively form a plurality of nodal spaces so that a plurality of fluid paths are formed from the surface region through the first borehole string to each of the nodal spaces and from the plurality of nodal spaces to the surface through the second borehole string.

19. The plurality of adjacent borehole configurations according to claim 16, comprising a plurality of additional borehole strings, each having first and second sections, the first section of each of the additional borehole strings extending downward from the surface region, the second section of each of the additional borehole strings extending in a first lateral direction from the first section, and wherein the plurality of additional borehole strings extend downward from the adjacent surface regions into the resource deposit, where fox each of the plurality of additional borehole strings are spaced away from one another and from the first, second and third borehole strings, and each of the plurality of additional borehole strings are distally connected to one of a plurality of the nodal spaces in a respective borehole configuration.

* * * * *